US007594414B2

(12) United States Patent
Wilding et al.

(10) Patent No.: US 7,594,414 B2
(45) **Date of Patent: *Sep. 29, 2009**

(54) APPARATUS FOR THE LIQUEFACTION OF NATURAL GAS AND METHODS RELATING TO SAME

(75) Inventors: Bruce M. Wilding, Idaho Falls, ID (US); Michael G. McKellar, Idaho Falls, ID (US); Terry D. Turner, Ammon, ID (US); Francis H. Carney, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 405 days.

This patent is subject to a terminal disclaimer.

(21) Appl. No.: 11/381,904

(22) Filed: May 5, 2006

(65) Prior Publication Data

US 2006/0213223 A1 Sep. 28, 2006

Related U.S. Application Data

(60) Continuation-in-part of application No. 11/124,589, filed on May 5, 2005, now Pat. No. 7,219,512, which is a continuation of application No. 10/414,991, filed on Apr. 14, 2003, now Pat. No. 6,962,061, which is a division of application No. 10/086,066, filed on Feb. 27, 2002, now Pat. No. 6,581,409.

(60) Provisional application No. 60/288,985, filed on May 4, 2001.

(51) Int. Cl.
*F25J 1/00* (2006.01)

(52) U.S. Cl. ..... 62/611; 62/613

(58) Field of Classification Search ..... 62/613, 62/611

See application file for complete search history.

(56) References Cited

U.S. PATENT DOCUMENTS 1,222,801 A 4/1917 Rosenbaum (Continued)

FOREIGN PATENT DOCUMENTS

DE 1 443 597 1/1970

(Continued)

OTHER PUBLICATIONS

Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, pp. 1-15.

(Continued)

*Primary Examiner*—William C Doerrler
(74) *Attorney, Agent, or Firm*—TraskBritt

(57) ABSTRACT

An apparatus and method for producing liquefied natural gas. A liquefaction plant may be coupled to a source of unpurified natural gas, such as a natural gas pipeline at a pressure let-down station. A portion of the gas is drawn off and split into a process stream and a cooling stream. The cooling stream passes through an expander creating work output. A compressor may be driven by the work output and compresses the process stream. The compressed process stream is cooled, such as by the expanded cooling stream. The cooled, compressed process stream is divided into first and second portions with the first portion being expanded to liquefy the natural gas. A gas-liquid separator separates the vapor from the liquid natural gas. The second portion of the cooled, compressed process stream is also expanded and used to cool the compressed process stream.

48 Claims, 26 Drawing Sheets

U.S. PATENT DOCUMENTS 2,209,534 A 7/1940 Moore
2,494,120 A 1/1950 Ferro, Jr.
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johanson
3,193,468 A 7/1965 Sprague
3,213,631 A 10/1965 Kniel
3,236,057 A 2/1966 Hashemi-Tafreshi
3,254,496 A 6/1966 Roche et al.
3,292,380 A 12/1966 Bucklin
3,312,073 A 4/1967 Jackson et al.
3,315,475 A 4/1967 Harmens
3,323,315 A 6/1967 Carr
3,326,453 A 6/1967 Kun
3,349,020 A 10/1967 Crownover et al.
3,362,173 A 1/1968 Kniel
3,376,709 A 4/1968 Dickey et al.
3,406,496 A 10/1968 Betteridge et al.
3,407,052 A * 10/1968 Huntress et al. ..... 48/127.3
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,548,606 A 12/1970 Kuerston
3,596,473 A 8/1971 Streich
3,608,323 A 9/1971 Salama
3,616,652 A * 11/1971 Engel ..... 62/613
3,628,340 A 12/1971 Meisler et al.
3,677,019 A * 7/1972 Olszewski ..... 62/613
3,690,114 A * 9/1972 Swearingen et al. ..... 62/613
3,724,225 A 4/1973 Mancini et al.
3,724,226 A 4/1973 Pachalay
3,735,600 A * 5/1973 Dowdell et al. ..... 62/619
3,846,993 A 11/1974 Bates
3,897,226 A 7/1975 Doherty
4,001,116 A 1/1977 Selcukoglu
4,007,601 A 2/1977 Webbon
4,022,597 A 5/1977 Bacon
4,120,911 A 10/1978 Davidson
4,128,410 A 12/1978 Bacon
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradowski
4,359,871 A 11/1982 Strass
4,370,150 A 1/1983 Fenstermaker
4,453,956 A 6/1984 Fabbri et al.
4,479,533 A 10/1984 Persson et al.
4,479,536 A 10/1984 Lameris
4,522,636 A 6/1985 Markbreiter et al.
4,561,496 A 12/1985 Kehrer
4,609,390 A 9/1986 Wilson
4,611,655 A 9/1986 Molignoni
4,654,522 A 3/1987 Gornick et al.
4,798,242 A 1/1989 Kito et al.
4,846,862 A 7/1989 Cook
4,869,313 A 9/1989 Fredley
4,970,867 A 11/1990 Harron et al.
4,993,485 A 2/1991 Gorman
5,003,782 A 4/1991 Kucerija
5,062,270 A 11/1991 Haut et al.
5,174,796 A 12/1992 Davis et al.
5,218,832 A 6/1993 Woolley
5,291,736 A 3/1994 Paradowski
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A * 11/1998 Lynch et al. ..... 62/613
5,916,260 A 6/1999 Dubar
5,956,971 A 9/1999 Cole et al.
5,983,665 A 11/1999 Howard et al.
6,023,944 A 2/2000 Blundell
6,041,620 A * 3/2000 Olszewski et al. ..... 62/612
6,085,546 A * 7/2000 Johnston ..... 62/613
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 * 4/2001 Hass et al. ..... 62/613
6,250,244 B1 6/2001 Dubar et al.
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,390,114 B1 5/2002 Haandrikman et al.
6,400,896 B1 6/2002 Longardner
6,412,302 B1 7/2002 Foglietta
6,427,464 B1 * 8/2002 Beaverson et al. ..... 62/196.3
6,484,533 B1 * 11/2002 Allam et al. ..... 62/643
6,581,409 B2 * 6/2003 Wilding et al. ..... 62/613
6,581,510 B2 6/2003 Koch et al.
6,694,774 B1 2/2004 Rashad et al.
6,767,388 B2 7/2004 Lecomte et al.
6,962,061 B2 * 11/2005 Wilding et al. ..... 62/613
2003/0196452 A1 10/2003 Wilding et al.
2004/0083888 A1 5/2004 Qualls
2004/0105812 A1 6/2004 Tonkovich et al.
2004/0148962 A1 8/2004 Rashad et al.
2005/0220704 A1 10/2005 Morrow et al.
2006/0218939 A1 * 10/2006 Turner et al. ..... 62/4

FOREIGN PATENT DOCUMENTS

EP 0 676 599 A 10/1995
EP 1 205 721 A1 5/2002
JP 11200817 A 7/1996
JP 2002071861 A 3/2002
WO WO 88/00936 2/1988
WO WO 98/59206 12/1998

WO 03/062725 A 7/2003

OTHER PUBLICATIONS

Curtin Unversity of Technology, LNG Microcell Progress Update, May 2002, Curtin/Corelab.
International Search Report dated Sep. 17, 2002 (4 pages).
Mott Corporation, "Porous metal solutions," Jun. 2007, 16 pages.
"Porous Metal Design Guidebook," Metal Powder Industries Federation, Princeton, NJ, <<http://www.mpif.org/designcenter/porous.pdf>>, Jun. 2007, 25 pages.
"The Hydrogen Initiative, Panel on Public Affairs," American Physical Society, Mar. 2004, <http://www.aps.org/public_affairs/popa/reports/index.cfm>.
"Hydrogen as an Energy Carrier and its Production by Nuclear Power," IAEA-TECDOC-1085, International Atomic Energy Agency, May 1999.
"A National Vision of America's Transition to a Hydrogen Economy—To 2030 and Beyond," Based on the results of the National Hydrogen Vision Meeting Washington DC Nov. 15-16, 2001, United States Department of Energy.
"The Hydrogen Economy: Opportunities, Costs, Barriers, and R&D Needs," National Academy of Engineering and Board on Energy and Environmental Systems, 2004, The National Academies Press, <http://books.nap.edu/books/0309091632/html/index.html>.
"Hydrogen Infrastructure Delivery, Reliability R&D Needs," Science Applications International Corporation, Prepared for U.S. Department of Energy, NETL Natural Gas & Infrastructure Reliability Program <www.netl.doe.gov/technologies/oil-gas/publications/td/Final%20White%20Paper%20072604.pdf>.
"Generation of Hydrogen and Transportation and Transmission of Energy Generated on the U.S. Outer Continental Shelf to Onshore," (Minerals Management Service), May 2006.
PCT International Preliminary Report on Patentability and Written Opinion for PCT/US2006/041039 dated Apr. 9, 2009, 7 pp.
PCT International Preliminary Report on Patentability and Written Opinion for PCT/US2007/084677 dated May 28, 2009, 7 pp.

* cited by examiner

APPARATUS FOR THE LIQUEFACTION OF NATURAL GAS AND METHODS RELATING TO SAME

CROSS-REFERENCE TO RELATED APPLICATIONS

This application is a continuation-in-part of U.S. patent application Ser. No. 11/124,589, filed May 5, 2005, now U.S. Pat. No. 7,219,512, issued May 22, 2007, which is a continuation of U.S. patent application Ser. No. 10/414,991, filed Apr. 14, 2003, now U.S. Pat. No. 6,962,061, issued Nov. 8, 2005, which is a divisional of U.S. patent application Ser. No. 10/086,066, filed Feb. 27, 2002, now U.S. Pat. No. 6,581,409, issued Jun. 24, 2003, and which claims the benefit of U.S. Provisional Patent Application Ser. No. 60/288,985, filed May 4, 2001.

This application is also related to U.S. patent application Ser. No. 11/383,411, filed May 15, 2006, U.S. patent application Ser. No. 11/674,984, filed Feb. 14, 2007, U.S. patent application Ser. No. 11/536,477, filed Sep. 28, 2006, U.S. patent application Ser. No. 11/560,682, filed Nov. 16, 2006, U.S. patent application Ser. No. 11/855,071, filed Sep. 13, 2007, and U.S. patent application Ser. No. 09/643,420, filed Aug. 23, 2001, now U.S. Pat. No. 6,425,263, issued Jul. 30, 2002, which is a continuation of U.S. patent application Ser. No. 09/212,490, filed Dec. 16, 1998, now U.S. Pat. No. 6,105,390, issued Aug. 22, 2000, which claims benefit of U.S. Provisional Application No. 60/069,988 filed Dec. 16, 1997, the disclosures of which are hereby incorporated herein in their entirety by this reference.

GOVERNMENT RIGHTS

This invention was made with government support under Contract No. DE-AC07-05ID14517 awarded by the United States Department of Energy. The government has certain rights in this invention.

BACKGROUND OF THE INVENTION

1. Field of the Invention

The present invention relates generally to the compression and liquefaction of gases, and more particularly to the partial liquefaction of a gas, such as natural gas, on a small scale by utilizing a combined refrigerant and expansion process.

2. State of the Art

Natural gas is a known alternative to combustion fuels such as gasoline and diesel. Much effort has gone into the development of natural gas as an alternative combustion fuel in order to combat various drawbacks of gasoline and diesel including production costs and the subsequent emissions created by the use thereof. As is known in the art, natural gas is a cleaner burning fuel than other combustion fuels. Additionally, natural gas is considered to be safer than gasoline or diesel as natural gas will rise in the air and dissipate, rather than settling or accumulating.

To be used as an alternative combustion fuel, natural gas (also termed "feed gas" herein) is conventionally converted into compressed natural gas (CNG) or liquified (or liquid) natural gas (LNG) for purposes of storing and transporting the fuel prior to its use. Conventionally, two of the known, basic processes used for the liquefaction of natural gases are referred to as the "cascade cycle" and the "expansion cycle."

Briefly, the cascade cycle consists of subjecting the feed gas to a series of heat exchanges, each exchange being at successively lower temperatures until the desired liquefaction is accomplished. The levels of refrigeration are obtained with different refrigerants or with the same refrigerant at different evaporating pressures. The cascade cycle is considered to be very efficient at producing LNG as operating costs are relatively low. However, the efficiency in operation is often seen to be offset by the relatively high investment costs associated with the expensive heat exchange and the compression equipment associated with the refrigerant system. Additionally, a liquefaction plant incorporating such a system may be impractical where physical space is limited, as the physical components used in cascading systems are relatively large.

In an expansion cycle, gas is conventionally compressed to a selected pressure, cooled and then allowed to expand through an expansion turbine, thereby producing work as well as reducing the temperature of the feed gas. The low temperature feed gas is then heat exchanged to effect liquefaction of the feed gas. Conventionally, such a cycle has been seen as being impracticable in the liquefaction of natural gas since there is no provision for handling some of the components present in natural gas which freeze at the temperatures encountered in the heat exchangers, for example, water and carbon dioxide.

Additionally, to make the operation of conventional systems cost effective, such systems are conventionally built on a large scale to handle large volumes of natural gas. As a result, fewer facilities are built, making it more difficult to provide the raw gas to the liquefaction plant or facility as well as making distribution of the liquefied product an issue. Another major issue with large-scale facilities is the capital and operating expenses associated therewith. For example, a conventional large-scale liquefaction plant, i.e., producing on the order of 70,000 gallons of LNG per day, may cost $2 million to $15 million, or more, in capital expenses. Also, such a plant may require thousands of horsepower to drive the compressors associated with the refrigerant cycles, making operation of the plants expensive.

An additional problem with large facilities is the cost associated with storing large amounts of fuel in anticipation of future use and/or transportation. Not only is there a cost associated with building large storage facilities, but there is also an efficiency issue related therewith as stored LNG will tend to warm and vaporize over time, creating a loss of the LNG fuel product. Further, safety may become an issue when larger amounts of LNG fuel product are stored.

In confronting the foregoing issues, various systems have been devised which attempt to produce LNG or CNG from feed gas on a smaller scale, in an effort to eliminate long-term storage issues and to reduce the capital and operating expenses associated with the liquefaction and/or compression of natural gas. However, such systems and techniques have all suffered from one or more drawbacks.

U.S. Pat. No. 5,505,232 to Barclay, issued Apr. 9, 1996 is directed to a system for producing LNG and/or CNG. The disclosed system is stated to operate on a small scale, producing approximately 1,000 gallons a day of liquefied or compressed fuel product. However, the liquefaction portion of the system itself requires the flow of a "clean" or "purified" gas, meaning that various constituents in the gas such as carbon dioxide, water, or heavy hydrocarbons must be removed before the actual liquefaction process can begin.

Similarly, U.S. Pat. Nos. 6,085,546 and 6,085,547 both issued Jul. 11, 2000 to Johnston, describe methods and systems of producing LNG. The Johnston patents are both directed to small-scale production of LNG, but again, both require "prepurification" of the gas in order to implement the actual liquefaction cycle. The need to provide "clean" or "prepurified" gas to the liquefaction cycle is based on the fact that certain gas components might freeze and plug the system during the liquefaction process because of their relatively higher freezing points as compared to methane, which makes up the larger portion of natural gas.

Since many sources of natural gas, such as residential or industrial service gas, are considered to be relatively "dirty," the requirement of providing "clean" or "prepurified" gas is actually a requirement of implementing expensive and often complex filtration and purification systems prior to the liquefaction process. This requirement simply adds expense and complexity to the construction and operation of such liquefaction plants or facilities.

In view of the shortcomings in the art, it would be advantageous to provide a process, and a plant for carrying out such a process, of efficiently producing liquefied natural gas on a small scale. More particularly, it would be advantageous to provide a system for producing liquefied natural gas from a source of relatively "dirty" or "unpurified" natural gas without the need for "prepurification." Such a system or process may include various clean-up cycles which are integrated with the liquefaction cycle for purposes of efficiency.

It would be additionally advantageous to provide a plant for the liquefaction of natural gas which is relatively inexpensive to build and operate, and which desirably requires little or no operator oversight.

It would be additionally advantageous to provide such a plant which is easily transportable and which may be located and operated at existing sources of natural gas which are within or near populated communities, thus providing easy access for consumers of LNG fuel.

BRIEF SUMMARY OF THE INVENTION

In accordance with one aspect of the invention, a method is provided for removing carbon dioxide from a mass of natural gas. The method includes cooling at least a portion of the mass of natural gas to form a slurry which comprises at least liquid natural gas and solid carbon dioxide. The slurry is flowed into a hydrocyclone and a thickened slush is formed therein. The thickened slush comprises the solid carbon dioxide and a portion of the liquid natural gas. The thickened slush is discharged through an underflow of the hydrocyclone while the remaining portion of liquid natural gas is flowed through an overflow of the hydrocyclone.

Cooling the portion of the mass of natural gas may be accomplished by expanding the gas, such as through a Joule-Thomson valve. Cooling the portion of the mass of natural gas may also include flowing the gas through a heat exchanger.

The method may also include passing the liquid natural gas through an additional carbon dioxide filter after it exits the overflow of the hydrocyclone.

In accordance with another aspect of the invention, a system is provided for removing carbon dioxide from a mass of natural gas. The system includes a compressor configured to produce a compressed stream of natural gas from at least a portion of the mass of natural gas. At least one heat exchanger receives and cools the compressed stream of natural gas. An expansion valve, or other gas expander, is configured to expand the cooled, compressed stream and form a slurry therefrom, the slurry comprising liquid natural gas and solid carbon dioxide. A hydrocyclone is configured to receive the slurry and separate the slurry into a first portion of liquid natural gas and a thickened slush comprising the solid carbon dioxide and a second portion of the liquid natural gas.

The system may further include additional heat exchangers and gas expanders. Additionally, carbon dioxide filters may be configured to receive the first portion of liquid natural gas for removal of any remaining solid carbon dioxide.

In accordance with another aspect of the invention, a liquefaction plant is provided. The plant includes a plant inlet configured to be coupled with a source of natural gas, which may be unpurified natural gas. A turbo expander is configured to receive a first stream of the natural gas drawn through the plant inlet and to produce an expanded cooling stream therefrom. A compressor is mechanically coupled to the turbo expander and configured to receive a second stream of the natural gas drawn through the plant inlet and to produce a compressed process stream therefrom. A first heat exchanger is configured to receive the compressed process stream and the expanded cooling stream in a countercurrent flow arrangement to cool to the compressed process stream. A first plant outlet is configured to be coupled with the source of unpurified gas such that the expanded cooling stream is discharged through the first plant outlet subsequent to passing through the heat exchanger. A first expansion valve is configured to receive and expand a first portion of the cooled compressed process stream and form an additional cooling stream, the additional cooling stream being combined with the expanded cooling stream prior to the expanded cooling stream entering the first heat exchanger. A second expansion valve is configured to receive and expand a second portion of the cooled compressed process stream to form a gas-solid-vapor mixture therefrom. A first gas-liquid separator is configured to receive the gas-solid-vapor mixture. A second plant outlet is configured to be coupled with a storage vessel, the first gas-liquid separator being configured to deliver a liquid contained therein to the second plant outlet.

In accordance with another aspect of the invention, a method of producing liquid natural gas is provided. The method includes providing a source of unpurified natural gas. A portion of the natural gas is flowed from the source and divided into a process stream and a first cooling stream. The first cooling stream is flowed through a turbo expander where work is produced to power a compressor. The process stream is flowed through the compressor and is subsequently cooled by the expanded cooling stream. The cooled, compressed process stream is divided into a product stream and a second cooling stream. The second cooling stream is expanded and combined with the first expanded cooling stream. The product stream is expanded to form a mixture comprising liquid, vapor and solid. The liquid and solid is separated from the vapor, and at least a portion of the liquid is subsequently separated from the liquid-solid mixture.

In accordance with yet another aspect of the present invention, another liquefaction plant is provided. The liquefaction plant includes a first flow path comprising a first stream of natural gas flowing sequentially through a compressor, a first side of a first heat exchanger and a first side of a second heat exchanger. A second flow path includes a second stream of natural gas flow sequentially through an expander, a second side of the second heat exchanger and a second side of the first heat exchanger. At least two paths, including a cooling path and liquid production path, are formed from the first flow path subsequent flow of the first stream of natural gas through the first side of the second heat exchanger. The cooling path selectively directs at least a first portion of the first stream of natural gas to the second side of the second heat exchanger. The liquid production path selectively directs a second portion of the first stream of natural gas to a gas-liquid separator.

In accordance with a further aspect of the present invention, another method of producing liquid natural gas is provided. The method includes providing a source of unpurified natural gas and flowing a portion of the natural gas from the source. The portion of natural gas is divided into at least a process stream and a cooling stream. The process stream flows sequentially through a compressor, a first side of a first heat exchanger and a first side of a second heat exchanger. The cooling stream flows sequentially through an expander, a second side of the second heat exchanger and a second side of the first heat exchanger. A temperature of the process stream is sensed after it exits the first side of the second heat exchanger. Substantially all of the process stream flows from the first side of the second heat exchanger to the second side of the heat exchanger if the sensed temperature is warmer than a specified temperature. A first portion of the process stream flows from the first side of the second heat exchanger to the second side of the second heat exchanger and a second portion of the process stream flows from the first side of the second heat exchanger to a gas-liquid separator if the sensed temperature is equal to or colder than the specified temperature.

In accordance with yet a further aspect of the present invention, a method of controlling a plurality of valves is provided such that the plurality of valves act cooperatively as a single valve. The method includes defining a number (N) of a plurality of valves. A flow capacity (Cv) is determined for each valve and the Cvs of the individual valves are summed to determine a cumulative flow capacity. A ratio of cumulative flow capacity to individual Cv is determined for each valve. The actuation of each valve is controlled with a proportional, integral, derivative (PID) control loop with a specified output resolution wherein a range of resolution is assigned to each valve based on their respective determined ratios. Each valve is actuated when an output of the PID control loop corresponds with the associated range of the respective valve.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
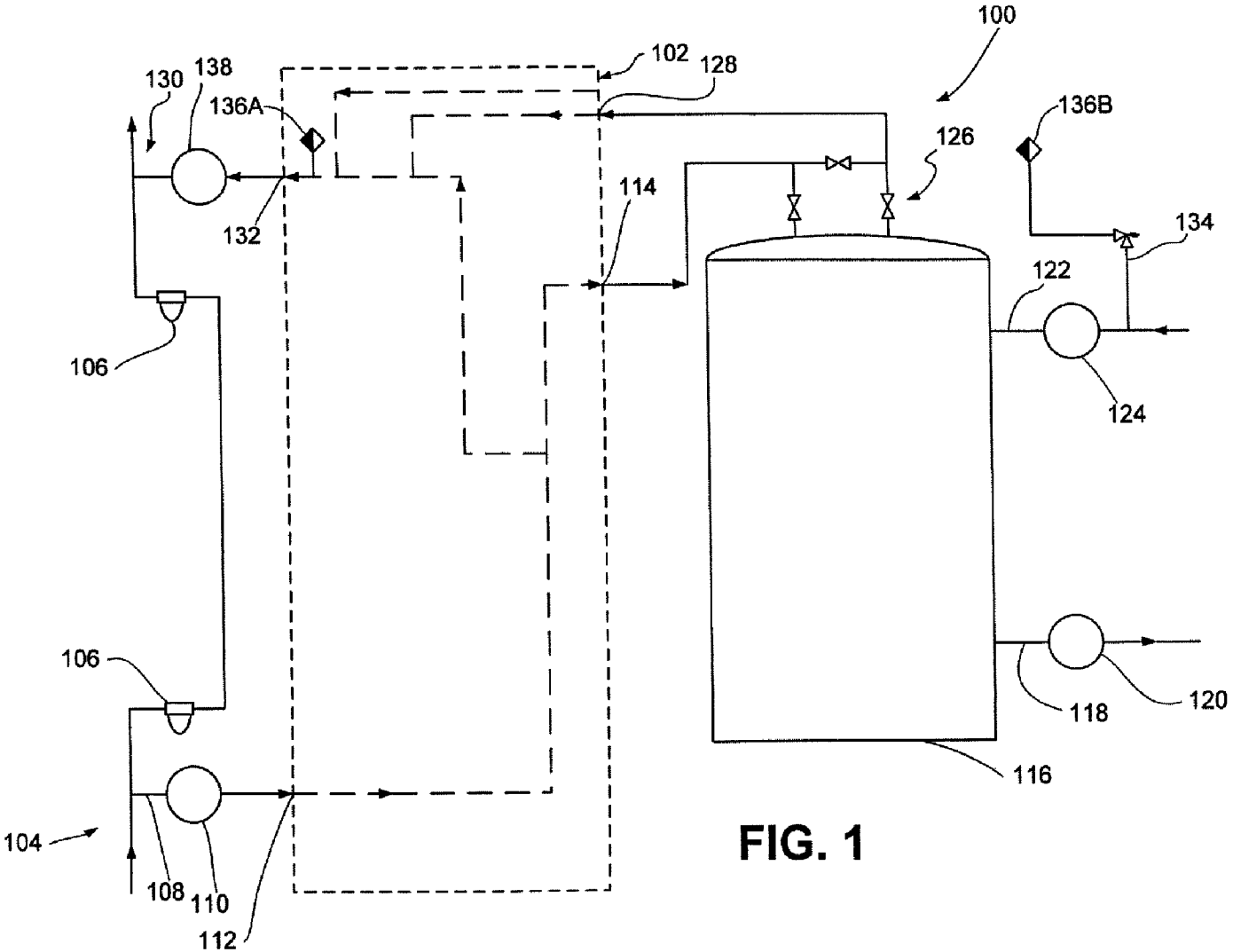
FIG. 1 is a schematic overview of a liquefaction plant according to one embodiment of the present invention.

Referring to FIG. 1, a schematic overview of a portion of a liquefied natural gas (LNG) station 100 is shown according to one embodiment of the present invention. It is noted that, while the present invention is set forth in terms of liquefaction of natural gas, the present invention may be utilized for the liquefaction of other gases as will be appreciated and understood by those of ordinary skill in the art.

The liquefaction station 100 includes a "small-scale" natural gas liquefaction plant 102 which is coupled to a source of natural gas such as a pipeline 104, although other sources, such as a well head, are contemplated as being equally suitable. The term "small-scale" is used to differentiate from a larger-scale plant having the capacity of producing, for example 70,000 gallons of LNG or more per day. In comparison, the presently disclosed liquefaction plant may have the capacity of producing, for example, approximately 10,000 gallons of LNG a day but may be scaled for a different output as needed and is not limited to small-scale operations or plants. Additionally, as shall be set forth in more detail below, the liquefaction plant 102 of the present invention is considerably smaller in physical size than a large-scale plant and may be readily transported from one site to another.

One or more pressure regulators 106 are positioned along the pipeline 104 for controlling the pressure of the gas flowing therethrough. Such a configuration is representative of a pressure letdown station wherein the pressure of the natural gas is reduced from the high transmission pressures at an upstream location to a pressure suitable for distribution to one or more customers at a downstream location. Upstream of the pressure regulators 106, for example, the pressure in the pipeline may be approximately 300 to 1000 pounds per square inch absolute (psia) while the pressure downstream of the regulators may be reduced to approximately 65 psia, or less. Of course, such pressures are merely examples and may vary depending on the particular pipeline 104 and the needs of the downstream customers. It is noted that the available pressure of the upstream gas in the pipeline 104 (i.e., at plant inlet 112) is not critical as the pressure thereof may be raised, for example by use of an auxiliary booster pump, heat exchanger, or both, prior to the gas entering the liquefaction process described herein. It is further noted that the regulators 106 may be positioned near the liquefaction plant 102 or at some distance therefrom. As will be appreciated by those of ordinary skill in the art, in some embodiments such regulators 106 may be associated with, for example, low pressure lines crossing with high pressure lines and one regulator may be associated with a different flow circuit than another regulator.

Prior to any reduction in pressure along the pipeline 104, a stream of feed gas 108 is split off from the pipeline 104 and fed through a flow meter 110 which measures and records the amount of gas flowing therethrough. The stream of feed gas 108 then enters the small-scale liquefaction plant 102 through a plant inlet 112 for processing, as will be detailed hereinbelow. A portion of the feed gas 108 entering the liquefaction plant 102 becomes LNG and exits the liquefaction plant 102 at a plant outlet 114 for storage in a suitable tank or vessel 116. In one embodiment, the vessel 116 is configured to hold at least 10,000 gallons of LNG at a pressure of approximately 30 to 35 psia and at temperatures as low as approximately −240° F. However, other vessel sizes and configurations may be utilized, for example, depending on specific output and storage requirements of the liquefaction plant 102.

A vessel outlet 118 is coupled to a flow meter 120 in association with dispensing the LNG from the vessel 116, such as to a vehicle which is powered by LNG, or into a transport vehicle as may be required. A vessel inlet 122, coupled with a valve/meter set 124 which could include flow and or process measurement devices, enables the venting and/or purging of a vehicle's tank during dispensing of LNG from the vessel 116. Piping 126 associated with the vessel 116 and connected with a second plant inlet 128 provides flexibility in controlling the flow of LNG from the liquefaction plant 102 which also allows the flow to be diverted away from the vessel 116, or for drawing vapor from the vessel 116, should conditions ever make such action desirable.

The liquefaction plant 102 is also coupled to a downstream section 130 of the pipeline 104 at a second plant outlet 132 for discharging the portion of natural gas not liquefied during the process conducted within liquefaction plant 102, along with other constituents which may be removed during production of the LNG. Optionally, adjacent the vessel inlet 122, vent piping 134 may be coupled with piping of liquefaction plant 102 as indicated by interface connections 136A and 136B. Such vent piping 134 will similarly carry gas into the downstream section 130 of the pipeline 104.

As the various gas components leave the liquefaction plant 102 and enter into the downstream section 130 of the pipeline 104 a valve/meter set 138, which could include flow and/or process measuring devices, may be used to measure the flow of gas therethrough. The valve/meter sets 124 and 138, as well as the flow meters 110 and 120, may be positioned outside of the liquefaction plant 102 and/or inside the liquefaction plant 102, as may be desired. Thus, flow meters 110 and 120, when the outputs thereof are compared, help to determine the net amount of feed gas 140 removed from the pipeline 104 as the upstream flow meter 110 measures the gross amount of gas removed and the downstream flow meter 138 measures the amount of gas placed back into the pipeline 104, the difference being the net amount of feed gas 140 removed from pipeline 104. Similarly, optional flow meter 120 and valve/meter set 124 indicate the net discharge of LNG from the vessel 116.

Figure 2:
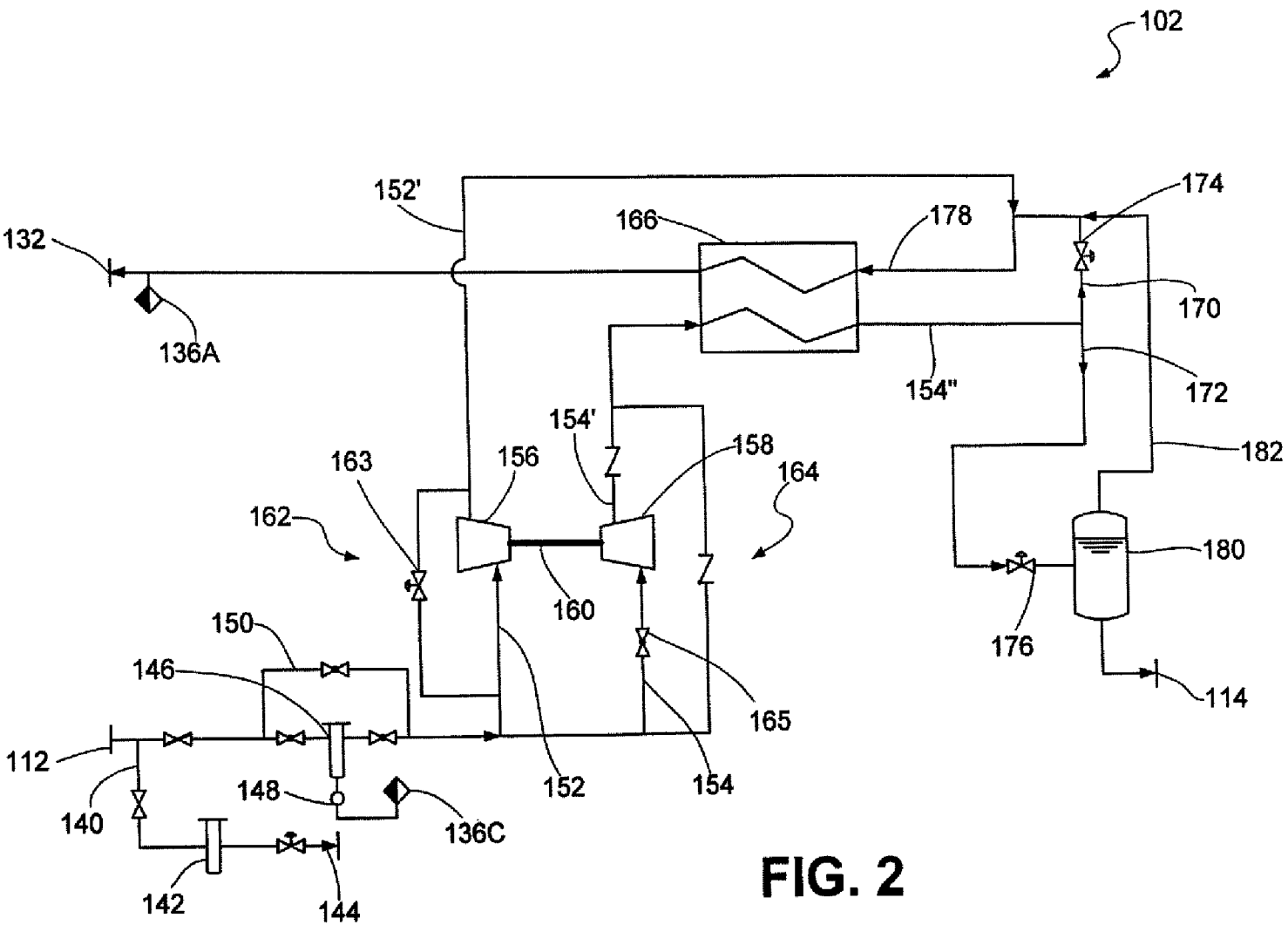
FIG. 2 is a process flow diagram depicting the basic cycle of a liquefaction plant according to one embodiment of the present invention.

Referring now to FIG. 2, a process flow diagram is shown, representative of one embodiment of the liquefaction plant 102 schematically depicted in FIG. 1. As previously indicated with respect to FIG. 1, a high pressure stream of feed gas (i.e., 300 to 1000 psia), for example, at a temperature of approximately 60° F. enters the liquefaction plant 102 through the plant inlet 112. Prior to processing the feed gas 140, a small portion of feed gas 140 may be split off, passed through a drying filter 142 and utilized as instrument control gas in conjunction with operating and controlling various components in the liquefaction plant 102. While only a single stream 144 of instrument gas is depicted, it will be appreciated by those of skill in the art that multiple lines of instrument gas may be formed in a similar manner.

Alternatively, a separate source of instrument gas, such as, for example, nitrogen, may be provided for controlling various instruments and components within the liquefaction plant 102. As will be appreciated by those of ordinary skill in the art, other instrument controls including, for example, mechanical, electromechanical, or electromagnetic actuation, may likewise be implemented.

Upon entry into the liquefaction plant 102, the feed gas 140 flows through a filter 146 to remove any sizeable objects which might cause damage to, or otherwise obstruct, the flow of gas through the various components of the liquefaction plant 102. The filter 146 may additionally be utilized to remove certain liquid and solid components. For example, the filter 146 may be a coalescing type filter. An example filter is available from Parker Filtration, located in Tewksbury, Mass. and is designed to process approximately 5000 standard cubic feet per minute (SCFM) of natural gas at approximately 60° F. at a pressure of approximately 500 psia. Another example of a filter that may be utilized includes a model AKH-0489-DXJ with filter #200-80-DX available from MDA Filtration, Ltd. of Cambridge, Ontario, Canada.

The filter 146 may be provided with an optional drain 148 which discharges into piping near the second plant outlet 132, as is indicated by interface connections 136C and 136A, the discharge ultimately reentering the downstream section 130 of the pipeline 104 (see FIG. 1). Bypass piping 150 is routed around the filter 146, allowing the filter 146 to be isolated and serviced, as may be required, without interrupting the flow of gas through the liquefaction plant 102.

After the feed gas 140 flows through the filter 146 (or alternatively around the filter by way of piping 150) the feed gas 140 is split into two streams, a cooling stream 152 and a process stream 154. The cooling stream 152 passes through a turbo expander 156 and is expanded to an expanded cooling stream 152' exhibiting a lower pressure, for example between approximately 100 psia and atmospheric pressure, at a reduced temperature of approximately −100° F. The turbo expander 156 is a turbine which expands the gas and extracts power from the expansion process. A rotary compressor 158 is coupled to the turbo expander 156 by mechanical means, such as with a shaft 160, and utilizes the power generated by the turbo expander 156 to compress the process stream 154.

The proportion of gas in each of the cooling and process lines 152 and 154, respectively, is determined by the power requirements of the compressor 158, as well as the flow and pressure drop across the turbo expander 156. Vane control valves within the turbo expander 156 may be used to control the proportion of gas between the cooling and process lines 152 and 154, respectively, as is required according to the above stated parameters.

Examples of a turbo expander 156 and compressor 158 system include a frame size ten (10) system available from GE Rotoflow, Inc., located in Gardena, Calif. In one embodiment, the expander 156 and compressor 158 system is designed to operate at approximately 440 psia at 5,000 pounds mass per hour at about 60° F. The expander/compressor system may also be fitted with magnetic bearings to reduce the footprint of the expander 156 and compressor 158, as well as simplify maintenance thereof. In another embodiment, the expander/compressor system may be fitted with gas bearings. Such bearings may utilize a portion of the feed gas flowing through the liquefaction plant 102 or may be supplied with a separate flow of gas such as nitrogen.

Bypass piping 162 routes the cooling stream 152 around the turbo expander 156. Likewise, bypass piping 164 routes the process stream 154 around the compressor 158. The bypass piping 162 and 164 may be used during startup to bring certain components to a steady state condition prior to the processing of LNG within the liquefaction plant 102. For example, the bypass piping 162 and 164 allows the heat exchanger 166, and/or other components, to be brought to a steady state temperature without inducing thermal shock. Additionally, if the pressure of the feed gas 140 is sufficient, the compressor 158 need not be used and the process stream 154 may continue through the bypass piping 164. Indeed, if it is known that the pressure of the feed gas 140 will remain at a sufficiently high pressure, the compressor 158 could conceivably be eliminated. In such a case where the compressor 158 was not being utilized, the work generated by the expander 156 could be utilized to drive a generator or power some other component, if desired.

Without bypass piping 162 and 164, thermal shock might result from the immediate flow of gas from the turbo expander 156 and compressor 154 into certain downstream components. Depending on the design of specific components (i.e., the heat exchanger 166) being used in the liquefaction plant 102, several hours may be required to bring the system to a thermally steady state condition upon start-up of the liquefaction plant 102.

For example, by routing the process stream 154 around the compressor 158, the temperature of the process stream 154 is not increased prior to its introduction into the heat exchanger 166. However, the cooling stream 152, as it bypasses the expander 156, passes through a Joule-Thomson (JT) valve 163 allowing the cooling stream 152 to expand thereby, reducing its temperature. The JT valve 163 utilizes the Joule-Thomson principle that expansion of gas will result in an associated cooling of the gas as well, as is understood by those of ordinary skill in the art. The cooling stream 152 may then be used to incrementally reduce the temperature of the heat exchanger 166.

In one embodiment, as discussed in more detail below, the heat exchanger 166 is a high efficiency heat exchanger made from aluminum. In start-up situations it may be desirable to reduce the temperature of such a heat exchanger 166 by, for example, as much as 1.8° F. per minute until a defined temperature limit is achieved. During start-up of the liquefaction plant 102, the temperature of the heat exchanger 166 may be monitored as it incrementally decreases. The JT valve 163 and other valving 165 or instruments may be controlled, accordingly, in order to effect the rate and pressure of flow in the cooling stream 152 and compressed process stream 154' which ultimately controls the cooling rate of heat exchanger 166 and/or other components of the liquefaction plant 102.

Additionally, during start-up, it may be desirable to have an amount of LNG already present in the tank 116 (FIG. 1). Some of the LNG may be cycled through the system in order to cool various components if so desired or deemed necessary. Also, as will become apparent upon reading the additional description below, other cooling devices, including additional JT valves, located in various "loops" or flow streams may likewise be controlled during start-up in order to cool down the heat exchanger 166 or other components of the liquefaction plant 102.

Upon achieving a steady state condition, the process stream 154 is flowed through the compressor 158 which raises the pressure of the process stream 154. In one embodiment, the ratio of the outlet to inlet pressures of a rotary compressor may be approximately 1.5 to 2.0, with an average ratio being around 1.7. The compression process is not thermodynamically ideal and, therefore, adds heat to the process stream 154 as it is compressed. To remove heat from the compressed process stream 154' it is flowed through the heat exchanger 166 and is cooled to a very low temperature, for example approximately −200° F. The heat exchanger 166 depicted in FIG. 2 is a type utilizing countercurrent flow, as is known by those of ordinary skill in the art although other types may be used.

After exiting the heat exchanger 166, the cooled compressed process stream 154" is split into two new streams, a cooling stream 170 and a product stream 172. The cooling stream 170 and the product stream 172 are each expanded through JT valves 174 and 176, respectively. The expansion of the cooling and process streams 170 and 172 through the JT valves 174 and 176 result in a reduced pressure, such as, for example, between approximately 100 psia and atmospheric, and a reduced temperature, for example, of approximately −240° F. The reduced pressure and temperatures will cause the cooling and product streams 170 and 172 to form a mixture of liquid and vapor natural gas.

The cooling stream 170 is combined with the expanded cooling stream 152' exiting the turbo expander 156 to create a combined cooling stream 178. The combined cooling stream 178 is then used to cool the compressed process stream 154' via the heat exchanger 166. After cooling the compressed process stream 154' in the heat exchanger 166, the combined cooling stream 178 may be discharged back into the natural gas pipeline 104 at the downstream section 130 (FIG. 1). In other embodiments, the cooling streams (e.g., cooling stream 170 and expanded cooling stream 152') could be introduced into the heat exchanger 166 independently. Such cooling streams could remain as independent streams flowing through the heat exchanger 166 or become a combined cooling stream (similar to combined cooling stream 178) while flowing through the heat exchanger 166 or subsequent to their discharge therefrom.

After expansion via the JT valve 176, the product stream 172 enters into a liquid/vapor separator 180. The vapor component from the separator 180 is collected and removed therefrom through line 182 and is added to the combined cooling stream 178 at a location upstream of its entrance into the heat exchanger 166. The liquid component in the separator 180 is the LNG fuel product and passes through the plant outlet 114 for storage in the vessel 116 (FIG. 1).

By controlling the proportion of gas respectively flowing through the cooling and product streams 170 and 172, the thermodynamics of the process will produce a product stream that has a high liquid fraction. If the liquid fraction is high, i.e., greater than 90%, the methane content in the liquid will be high and the heavy hydrocarbons (ethane, propane, etc.) will be low, thus approaching the same composition as the incoming gas stream into plant inlet 112. If the liquid fraction is low, the methane content in the liquid will be low, and the heavy hydrocarbon content in the liquid will be high. The heavy hydrocarbons add more energy content to the fuel, which causes the fuel to burn hotter in combustion processes.

Figure 3:
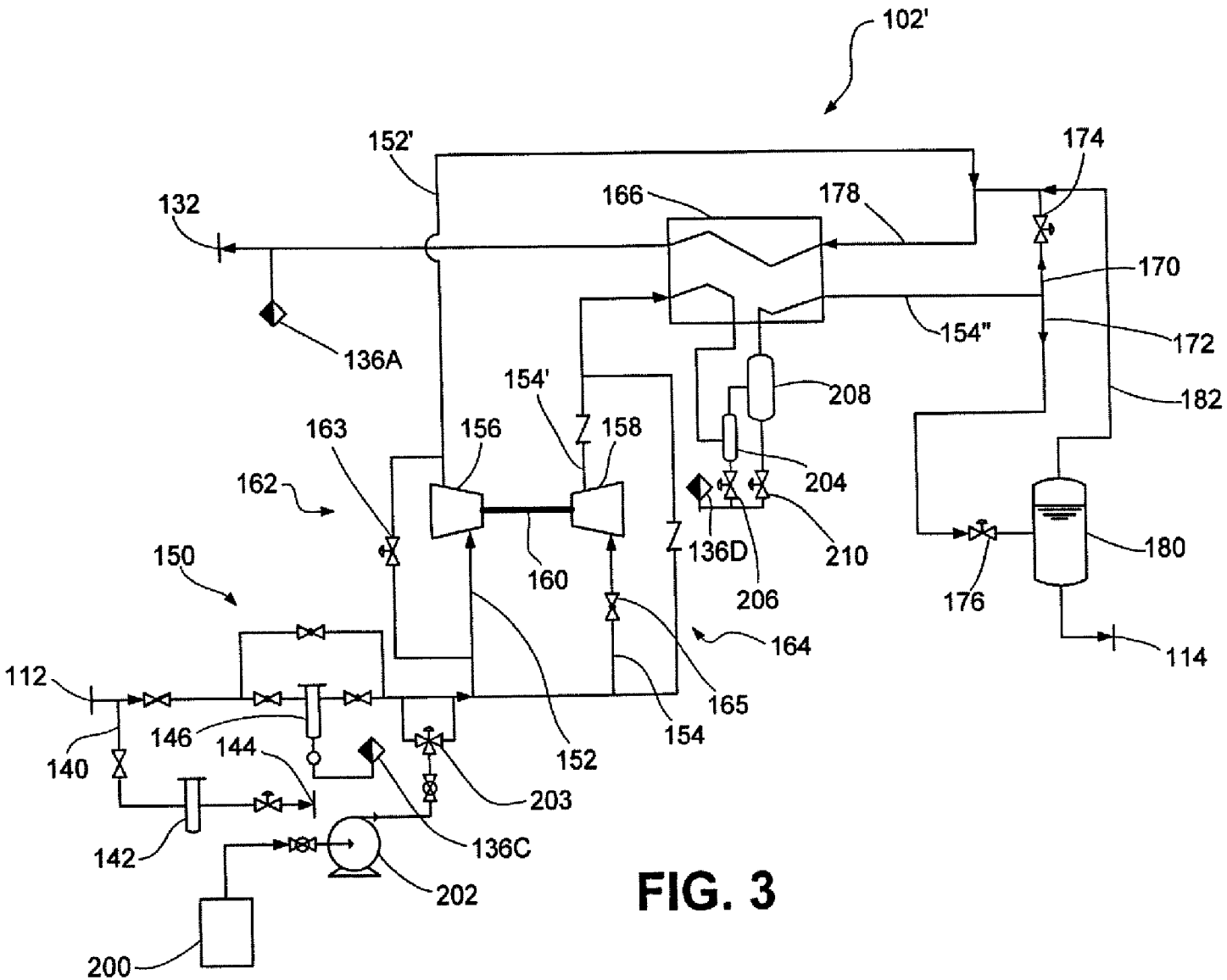
FIG. 3 is a process flow diagram depicting a water clean-up cycle integrated with the liquefaction cycle according an embodiment of the present invention.

Referring now to FIG. 3, a process flow diagram is shown depicting a liquefaction process performed in accordance with another embodiment of a liquefaction plant 102'. As the liquefaction plant 102' and the process carried out thereby share a number of similarities with the liquefaction plant 102 and process depicted in FIG. 2, like components are identified with like reference numerals for sake of clarity.

Liquefaction plant 102' essentially modifies the basic cycle shown in FIG. 2 to allow for removal of water from the natural gas stream during the production of LNG and for prevention of ice formation throughout the system. The water clean-up cycle includes a source of methanol 200, or some other water absorbing product, which is injected into the gas stream, via a pump 202, at a location prior to the gas being split into the cooling stream 152 and the process stream 154. The pump 202 desirably includes variable flow capability to inject methanol 200 into the gas stream such as, for example, by way of at least one of an atomizing or a vaporizing nozzle. In another embodiment, valving 203 may be used to accommodate multiple types of nozzles such that an appropriate nozzle may be selectively utilized depending on the flow characteristics of the feed gas 140 at a given point in time.

A suitable pump 202 for injecting the methanol 200 may include variable flow control in the range of 0.4 to 2.5 gallons per minute (GPM) at a design pressure of approximately 1000 psia for a water content of approximately two to seven pounds mass per millions of standard cubic feet (lbm/mmscf). The variable flow control may be accomplished through the use of a variable frequency drive coupled to a motor of the pump 202. For example, one such pump is available from America LEWA located in Holliston, Mass. as model number EKM7-2-10MM.

The methanol 200 is mixed with the gas stream to lower the freezing point of any water which may be contained therein. The methanol 200 mixes with the gas stream and binds with the water to prevent the formation of ice in the cooling stream 152 during expansion in the turbo expander 156. Additionally, as noted above, the methanol 200 is present in the process stream 154 and passes therewith through the compressor 158. About midway through the heat exchange process (i.e., between approximately −60° F. and −90° F.) the methanol 200 and water become liquid. The compressed process stream 154' is temporarily diverted from the heat exchanger 166 and passed through a separating tank 204 wherein the methanol/water liquid is separated from the compressed process stream 154', the liquid being discharged through a valve 206 and the gas flowing to a coalescing filter 208 to remove an additional amount of the methanol/water mixture. The methanol/water mixture may be discharged from the coalescing filter 208 through a valve 210 with the dried gas reentering the heat exchanger 166 for further cooling and processing. As is indicated by interface connections 136D and 136A, both valves 206 and 210 discharge the removed methanol/water mixture into piping near the second plant outlet 132 for discharge into the downstream section 130 of the pipeline 104 (see FIG. 1).

In one example, a coalescing filter 208 used for removing the methanol/water mixture may be designed to process natural gas at approximately −70° F. at flows of approximately 2500 SCFM and at a pressure of approximately 800 psia. Such a filter may exhibit an efficiency of removing the methane/water mixture to less than 75 ppm/w. A suitable filter is available from Parker Filtration, located in Tewksbury, Mass. Another suitable coalescing filter includes model number RO1-183746 with filter #200-80DX from MDA Filtration, Ltd.

The liquefaction process shown in FIG. 3 thus provides for efficient production of natural gas by integrating the removal of water during the process without expensive equipment and preprocessing required prior to the liquefaction cycle, and particularly prior to the expansion of the gas through the turbo expander 156.

Figure 4:
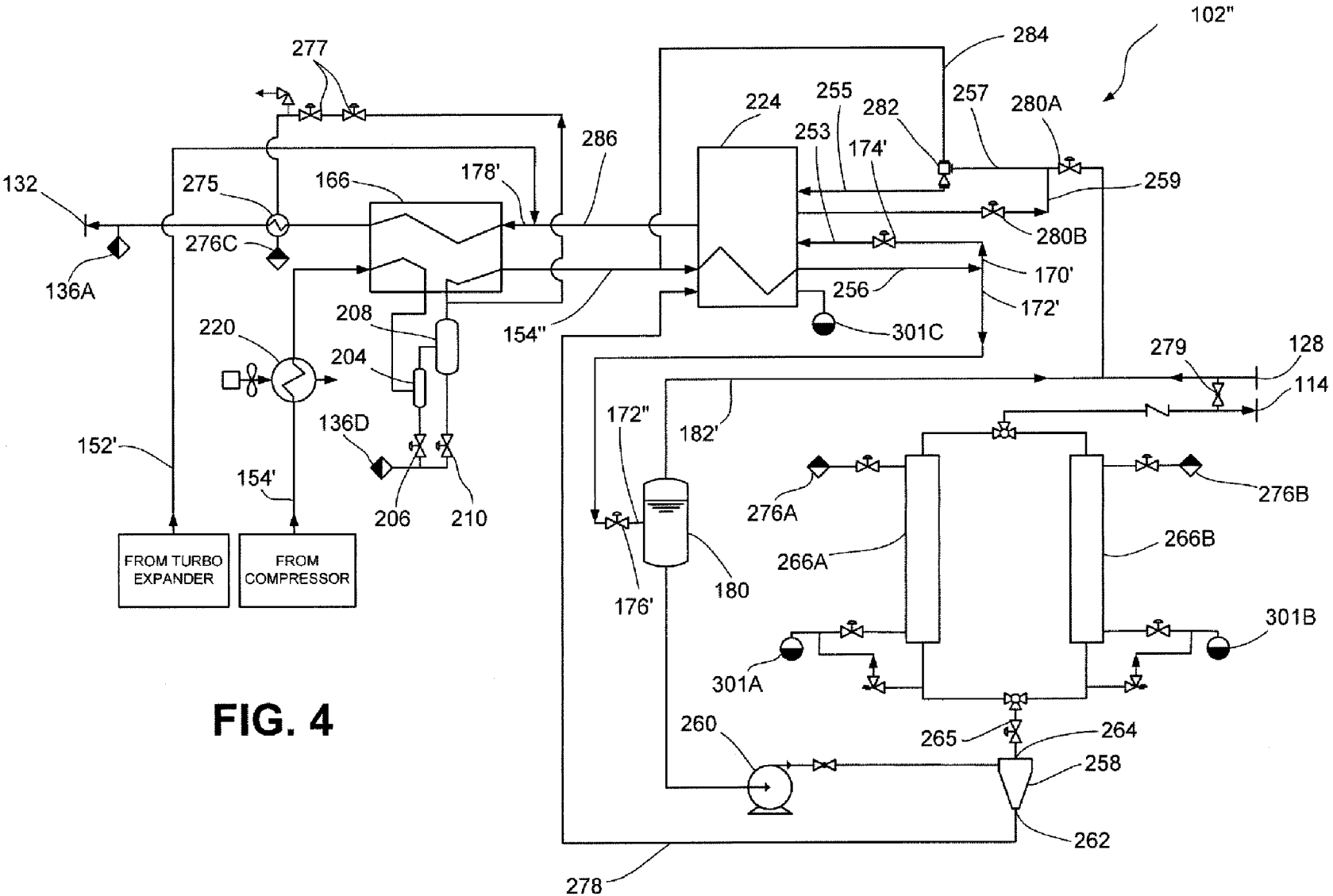
FIG. 4 is a process flow diagram depicting a carbon dioxide clean-up cycle integrated with a liquefaction cycle according to an embodiment of the present invention.

Referring now to FIG. 4, a process flow diagram is shown depicting a liquefaction process performed in accordance with another embodiment of the liquefaction plant 102". As the liquefaction plant 102" and process carried out therein share a number of similarities with liquefaction plants 102 and 102' and the processes depicted in FIGS. 2 and 3 respectively, like components are again identified with like reference numerals for sake of clarity. Additionally, for sake of clarity, the portion of the cycle between the plant inlet 112 and the expander 156/compressor 158 is omitted in FIG. 4, but may be considered an integral part of the liquefaction plant 102" and process shown in FIG. 4.

The liquefaction plant 102" shown in FIG. 4 modifies the basic cycle shown in FIG. 2 to incorporate an additional cycle for removing carbon dioxide ($CO_2$) from the natural gas stream during the production of LNG. While the liquefaction plant 102" and process of FIG. 4 are shown to include the water clean-up cycle described in reference to liquefaction-plant 102' and the process of FIG. 3, the $CO_2$ clean-up cycle is not dependent on the existence of the water clean-up cycle and may be independently integrated with the inventive liquefaction process.

The heat exchange process may be divided or distributed among three different heat exchangers 166, 220 and 224. The first heat exchanger 220 in the flow path of the compressed process stream 154' uses ambient conditions, such as, for example, air, water, or ground temperature or a combination thereof, for cooling the compressed process stream 154'. The ambient condition(s) heat exchanger 220 serves to reduce the temperature of the compressed process stream 154' to ensure that the heat generated by the compressor 158 does not thermally damage the high efficiency heat exchanger 166 which sequentially follows the ambient heat exchanger 220 during the flow of the compressed process stream 154'.

In one example, the ambient heat exchanger 220 may be designed to process the compressed process stream 154' at approximately 6700 to 6800 lbs mass per hour (lbm/hr) at a design pressure of approximately 800 psia. The heat exchanger 220 may further be configured such that the inlet temperature of the gas is approximately 240° F. and the outlet temperature of the gas is approximately 170° F. with an ambient source temperature (i.e., air temperature, etc.) being approximately 100° F. If such a heat exchanger is provided with a fan, such may be driven by a suitable electric motor.

The high efficiency heat exchanger 166, sequentially following the ambient heat exchanger 220 along the flow path, may be formed as a countercurrent flow, plate and fin type heat exchanger. Additionally, the plates and fins may be formed of a highly thermally conductive material such as, for example, aluminum. In one embodiment, the high efficiency heat exchanger 166 may include a model number 01-46589-1 heat exchanger available from Chart Industries, Inc. of La Crosse, Wis.

The high efficiency heat exchanger 166 is positioned and configured to efficiently transfer as much heat as possible from the compressed process stream 154' to the combined cooling stream 178'. The high efficiency heat exchanger 166 may be configured such that the inlet temperature of the gas will be approximately 170° F. and the outlet temperature of the gas will be approximately −105° F. The liquefaction plant 102" is desirably configured such that temperatures generated within the high efficiency heat exchanger 166 are never low enough to generate solid $CO_2$ which might result in blockage in the flow path of the compressed process stream 154'.

The third heat exchanger 224 sequentially located along the flow path of the process stream (sometimes referred to herein as the $CO_2$ heat exchanger 224 for purposes of convenience and clarity) is, in part, associated with the processing of solid $CO_2$ removed from the process stream at a later point in the cycle. More specifically, the $CO_2$ heat exchanger 224 prepares the $CO_2$ for reintroduction into the gas pipeline 104 at the downstream section 130 (see FIG. 1) by subliming the removed solid $CO_2$ in anticipation of its discharge back into the pipeline 104. The sublimation of solid $CO_2$ in the $CO_2$ heat exchanger 224 helps to prevent damage to, or the plugging of, heat exchanger 166. It is noted that heat exchangers 166 and 224 could be combined if desired. The sublimation of the solid $CO_2$ also serves to further chill the process gas in anticipation of the liquefaction thereof.

Figure 5A:
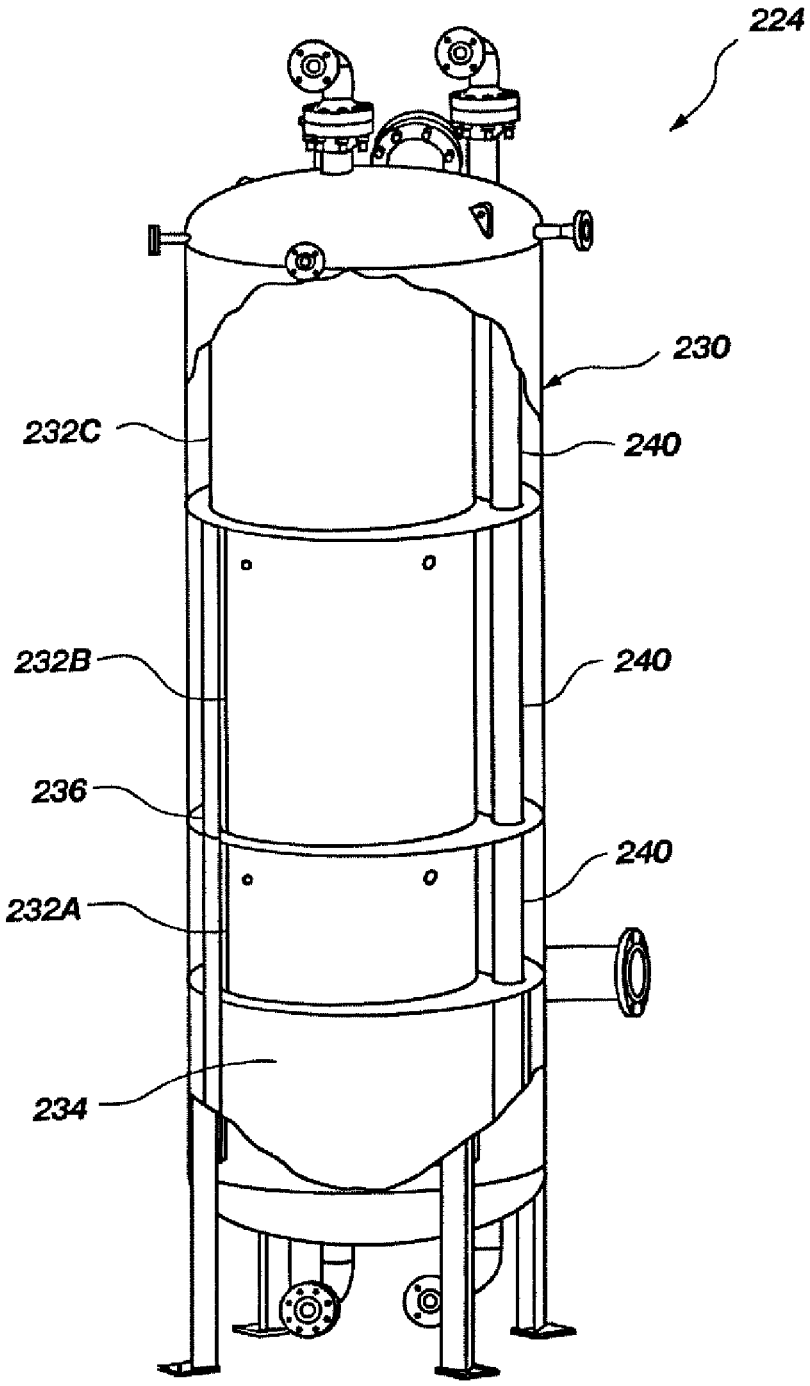
FIGS. 5A and 5B show a heat exchanger according to one embodiment of the present invention.

An example of a heat exchanger 224 used for processing the solid $CO_2$ may include a tube-in-shell type heat exchanger. Referring to FIG. 5A, a tube-in-shell heat exchanger 224 is shown with a portion of the tank 230 stripped away to reveal a plurality of, in this instance three, cooling coils 232A-232C stacked vertically therein. A filter material 234 may also be disposed in the tank 230 about a portion of the lower coil 232A to ensure that no solid $CO_2$ exits the heat exchanger 224. The filter material 234 may include, for example, stainless steel mesh. One or more structural supports 236 may be placed in the tank to support the coils 232A-232C as may be required depending on the size and construction of the coils 232A-232C.

Figure 6B:
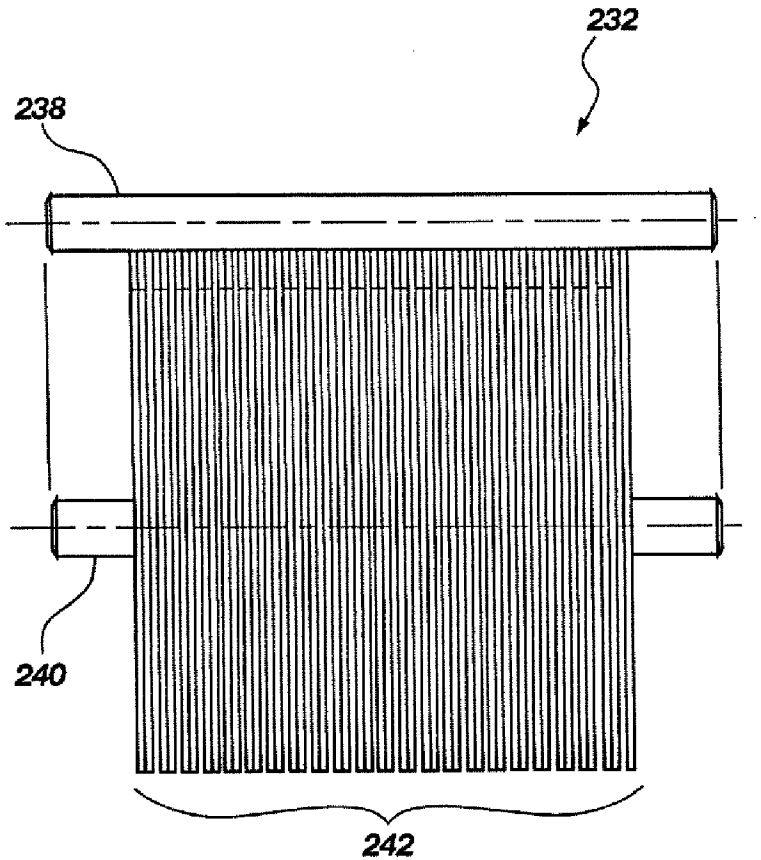
FIGS. 6A and 6B show plan and elevational views of cooling coils used in the heat exchanger of FIGS. 5A and 5B.
Figure 6A:
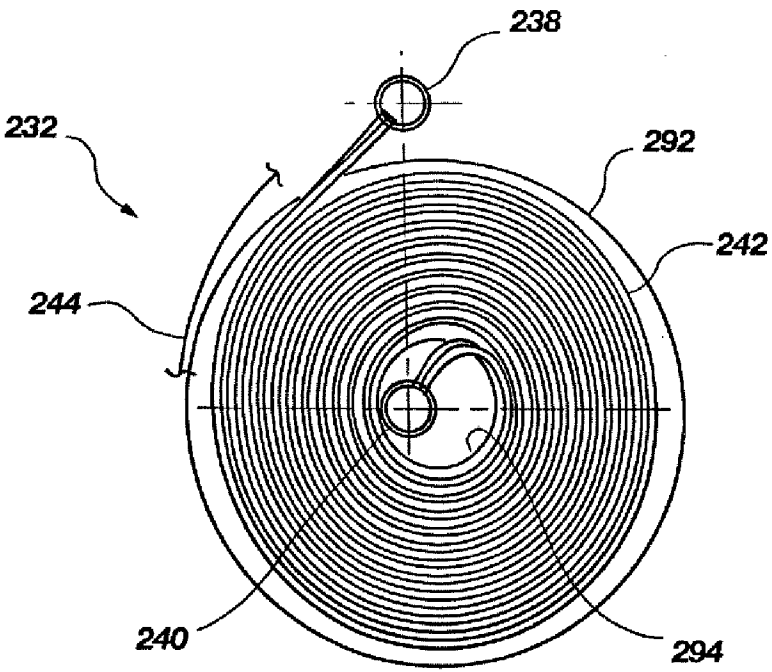

Referring briefly to FIGS. 6A and 6B, an example of a cooling coil 232 may include inlet/outlet pipes 238 and 240 with a plurality of individual tubing coils 242 coupled therebetween. The tubing coils 242 are in fluid communication with each of the inlet/outlet pipes 238 and 240 and are structurally and sealingly coupled therewith. Thus, in operation, fluid may flow into the first inlet/outlet pipe 238 for distribution among the plurality of tubing coils 242 and pass from the tubing coils 242 into the second inlet/outlet pipe 240 to be subsequently discharged therefrom. Of course, if desired, the flow through the cooling coils 232 could be in the reverse direction as set forth below.

A cooling coil 232 may include, for example, inlet/outlet pipes 238 and 240 which are formed of 3-inch diameter, schedule 80 304L stainless steel pipe. The tubing coils 242 may be formed of 304L stainless steel tubing having a wall thickness of 0.049 inch. The cooling coils 232 may further be designed and sized to accommodate flows having, for example, but not limited to, pressures of approximately 815 psia at a temperature between approximately −240° F. and 200° F. Such coils are available from the Graham Corporation located in Batavia, N.Y.

Referring back to FIG. 5A, the ends of the inlet/outlet pipes 238 and 240 of each individual cooling coil, for example coil 232B, are sealingly and structurally coupled to the corresponding inlet/outlet pipes 238 and 240 of each adjacent coil, i.e., 232A and 232C. Such connection may be made, for example, by welding or by other mechanical means.

Figure 5B:
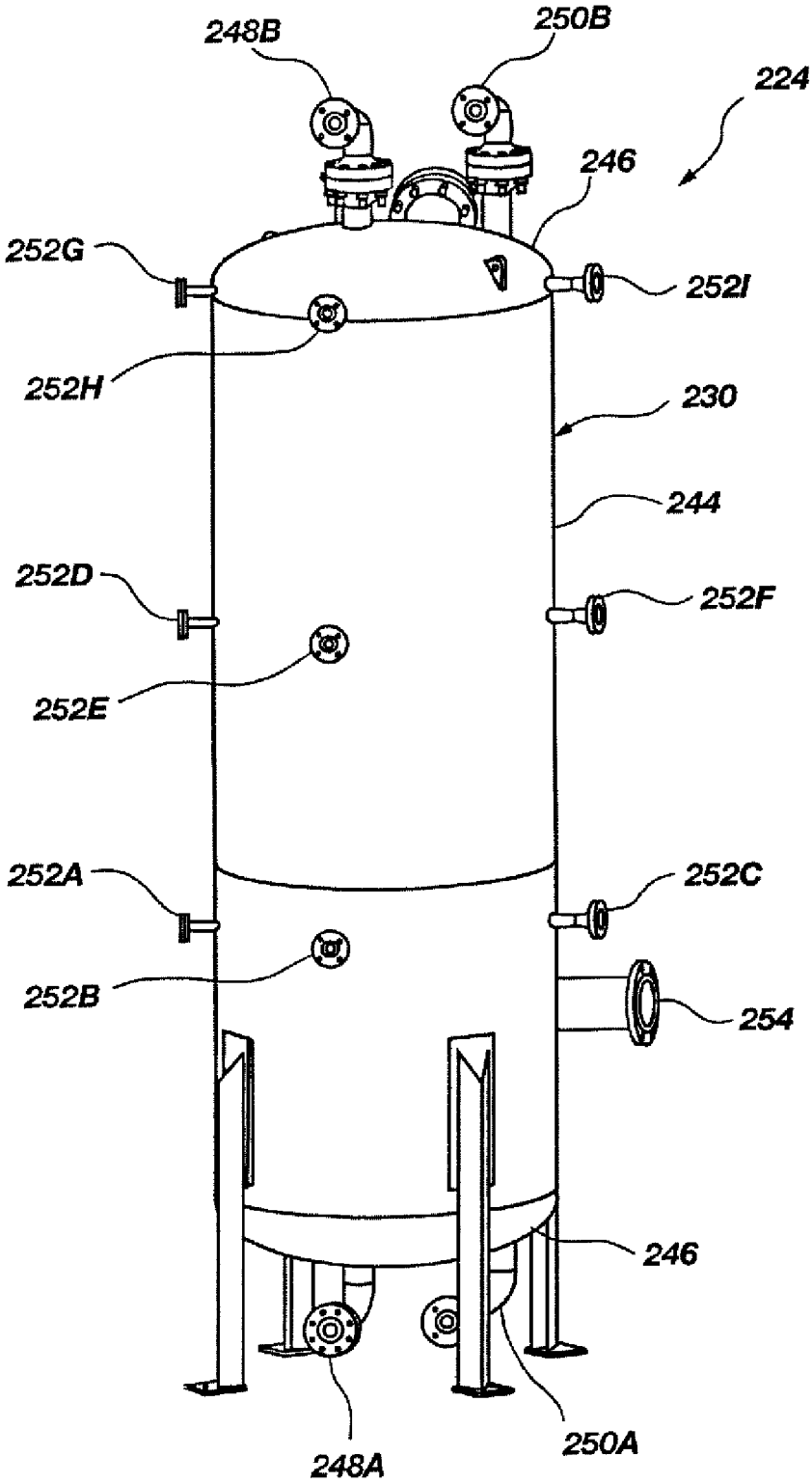

Referring now to FIG. 5B, the tank 230 includes a shell 244 and end caps 246 with a plurality of inlets and outlets coupled therewith. The shell 244 and end caps 246 may be formed of, for example, 304 or 304L stainless steel such that the tank 230 has a design pressure of approximately 95 psia for operating temperatures of approximately −240° F. Desirably, the tank 230 may be designed with adequate corrosion allowances for a minimum service life of 20 years.

Fluid may be introduced into the cooling coils 232A-232C (not shown) through one of a pair of coil inlets 248A and 250A which are respectively coupled with the inlet/outlet pipe(s) 238 and 240 of a cooling coil 232A (not shown). The coil inlets 248A and 250A may be designed, for example, to accommodate a flow of high density gas at approximately 5000 lbm/hr having a pressure of approximately 750 psia at a temperature of approximately −102° F.

A set of coil outlets 248B and 250B are respectively associated with, and sealingly coupled to, the inlet/outlet pipes 238 and 240 of a coil 232C (not shown). Each coil outlet 248B and 250B may be designed, for example, to accommodate a flow of high density fluid of approximately 5000 lbm/hr having a pressure of approximately 740 psia at a temperature of approximately −205° F.

A plurality of tank inlets 252A-252I are coupled with the tank 230 allowing the cooling streams 253 and 255 (FIG. 4), including removed solid $CO_2$, to enter into the tank 230 and flow over one or more coils 232A-232C. For example, tank inlets 252A-252C allow one or more of the cooling streams 253 and 255 to enter the tank 230 and flow over coil 232A, while tank inlets 252D-252F allow one or more of the cooling streams 253 and 255 to enter the tank 230 and flow first over coil 232B and then over coil 232A. The tank inlets 252A-252I may be positioned about the periphery of the shell 244 to provide a desired distribution of the cooling streams 253 and 255 with respect to the coils 232A-232C.

Each tank inlet 252A-252I may be designed to accommodate flows having varying characteristics. For example, tank inlet 252G may be designed to accommodate a slurry of liquid methane having approximately 10% solid $CO_2$ at a mass flow rate of approximately 531 lbm/hr having a pressure of approximately 70 psia and a temperature of approximately −238° F. Tank inlet 252H may be designed to accommodate a flow of mixed gas, liquid and solid $CO_2$ at a flow rate of approximately 1012 lbm/hr exhibiting a pressure of approximately 70 psia and a temperature of approximately −218° F. Tank inlet 252I may be designed to accommodate a flow of mixed gas, liquid and solid $CO_2$ at a flow rate of approximately 4100 lbm/hr exhibiting a pressure of approximately 70 psia and a temperature of approximately −218° F.

It is also noted that, while not shown in the drawings, an interior shell may be formed about the cooling coils 232A-232C such that an annulus may be formed between the interior shell and the shell 244 of tank 230. The interior shell may be configured to control the flow of the entering cooling streams through the various tank inlets 252A-252I such that the cooling streams flow over the cooling coils 232A-232C but do not contact the shell 244 of tank 230 of the heat exchanger 224.

A tank outlet 254 allows for discharge of the cooling streams 253 and 255 after they have passed over one or more cooling coils 232A-232C. The tank outlet 254 may be designed, for example, to accommodate a flow of gas at a mass flow rate of approximately 5637 lbm/hr having a pressure of approximately 69 psia and a temperature of approximately −158° F. In some designs, the tank outlet 254 may be designed to service at a temperature of approximately −70° F.

Figures 7A, 7B, 7C:
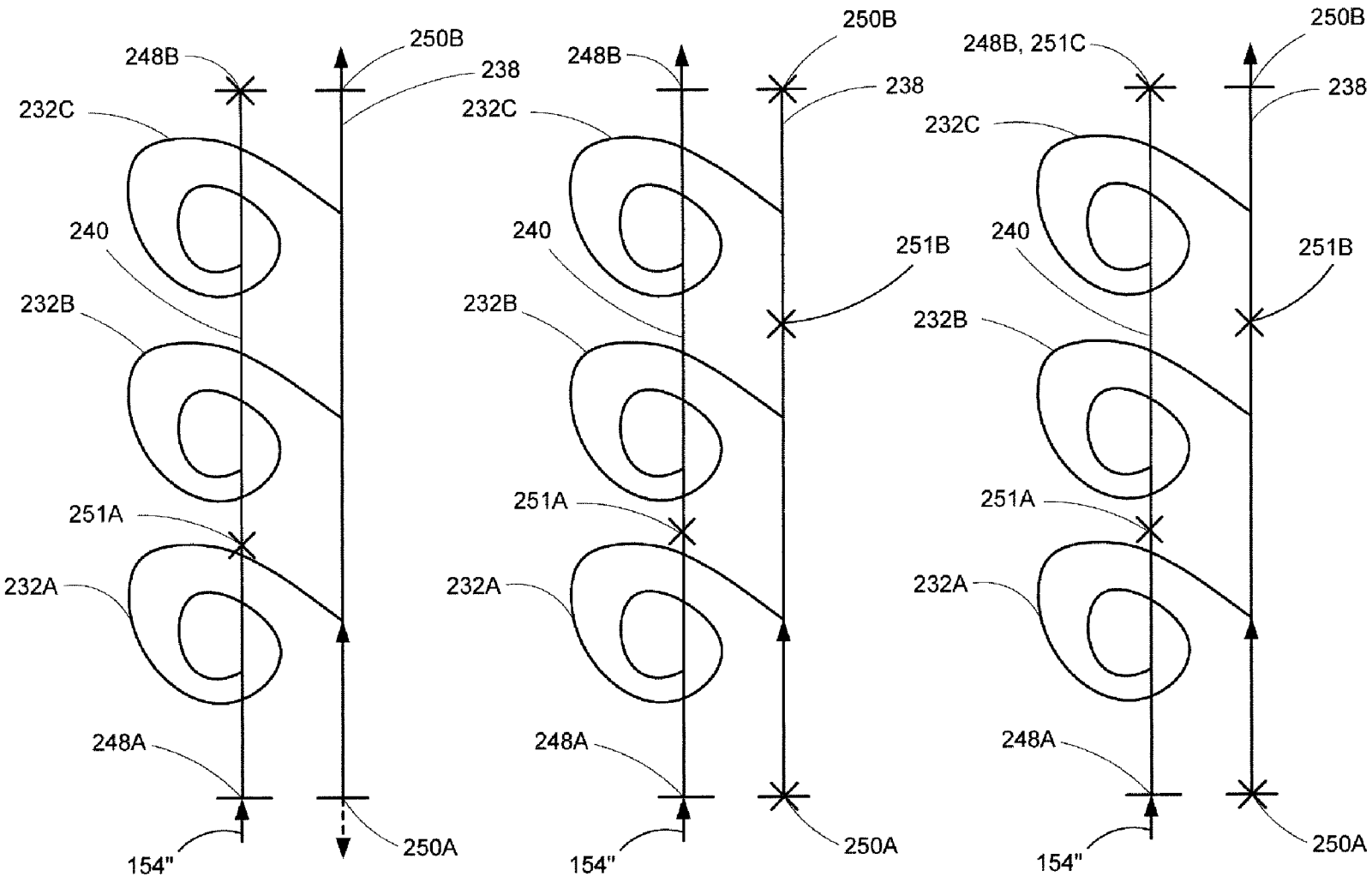
FIGS. 7A through 7C show a schematic of different modes of operation of the heat exchanger depicted in FIGS. 5A and 5B according to various embodiments of the invention.

Referring now to FIGS. 7A through 7C, a schematic is shown of various flow configurations possible with the heat exchanger 224. The heat exchanger 224 may be configured such that the process stream 154" entering through the coil inlet 248A may pass through less than the total number of cooling coils 232A-232C. Thus, if it is desired, the process stream 154" may flow through all three cooling coils 232A-232C, only two of the cooling coils 232A and 232B, or through just one of the cooling coils 232A. For flow through the first coil 232A, appropriate piping will allow the process stream 154" to exit through associated coil outlet 250A. Similarly, if it is desired that the process stream 154" flow through coils 232A and 232B, it may exit through associated coil outlet 250B.

For example, referring to FIG. 7A, the process stream 154" may enter coil inlet 248A to flow, initially, through the inlet/outlet pipe 240. At a location above where the first cooling coil 232A is coupled with the inlet/outlet pipe 240, a flow diverter 251A blocks the process stream 154" forcing it to flow through the first cooling coil 232A. While there may be some transitory flow into the other cooling coils 232B and 232C, the steady state flow of the process stream 154" will be through the inlet/outlet pipe 238 exiting the coil outlet 250B.

Referring to FIG. 7B, it can be seen that the use of two flow diverters 251A and 251B will cause the process stream 154" to traverse through the first cooling coil 232A, as was described with respect to FIG. 7A, and then flow through inlet/outlet pipe 238 until it encounters the second diverter 251B. The second diverter will cause the process stream 154" to flow through the second cooling coil 232B and then through the inlet/outlet pipe 240 through the coil outlet 248B.

Referring to FIG. 7C, it is shown that the use of three flow diverters 251A-251C will caused the process stream 154" to traverse through the first two coils, as was described with respect to FIG. 7B, and then through inlet/outlet pipe 240 (coil inlet 250A being capped off) until it encounters the third flow diverter 251C. The third flow diverter 251C will cause the process stream 154" to flow through the third cooling coil 232C and then through the inlet/outlet pipe 238 exiting the coil outlet 250B. Thus, depending on the placement of the flow diverters 251A-251C, the capacity of the heat exchanger 166 is readily adapted to various processing conditions and output requirements.

Figure 8B:
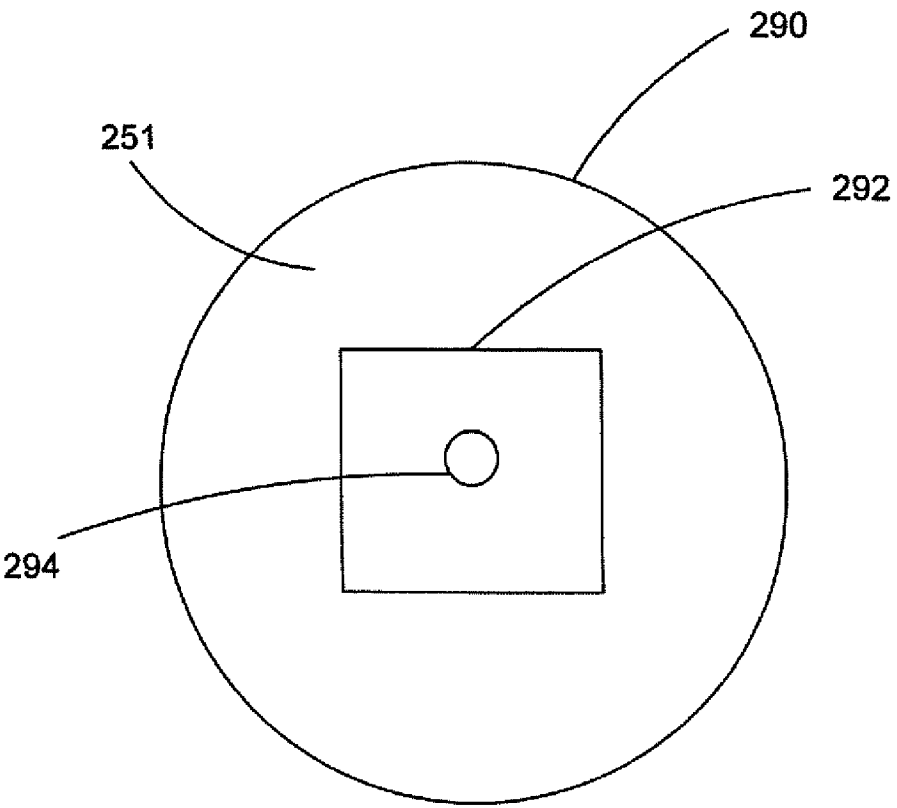
FIGS. 8A and 8B show perspective and elevational views, respectively, of a plug which may be used in conjunction with the heat exchanger of FIGS. 5A and 5B.
Figure 8A:
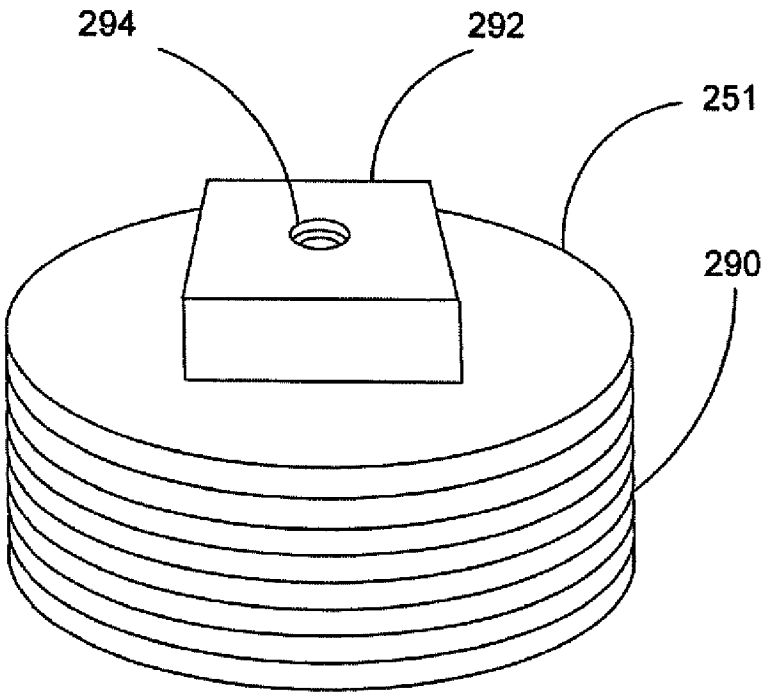

The flow diverters 251A-251C may comprise plugs, valves or blind flanges as may be appropriate. While valves or blind flanges may be easily adapted to the process when located externally to the heat exchanger 224 (e.g., at coil outlet 248B) it is desirable that plugs be used in the internal locations (e.g., for the flow diverters 251A and 251B adjacent the first and second coils, respectively). An example of a plug 251 is shown in FIGS. 8A and 8B. The plug 251 may include a threaded exterior portion 290 for engagement with a cooperatively threaded structure within the inlet/outlet pipes 238 and 240. A keyed head 292 is configured to cooperatively mate with a tool for rotating the plug 251 in association with the plugs' installation or removal from the inlet/outlet pipes 238 and 240. Additionally, a set of interior threads 294 may be formed in the keyed head 292 so as to lockingly engage the installation/removal tool therewith such that the plug 251 may be disposed in an inlet/outlet pipe 238 and 240 of substantial length.

In conjunction with controlling the flow of the process stream 154" through the cooling coils 232A-232C, the cooling stream(s) entering through the tank inlets 252A-252I may be similarly controlled through appropriate valving and piping.

Figure 16:
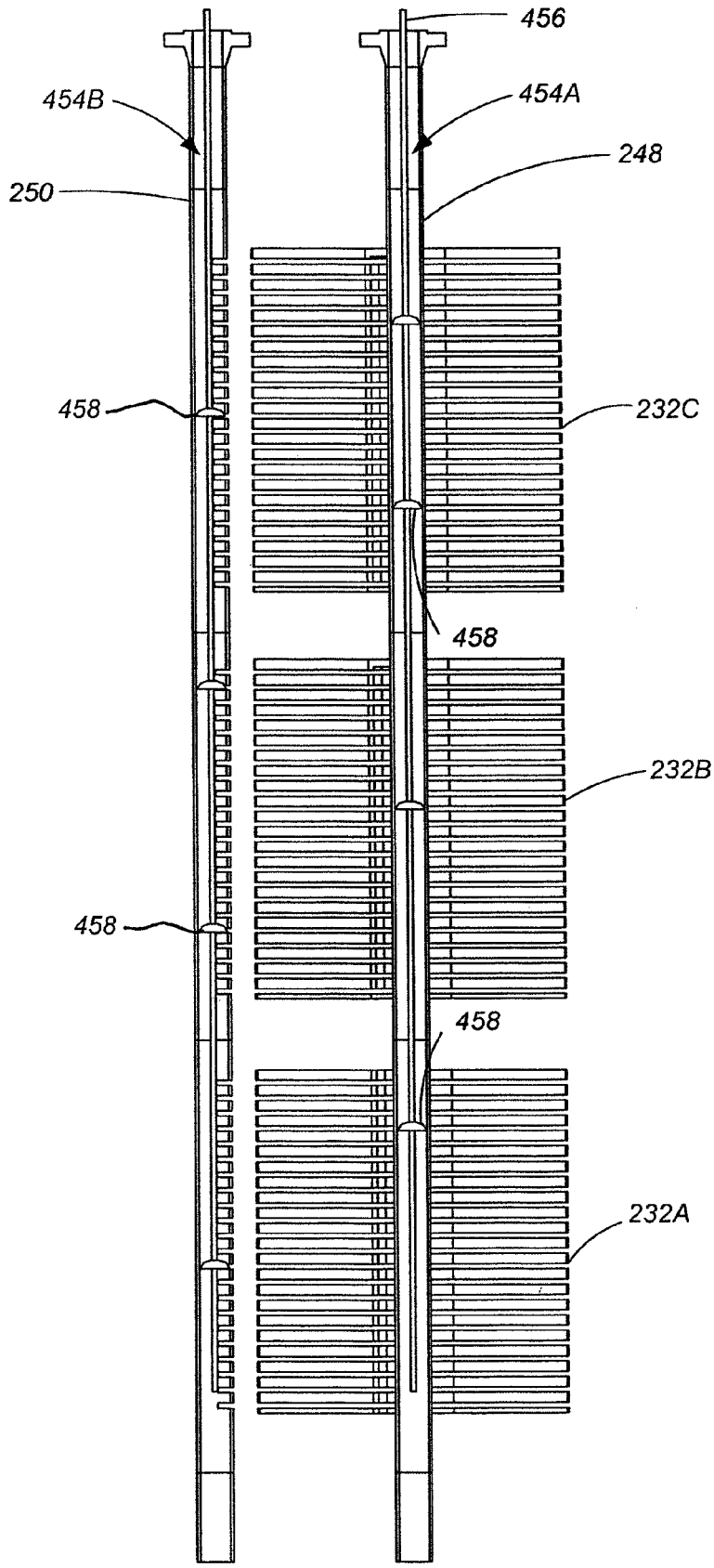
FIG. 16 shows an apparatus used to divert the flow within the coils of the heat exchangers of FIGS. 5A-5C in accordance with an embodiment of the present invention.

Referring briefly to FIG. 16, an apparatus for controlling flow within the cooling coils 232A-232C in accordance with another embodiment of the present invention is shown. As seen in FIG. 16, a first apparatus 454A is disposed within the first tube 248 coupled to the cooling coils 232A-232C and a second apparatus 454B is disposed within the second tube 250 coupled to the cooling coils 232A-232C. Each apparatus 454A and 454B includes a structural member 456 coupled to one or more diverter discs 458 at select locations along the longitudinal extent of their respective structural member 456. It is noted that the diverter discs 458 of the first apparatus 454A may be disposed at different longitudinal locations (or elevations, as viewed in FIG. 16) than the diverter discs 458 of the second apparatus 454B. The location of each diverter disc 458 may be selected so as to effect one of a plurality of desired flow paths such as, for example, has been described hereinabove with respect to FIGS. 7A-7C.

Figure 17:
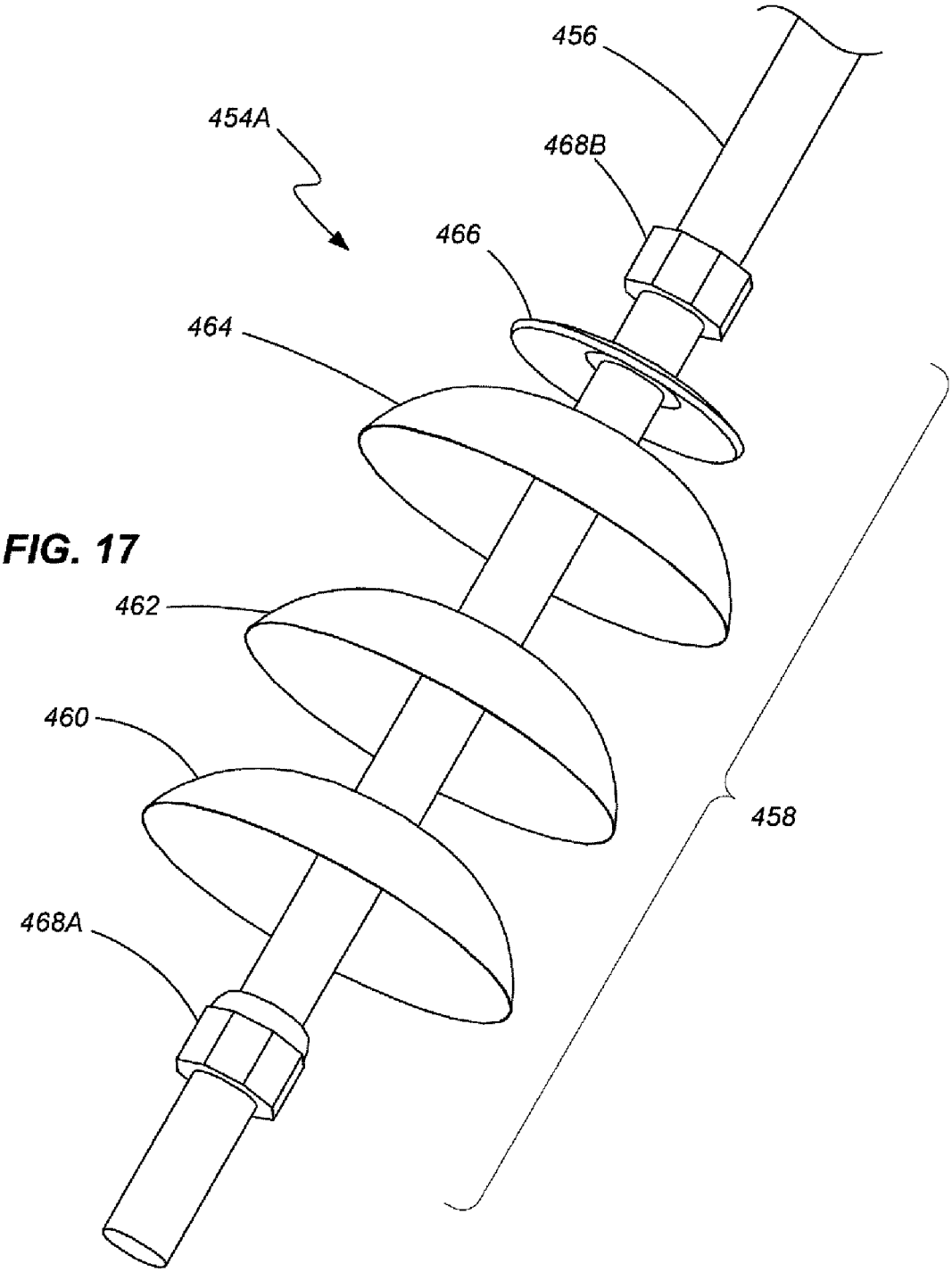
FIG. 17 shows an exploded view of a portion of the apparatus of FIG. 16.

Referring to FIG. 17, in conjunction with FIG. 16, an exploded view of a portion of an apparatus 454A is shown. The structural member 456 of the apparatus 454A includes a substantially elongated member such as, for example, a stainless steel threaded rod. The diverter discs 458 may be formed as discrete components or as an assembly of multiple components. In one particular example, a diverter disc 458 may include a first disc component 460 formed of, for example, stainless steel, a second disc component 462 formed of, for example, polyethylene, a third disc component 464 formed of, for example, stainless steel, and a structural reinforcing component 466 which may also be formed of, for example, stainless steel. When assembled, the various components may be pressed against each other such that the second disc component 462 is sandwiched between the first and third disc components 460 and 464. Appropriate stop members 468A and 468B may be used to fix the disc diverter components 460, 462 and 464, as well as the structural reinforcing member 466, relative to the structural member 456. For example, in the case that the structural member 456 includes a threaded rod, the stop members 468A and 468B may include nuts configured for threaded engagement with the threaded rod. Thus, the diverter discs 458 may be positioned and repositioned as desired by adjusting the stop members 468A and 468B.

In a more specific embodiment, the structural member 456 may include a ½-13, 304 stainless steel threaded rod, the first disc component 460 may include 0.005 inch thick 300 series stainless steel, the second disc component 462 may include polyethylene exhibiting a thickness of 0.003 inch to 0.005 inch, the third disc component 464 may include 0.008 inch thick 300 series stainless steel, the reinforcing component 466 may include 1/16 inch thick 304L stainless steel, the first stop member 468A may include a ½-20 304 stainless steel, pass-through, acorn nut, and the second stop member 468B may include a ½-20 304 stainless steel nut. Of course, other components and other materials may be used to form the apparatus 454A, if desired. In another example, the diverter discs 458 may be coupled structural member 456 by other means such as, for example, welding, adhesive, or with other mechanical fasteners.

Referring back to FIG. 4, as the process stream 154" exits the heat exchanger 224 through line 256, it is divided into a cooling stream 170' and a product stream 172'. The cooling stream 170' passes through a JT valve 174' which expands the cooling stream 170' producing various phases of $CO_2$, including solid $CO_2$, thereby forming a slurry of natural gas and $CO_2$. This $CO_2$ rich slurry enters the $CO_2$ heat exchanger 224 through one or more of the tank inputs 252A-252I to pass over one or more cooling coils 232A-232C (see FIGS. 5A and 5B).

The product stream 172' passes through a JT valve 176' and is expanded to a low pressure, for example approximately 35 psia. The expansion via JT valve 176' also serves to lower the temperature, for example to approximately −240° F. At this point in the process, solid $CO_2$ is formed in the product stream 172'. The expanded product stream 172", now containing solid $CO_2$, enters the liquid/vapor separator 180 wherein the vapor is collected and removed from the separator 180 through line 182' and added to a combined cooling stream 257 for use as a refrigerant in the $CO_2$ heat exchanger 224. The liquid in the liquid/vapor separator 180 will be a slurry comprising the LNG fuel product and solid $CO_2$.

The slurry may be removed from the separator 180 to a hydrocyclone 258 via an appropriately sized and configured pump 260. Pump 260 is primarily used to manage vapor generation resulting from a pressure drop through the hydrocyclone 258. While the pump 260 is schematically shown in FIG. 4 to be external to the liquid/vapor separator 180, the pump may be physically located within the liquid/vapor separator 260 if so desired. In such a configuration, the pump may be submersed in the lower portion of the separator 180. The pump 260 may include a thin wall tube liner, such as a thin wall stainless steel tube, in the outlet portion of the pump 260 to provide a relatively unrestricted flow path leaving the pump 260 in an effort to reduce or eliminate potential plugging that may occur at the exit of the pump with the solid $CO_2$. A suitable pump may be configured to have an adjustable flow rate of approximately 2 to 6.2 gallons per minute (gpm) of LNG with a differential pressure of 80 psi while operating at −240° F. The adjustable flow rate may be controlled by means of a variable frequency drive. An example of one such pump is available from Barber-Nichols located in Arvada, Colo.

In another embodiment, the pump 260 may be eliminated and flow between the separator 180 and the hydrocyclone 258 may be effected through proper pressure management, such as by controlling the pressure differential between the separator 180 and the storage tank 116. Such pressure management may include maintaining a steady state pressure differential between desired components or it may include the development of periodic, or pulsed, pressure differentials to effect the desired flow of slurry from the separator 180.

When using a pump 260, a recirculation line may be directed from the pump 260 back to the separator 180 so that the pump 260 may be operated without pushing liquid through the remainder of the system downstream from the pump 260 (such as the hydrocyclone 258 and polishing filters 266A and 266B). Appropriate piping and valving may also be used to enable a slow and moderate transition, for example, from the slurry flowing completely through the recirculation loop to a partial or full flow of the slurry to the downstream components.

The separator 180 may also include a vortex breaker to prevent or limit the development of a vortex within the separator 180 as may occur due to the operation of the pump 260. In one example, a vortex breaker may be installed at approximately 2 inches above the pump inlet, extend the entire diameter of the separator 180 and exhibit a height of approximately 12 inches.

The hydrocyclone 258 acts as a separator to remove the solid $CO_2$ from the slurry allowing the LNG product fuel to be collected and stored. In one embodiment, the hydrocyclone 258 may be designed, for example, to operate at a pressure of approximately 125 psia at a temperature of approximately −238° F. The hydrocyclone 258 uses a pressure drop to create a centrifugal force which separates the solids from the liquid. A thickened slush, formed of a portion of the liquid natural gas with the solid $CO_2$, exits the hydrocyclone 258 through an underflow 262. The remainder of the liquid natural gas is passed through an overflow 264 for additional filtering. A slight pressure differential, for example, between approximately 0.5 psi and 1.5 psi, exists between the underflow 262 and the overflow 264 of the hydrocyclone 258. Thus, for example, the thickened slush may exit the underflow 262 at approximately 65 psia with the liquid natural gas exiting the overflow 264 at approximately 64.5 psia. However, other pressure differentials may be more suitable depending of the specific hydrocyclone 258 utilized. A control valve 265 may be positioned at the overflow 264 of the hydrocyclone 258 to assist in controlling the pressure differential experienced within the hydrocyclone 258.

A suitable hydrocyclone is available, for example, from Krebs Engineering of Tucson, Ariz. In one example, the hydrocyclone 258 may be configured to operate at design pressures of up to approximately 125 psi within a temperature range of approximately 100° F. to −300° F. Additionally, the hydrocyclone 258 may desirably include an interior surface which is micro-polished to an 8to 12 micro inch finish or better.

Figure 9:
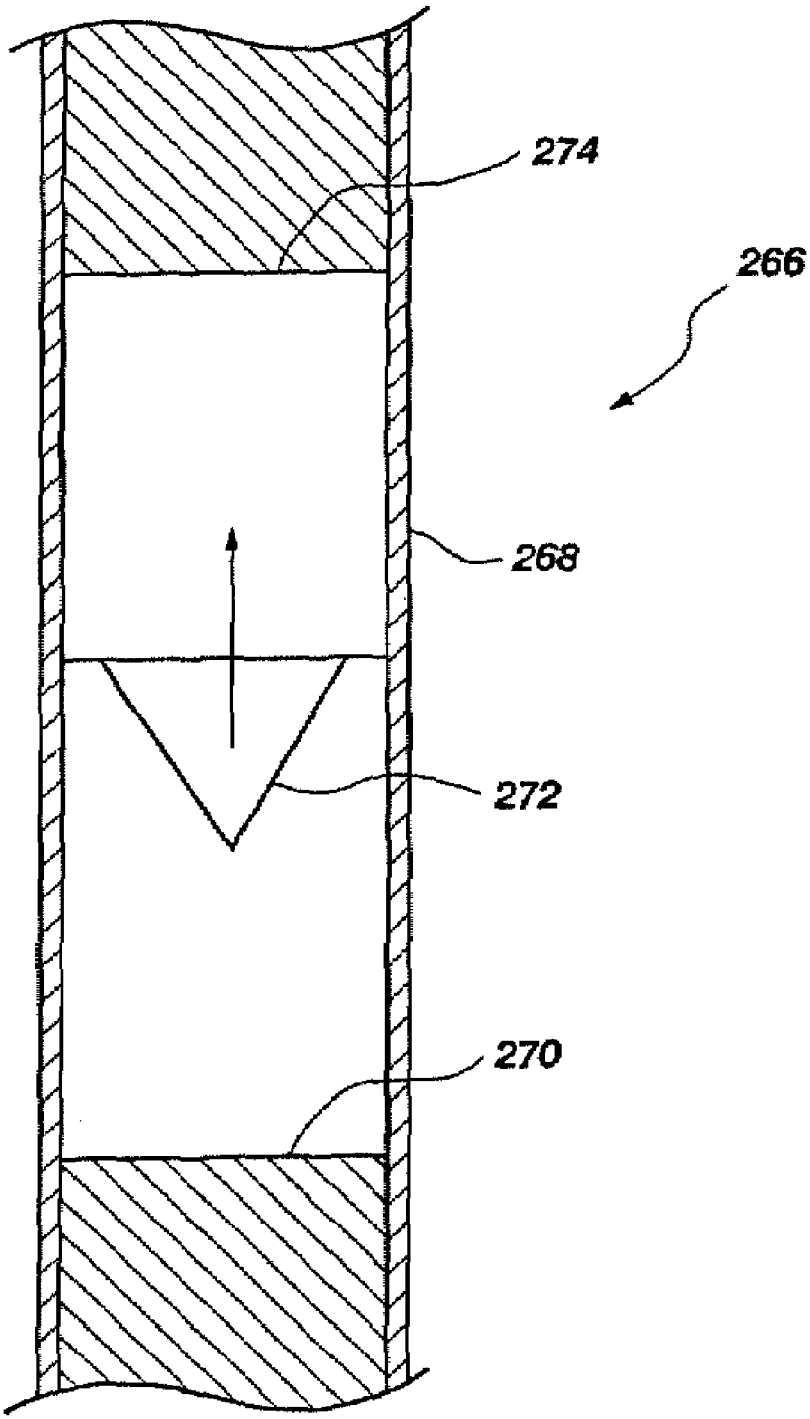
FIG. 9 is a cross-sectional view of a filter used in conjunction with the liquefaction plant and process of FIG. 4.

The liquid natural gas passes through the overflow 264 of the hydrocyclone 258 and may flow through one of a plurality, in this instance two, $CO_2$ screen filters 266A and 266B placed in parallel. The screen filters 266A and 266B capture any remaining solid $CO_2$ which may not have been separated out in the hydrocyclone 258. Referring briefly to FIG. 9, a screen filter 266 may be formed, in one embodiment, of 6-inch schedule 40 stainless steel pipe 268 and include a first filter screen 270 of coarse stainless steel mesh, a second conical shaped filter screen 272 of stainless steel mesh less coarse than the first filter screen 270, and a third filter screen 274 formed of fine stainless steel mesh. For example, in one embodiment, the first filter screen 270 may be formed of 50- to 75-mesh stainless steel, the second filter screen 272 may be formed of 75- to 100-mesh stainless steel and the third filter screen 274 may be formed of 100- to 150-mesh stainless steel. In another embodiment, all three filter screens 270, 272 and 274 may be formed of the same grade of mesh, for example, 40-mesh stainless steel or finer.

The $CO_2$ screen filters 266A and 266B may, from time to time, become clogged or plugged with solid $CO_2$ captured therein. Thus, as one filter, i.e., 266A, is being used to capture $CO_2$ from the liquid natural gas stream, the other filter, i.e., 266B, may be purged of $CO_2$ by passing a relatively high temperature natural gas therethrough in a counter flowing fashion. For example, gas may be drawn after the water clean-up cycle through a fourth heat exchanger 275 as indicated at interface connection 276C to flow through and clean the $CO_2$ screen filter 266B. Gas may be flowed through one or more pressure regulating valves 277 prior to passing through the heat exchanger 275 and into the $CO_2$ screen filter 266B as may be dictated by pressure and flow conditions within the process.

During cleaning of the filter 266B, a cleaning gas may be discharged back to coil-type heat exchanger 224 as is indicated by interface connections 301B and 301C. Appropriate valving and piping allows for the filters 266A and 266B to be switched and isolated from one another as may be required. Other methods of removing $CO_2$ solids that have accumulated on the filters are readily known by those of ordinary skill in the art.

The filtered liquid natural gas exits the liquefaction plant 102" for storage as described above herein. A fail open-type valve 279 may be placed between the lines coming from the plant inlet 128 and outlet 114 as a fail safe device in case of upset conditions either within the liquefaction plant 102" or from external sources, such as the tank 116 (FIG. 1).

The thickened slush formed in the hydrocyclone 258 exits the underflow 262 and passes through piping or underflow stream 278 to heat exchanger 224 where it helps to cool the process stream 154' flowing therethrough. Vapor passing through line 182' from the liquid/vapor separator 180 passes through a pressure control valve and is combined with a portion of gas drawn off heat exchanger 224 through line 259 to form a combined cooling stream 257. The combined cooling stream 257 then passes through an eductor 282. A motive stream 284, drawn from the process stream between the high efficiency heat exchanger 166 and coil-type heat exchanger 224, also flows through the eductor 282 and serves to draw the combined cooling stream 257 into one or more of the tank inlets 252A-252I (FIG. 5B). In one example, the eductor 282 may be configured to operate at a pressure of approximately 764 psia and a temperature of approximately −105° F. for the motive stream, and pressure of approximately 35 psia and temperature of approximately −240° F. for the suction stream with a discharge pressure of approximately 65 psia. Such an eductor is available from Fox Valve Development Corp. of Dover, N.J.

The $CO_2$ slurries introduced into the $CO_2$ heat exchanger 224, either via cooling stream 170', combined cooling stream 257 or underflow stream 278, flow downwardly through the heat exchanger 224 over one or more or cooling coils 232A-232C causing the solid $CO_2$ to sublime. This produces a cooling stream 286 that has a temperature high enough to eliminate solid $CO_2$ therein. The cooling stream 286 exiting the $CO_2$ heat exchanger 224 is combined with the expanded cooling stream 152' from the turbo expander 156 to form combined cooling stream 178' which is used to cool the compressed process stream 154' in the high efficiency heat exchanger 166. Upon exiting the heat exchanger 166, the combined cooling stream 178' is further combined with various other gas components flowing through interface connection 136A, as described throughout herein, for discharge into the downstream section 130 of the pipeline 104 (FIG. 1).

It is noted that, while not specifically shown, a number of valves may be placed throughout the liquefaction plant 102" (or in any other embodiment described herein) for various purposes such as facilitating physical assembly and startup of the liquefaction plant 102" maintenance activities or for collecting of material samples at desired locations throughout the plant 102" as will be appreciated by those of ordinary skill in the art.

Figure 10:
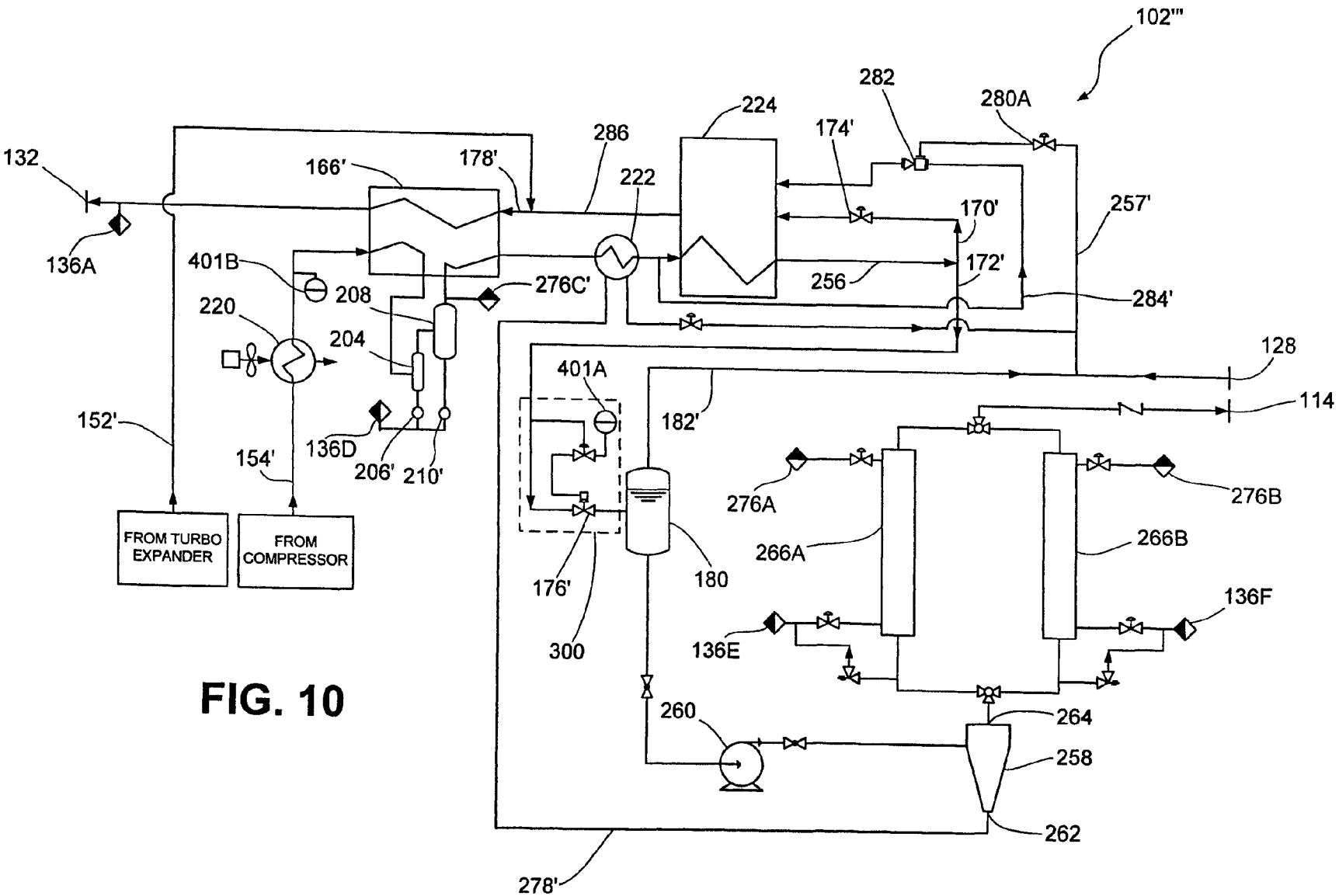
FIG. 10 is a process flow diagram depicting a liquefaction cycle according to another embodiment of the present invention.

Referring now to FIG. 10, a liquefaction plant 102'" according to another embodiment of the invention is shown. The liquefaction plant 102'" operates essentially in the same manner as the liquefaction plant 102" of FIG. 4 with some minor modifications.

A fourth heat exchanger 222 is located along the flow path of the process stream sequentially between high efficiency heat exchanger 166' and the $CO_2$ heat exchanger 224. The fourth heat exchanger 222 is associated with the removal of $CO_2$ and serves primarily to heat solid $CO_2$ which is removed from the process stream at a later point in the cycle, as shall be discussed in greater detail below. The fourth heat exchanger 222 also assists in cooling the gas in preparation for liquefaction and $CO_2$ removal.

The thickened slush formed in the hydrocyclone 258 exits the underflow 262 and passes through piping 278' to heat exchanger 222, wherein the density of the thickened sludge is reduced. As the $CO_2$ slurry exits heat exchanger 222 it combines with any vapor entering through plant inlet 128 (from tank 116 shown in FIG. 1) as well as vapor passing through line 182' from the liquid/vapor separator 180 forming combined cooling stream 257'. The combined cooling stream 257' passes through a pressure control valve 280A and then through an eductor 282. A motive stream 284', drawn from the process stream between the fourth heat exchanger 222 and the $CO_2$ heat exchanger 224, also flows through the eductor 282 and serves to draw the combined cooling stream 257' into one or more of the tank inlets 252A-252I (FIG. 5B).

As with the embodiment described in reference to FIG. 4, the $CO_2$ slurries introduced into the $CO_2$ heat exchanger 224, either via cooling stream 170' or combined cooling stream 257, 257' flow downwardly through the heat exchanger 224 over one or more or cooling coils 232A-232C causing the solid $CO_2$ to sublime. This produces a cooling stream 286 that has a temperature high enough to eliminate solid $CO_2$ therein. The cooling stream exiting heat exchanger 224 is combined with the expanded cooling stream 152' from the turbo expander 156 to form combined cooling stream 178' which is used to cool compressed process stream 154' in the high efficiency heat exchanger 166'. Upon exiting the heat exchanger 166', the combined cooling stream 178' is further combined with various other gas components flowing through interface connection 136A, as described throughout herein, for discharge into the downstream section 130 of the pipeline 104 (FIG. 1).

As with embodiments discussed above, the $CO_2$ screen filters 266A and 266B may require cleaning or purging from time to time. However, in the embodiment shown in FIG. 10, gas may be drawn after the water clean-up cycle at interface connection 276C' and enter into interface connection 276B to flow through and clean $CO_2$ screen filter 266B. During cleaning of the filter 266B, the cleaning gas may be discharged back to the pipeline 104 (FIG. 1) as is indicated by interface connections 136F and 136E. Appropriate valving and piping allows for the filters 266A and 266B to be switched and isolated from one another as may be required. Other methods of removing $CO_2$ solids that have accumulated on the filters are readily known by those of ordinary skill in the art. The filtered liquid natural gas exits the liquefaction plant 102'" for storage as described above herein.

Figure 11:
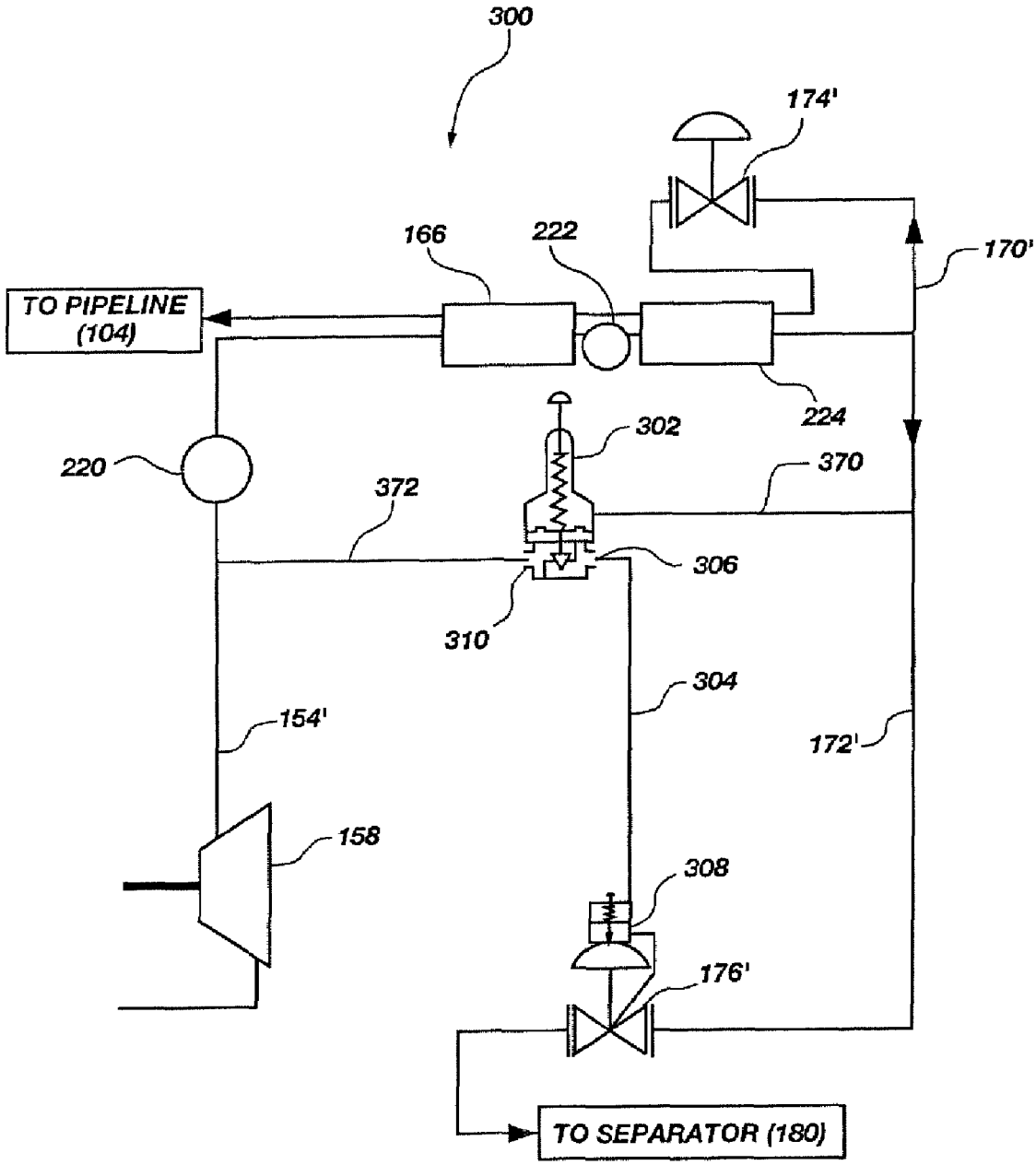
FIG. 11 is a process schematic showing a differential pressure circuit incorporated in the liquefaction plant and process of FIG. 10.

Referring now to FIG. 11, a differential pressure circuit 300 of liquefaction plant 102'" is shown (see FIG. 10). The differential pressure circuit 300 is designed to balance the flow entering the JT valve 176' just prior to the liquid/vapor separator 180 based on the pressure difference between the compressed process stream 154' and the product stream 172'. The JT valve 174' located along cooling stream 170' acts as the primary control valve passing a majority of the mass flow exiting from heat exchanger 224 in order to maintain the correct temperature in the product stream 172'. During normal operating conditions, it is assumed that gas will always be flowing through JT valve 174'. Opening up JT valve 174' increases the flow back into heat exchanger 224 and consequently decreases the temperature in product stream 172'. Conversely, restricting the flow through JT valve 174' will result in an increased temperature in product stream 172'.

JT valve 176' located in the product stream 172' serves to balance any excess flow in the product stream 172' due to variations, for example, in controlling the temperature of the product stream 172' or from surges experienced due to operation of the compressor 158. JT valve 176' is a pilot modulating action pressure relief valve such as, for example, an Iso-Dome Series 400 valve available from Anderson Greenwood located in Stafford, Tex.

A pressure differential control (PDC) valve 302 is disposed between, and coupled to the compressed process stream 154' and the product stream 172' (as is also indicated by interface connections 301A and 301B in FIG. 4). A pilot line 304 is coupled between the low pressure side 306 of the PDC valve 302 and the pilot 308 of JT valve 176'. Both the PDC valve 302 and the pilot 308 of JT valve 176' are biased (e.g., with springs) for pressure offsets to compensate for pressure losses experienced by the flow of the process stream 154' through the circuit containing heat exchangers 166, 222 (if used) and 224.

The following are examples of how the differential pressure circuit 300 may behave in certain operating situations.

In one situation, the pressure and flow increase in the compressed process stream 154' due to fluctuations in the compressor 158. As pressure increases in the compressed process stream 154', the high pressure side 310 of the PDC valve 302 causes the PDC valve 302 to open, thereby increasing the pressure within the pilot line 304 and the pilot 308 of JT valve 176'. After flowing through the various heat exchangers, a new pressure will result in the product stream 172'. With flow being maintained by JT valve 174', excessive process fluid built up in the product stream 172' will result in a reduction of pressure loss across the heat exchangers, bringing the pressure in the product stream 172' closer to the pressure exhibited by the compressed process stream 154'. The increased pressure in the product stream 172' will be sensed by the PDC valve 302 and cause it to close, thereby overcoming the pressure in the pilot line 304 and the biasing element of the pilot 308. As a result, JT valve 176' will open and increase the flow therethrough. As flow increases through JT valve 176' the pressure in the product stream 172' will be reduced.

In a second scenario, the pressure and flow are in a steady state condition in the compressed process stream 154'. In this case, the compressor will provide more flow than will be removed by JT valve 174', resulting in an increase in pressure in the product stream 172'. As the pressure builds in the product stream 172', the PDC 302 valve and JT valve 176' will react as described above with respect to the first scenario to reduce the pressure in the product stream 172'.

In a third scenario, JT valve 174' suddenly opens, magnifying the pressure loss across the heat exchangers 224 and 166 and thereby reducing the pressure in the product stream 172'. The loss of pressure in the product stream 172' will be sensed by the PDC valve 302, thereby actuating the pilot 308 such that JT valve 176' closes until the flow comes back into equilibrium.

In a fourth scenario, JT valve 174' suddenly closes, causing a pressure spike in the product stream 172'. In this case, the pressure increase will be sensed by the PDC valve 302, thereby actuating the pilot 308 and causing JT valve 176' to open and release the excess pressure/flow until the pressure and flow are back in equilibrium.

In a fifth scenario, the pressure decreases in the compressed process stream 154' due to fluctuations in the compressor 158. This will cause the circuit 300 to respond such that JT valve 176' momentarily closes until the pressure and flow balance out in the product stream 172'.

The JT valve 174' is a significant component of the differential pressure circuit 300 as it serves to maintain the split between cooling stream 170' and product stream 172' subsequent the flow of compressed process stream 154' through heat exchanger 224. JT valve 174' accomplishes this by maintaining the temperature of the stream in line 256 exiting heat exchanger 224. As the temperature in line 256 (and thus in cooling stream 170' and process stream 172') drops below a desired temperature, the flow through JT valve 174' may be adjusted to provide less cooling to heat exchanger 224. Conversely as the temperature in line 256 raises above a desired temperature, the flow through JT valve 174' may be adjusted to provide additional cooling to heat exchanger 224.

Figure 12:
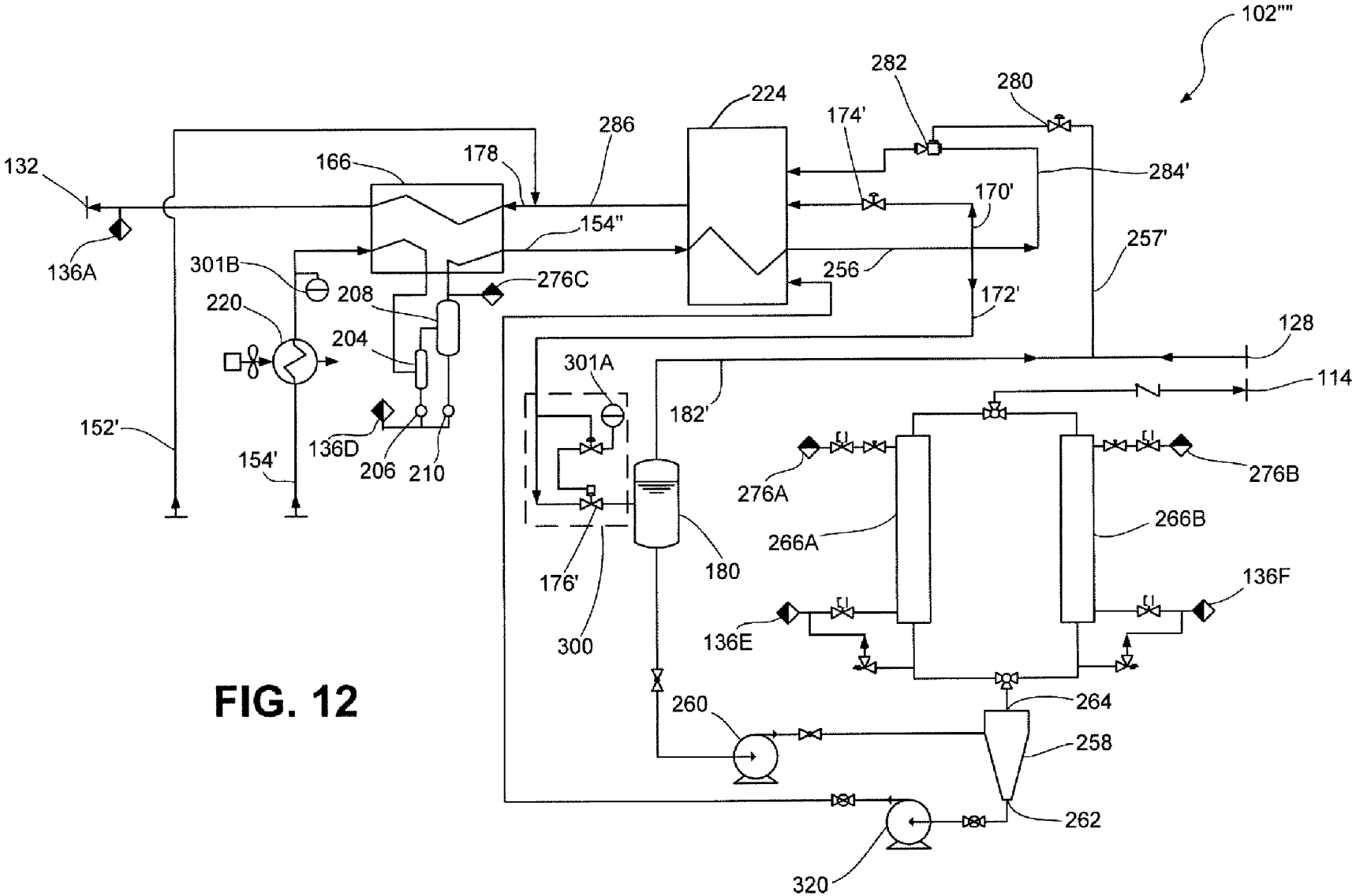
FIG. 12 is a process flow diagram depicting a liquefaction cycle according to another embodiment of the present invention.

Referring now to FIG. 12, a liquefaction plant 102"" and process are shown according to another embodiment of the invention. The liquefaction plant 102"" operates essentially in the same manner as the liquefaction plant 102''' of FIG. 10 with some minor modifications. Rather than passing the thickened $CO_2$ slush from the hydrocyclone 258 through a heat exchanger 222 (FIG. 10), a pump 320 accommodates the flow of the thickened $CO_2$ slush back to heat exchanger 224. The configuration of liquefaction plant 102"" eliminates the need for an additional heat exchanger (i.e., heat exchanger 222 of FIG. 10). However, flow of the thickened $CO_2$ slush may be limited by the capacity of the pump 320 and the density of the thickened slush in the configuration shown in FIG. 10.

Figure 13:
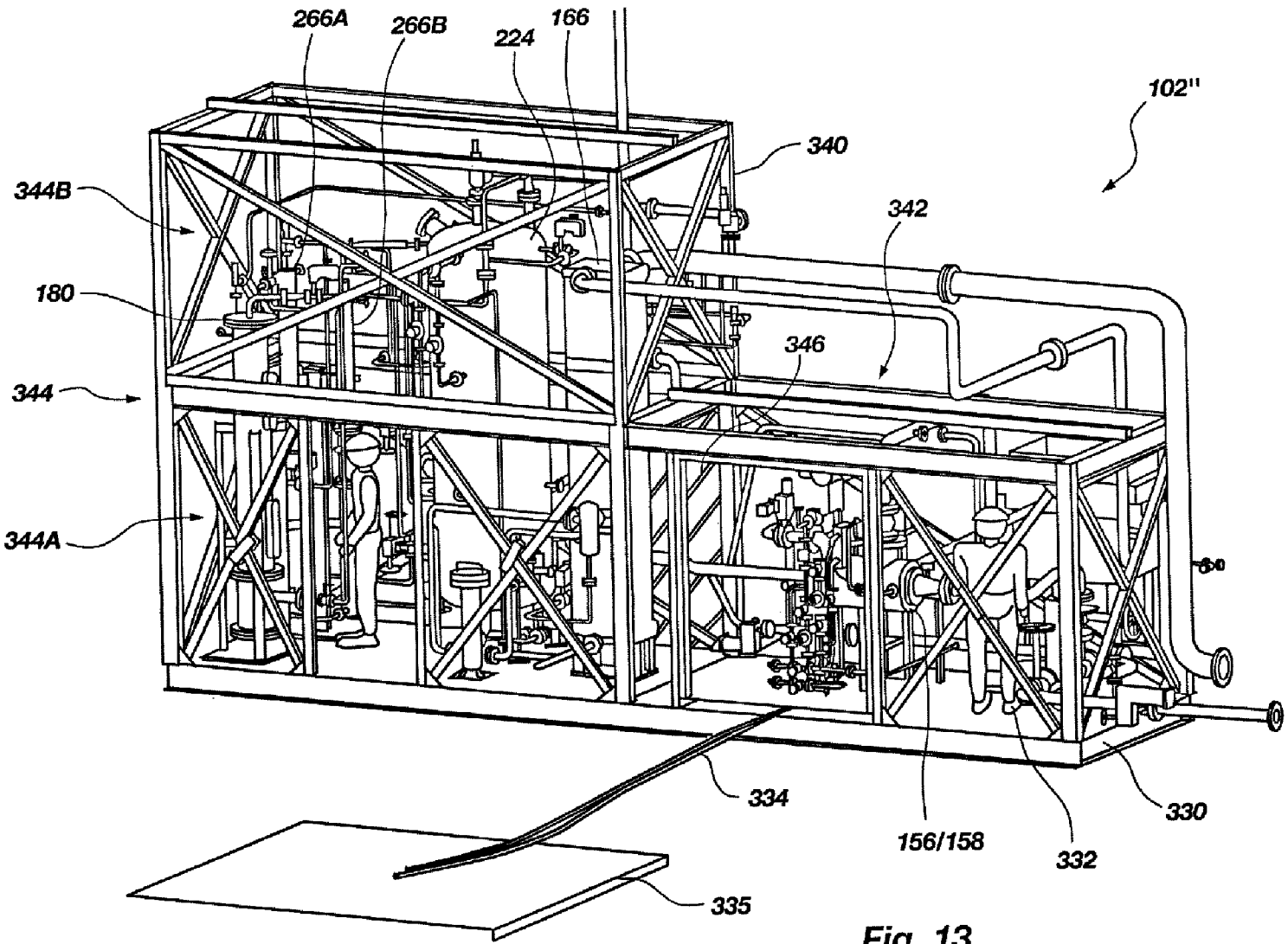
FIG. 13 is a perspective view of a liquefaction plant according to one embodiment of the present invention.

Referring now to FIG. 13, the physical configuration of liquefaction plant 102" described in reference to FIG. 4 is shown according to one embodiment thereof. Substantially an entire liquefaction plant 102" may be mounted on a supporting structure such as a skid 330 such that the liquefaction plant 102" may be moved and transported as needed. Pointing out some of the major components of the liquefaction plant 102", the turbo expander 156/compressor 158 is shown on the right hand portion of the skid 330. A human operator 332 is shown next to the turbo expander 156/compressor 158 to provide a general frame of reference regarding the size of the plant 102". Generally, the overall plant may be configured, for example, to be approximately 30 feet long, 16 feet high and 8½ feet wide.

The high efficiency heat exchanger 166 and the heat exchanger 224 used for sublimation of solid $CO_2$ are found on the left hand side of the skid 330. The parallel $CO_2$ filters 266A and 226B can be seen adjacent heat exchanger 224. Wiring 334 may extend from the skid 330 to a remote location, such as a separate pad 335 or control room, for controlling various components, such as, for example, the turbo expander 156/compressor 158, as will be appreciated and understood by those of skill in the art. Additionally, pneumatic and/or hydraulic lines may extend from the skid 330 for control or external power input as may be desired. It is noted that by remotely locating the controls, or at least some of the controls, costs may be reduced as such remotely located controls and instruments need not have, for example, explosion proof enclosures or other safety features as would be required if located on the skid 330.

It is also noted that a framework 340 may be mounted on the skid 330 and configured to substantially encompass the liquefaction plant 102". A first section 342, exhibiting a first height, is shown to substantially encompass the volume around the turbo expander 156 and compressor 158. A second section 344 substantially encompasses the volume around the heat exchangers 166, 224, filters 266A and 266B and other components which operate at reduced temperatures. The second section 344 includes two subsections 344A and 344B with subsection 344A being substantially equivalent in height to section 342. Subsection 344B extends above the height of section 342 and may be removable for purposes of transportation as discussed below. The piping associated with the plant 102" may be insulated for purposes of minimizing unwanted heat transfer. Alternatively, or in combination with insulated pipes, an insulated wall 346 may separate first section 342 from second section 344 and from the external environs of the plant 102". Additionally, insulated walls 346 may be placed on the framework 340 about the exterior of the liquefaction plant 102" to insulate at least a portion of the liquefaction plant 102" from ambient temperature conditions which might reduce the efficiency of the liquefaction plant 102".

In one embodiment, the liquefaction liquefaction plant 102" may be strategically designed such that the plant may be separated into two or more sections. For example, sections or subsections of the liquefaction plant 102" may be designed for physical separation from one another such that one section or subsection may be transported independent of the other sections or subsections. In one embodiment, the liquefaction plant 102" may be divided into sections or subsections such that, for example, one section includes so called "hot" components (e.g., those components not being thermally insulated from ambient conditions) and one section includes so called "cold" components (e.g., those components that are to be thermally insulated from ambient conditions).

Figure 14:
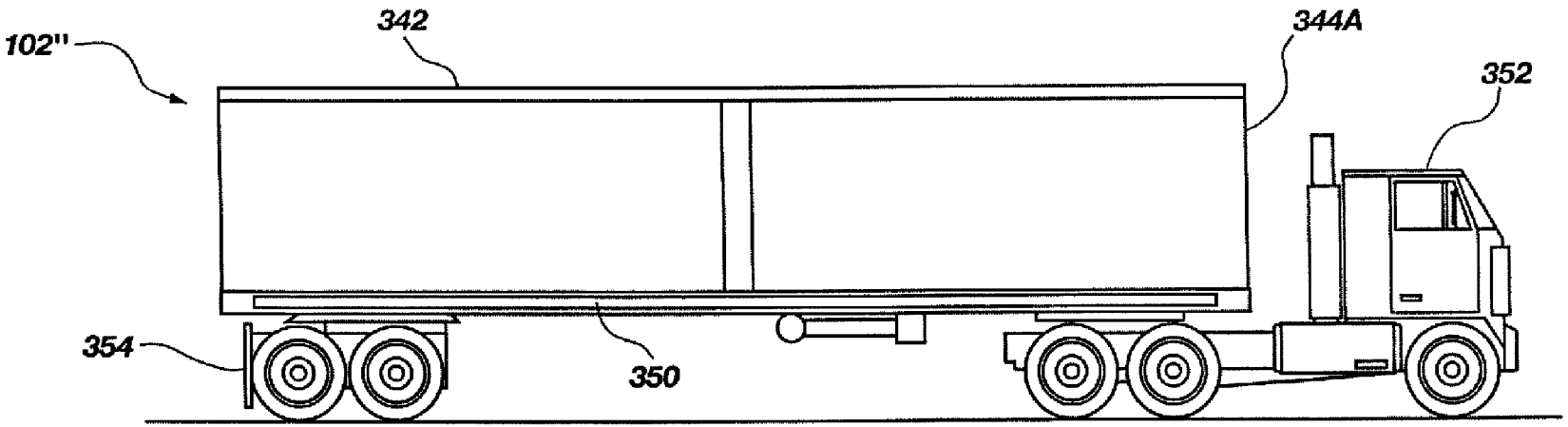
FIG. 14 shows the liquefaction plant of FIG. 4 in transportation to a plant site.

Referring now to FIG. 14, the liquefaction plant 102", or a substantial portion thereof, may, for example, be loaded onto a trailer 350 to be transported by truck 352 to a plant site. Alternatively, the supporting structure may serve as the trailer with the skid 330 (FIG. 13) configured with wheels, suspension and/or a hitch to mount to the truck 352 at one end, and a second set of wheels 354 at the opposing end. Other means of transport will be readily apparent to those having ordinary skill in the art.

It is noted that upper subsection 344B has been removed, and, while not explicitly shown in the drawing, some larger components such as the high efficiency heat exchanger 166 and the solid $CO_2$ processing heat exchanger 224 have been removed. This potentially allows the liquefaction plant 102" to be transported without any special permits (i.e., wide load, oversized load, etc.) while keeping the plant substantially intact.

It is further noted that the plant may include controls such that minimal operator input is required. Indeed, it may be desirable that any of the plants discussed herein be able to function without an on-site operator. Thus, with proper programming and control design, the plant may be accessed through remote telemetry for monitoring and/or adjusting the operations of the plant. Similarly, various alarms may be built into such controls so as to alert a remote operator or to shut down the plant in an upset condition. One suitable controller, for example, may be a DL405 series programmable logic controller (PLC) commercially available from Automation Direct of Cumming, Ga.

While the invention has been disclosed primarily in terms of liquefaction of natural gas, it is noted that the present invention may be utilized simply for removal of gas components, such as, for example, $CO_2$ from a stream of relatively "dirty" gas. Additionally, other gases may be processed and other gas components, such as, for example, nitrogen, may be removed. Thus, the present invention is not limited to the liquefaction of natural gas and the removal of $CO_2$ therefrom.

Figure 18:
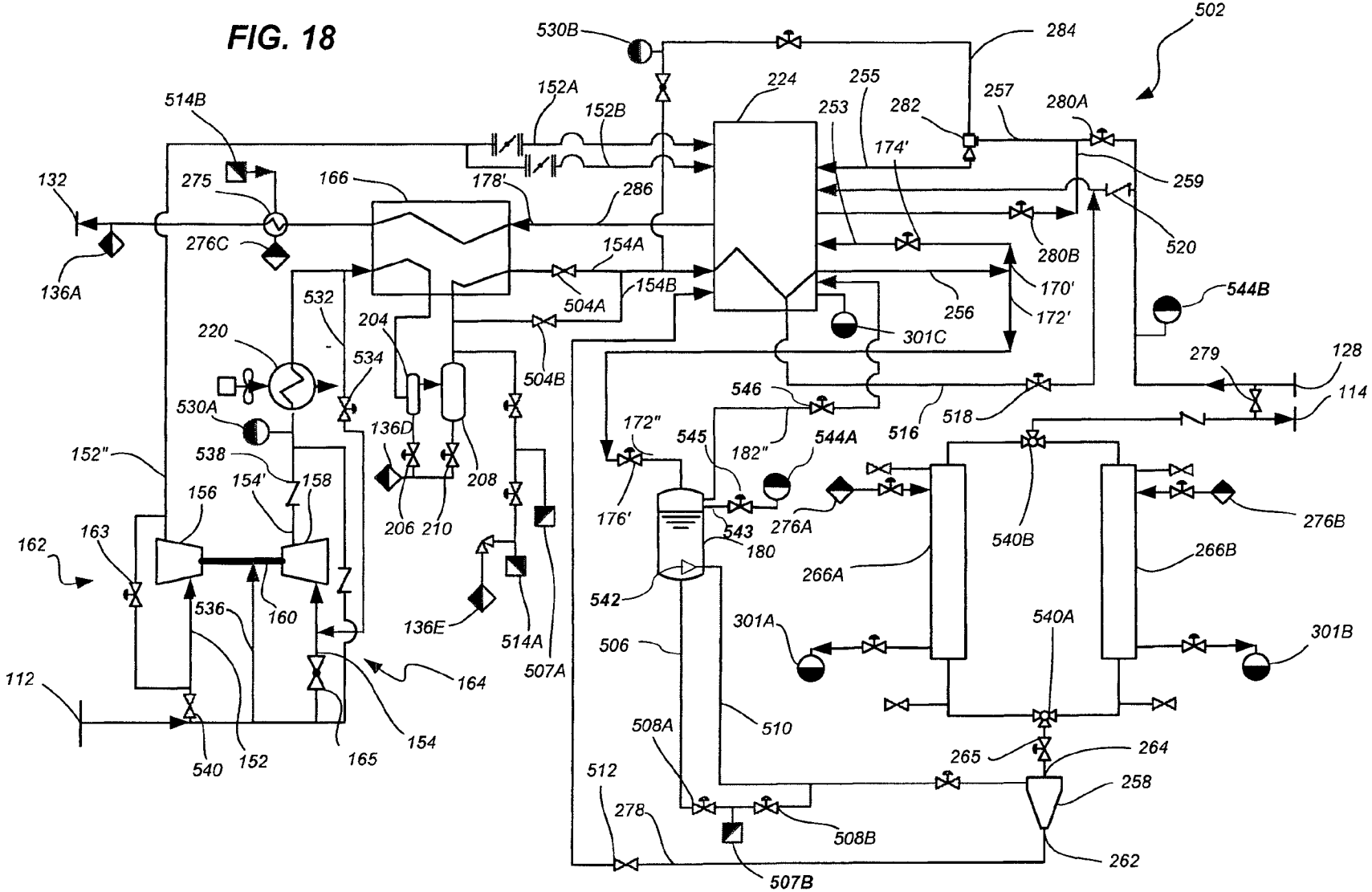
FIG. 18 is a process flow diagram depicting a liquefaction cycle according to yet another embodiment of the present invention.

Referring now to FIG. 18, a process flow diagram is shown depicting a liquefaction process performed in accordance with another embodiment of the liquefaction plant 502. As the liquefaction plant 502 and the process carried out thereby share a number of similarities with other embodiments described herein, including liquefaction plants 102, 102', 102" and 102'" and the processes depicted in FIGS. 2, 3, 4 and 10, respectively, like components are again identified with like reference numerals for sake of clarity. Additionally, for sake of clarity, a portion of the cycle between the plant inlet 112 and the expander 156/compressor 158 is omitted in FIG. 18, but may be incorporated into the liquefaction plant 502 and process shown and described with respect to FIG. 18.

In the embodiment shown in FIG. 18, appropriate valving and piping may be provided to divert a portion of the compressed process stream 154' from the high efficiency heat exchanger 166. For example, the compressed process stream 154' may be split into paths 154A and 154B wherein the first path 154A represents the cooling stream flowing through the entirety of the heat exchanger 166 while the second path 154B represents the cooling stream being diverted from the heat exchanger 166 so as to effectively bypass, for example, the last half or third of the heat exchanger 166. Thus, the amount of cooling provided by the heat exchanger 166 to the compressed process stream 154' could be selectively managed by directing the compressed process stream 154' through the first path 154A, the second path 154B or through both simultaneously at selected flow rates depending on the settings of the associated valves for inlets 504A and 504B.

The cooling stream 152" leaves the expander 156 and directly enters the $CO_2$ heat exchanger 224 on the shell side thereof (so as to flow over one or more of the coils disposed within the heat exchanger 224) and ultimately combines with the cooling stream 286 that provides cooling to the high efficiency heat exchanger 166. The cooling stream 152" may be split into multiple streams (e.g., streams 152A and 152B) so that the cooling stream 152" may be selectively discharged into the $CO_2$ heat exchanger 224. Thus, depending on the amount of cooling that needs to be supplied to the cooling coils 232A-232C (FIG. 5A) of the $CO_2$ heat exchanger 224, the cooling stream 152" may be diverted through one path (e.g., stream 152A) that corresponds to flowing the cooling stream 152" over multiple coils, through another path (e.g., stream 152B) that corresponds to flowing the cooling stream 152" over a single coil, or the cooling stream may be distributed simultaneously through multiple paths to a plurality of locations within the $CO_2$ heat exchanger 224. Appropriate valving and piping may be used to selectively direct the flow of the cooling stream 152" into the $CO_2$ heat exchanger 224 in any number of desired configurations. In one embodiment, an appropriate separator such as, for example, a cyclonic type separator may be disposed in the flow of the cooling stream 152" to remove methanol and water from the stream prior to its entrance into the $CO_2$ heat exchanger 224. The introduction of cooling stream 152" into the shell side of the $CO_2$ heat exchanger 224 not only assists with cooling of any material flowing through the coils thereof, but may also assist in the sublimation of any solid $CO_2$ that is being flowed through the shell side of the heat exchanger 224.

Figure 5C:
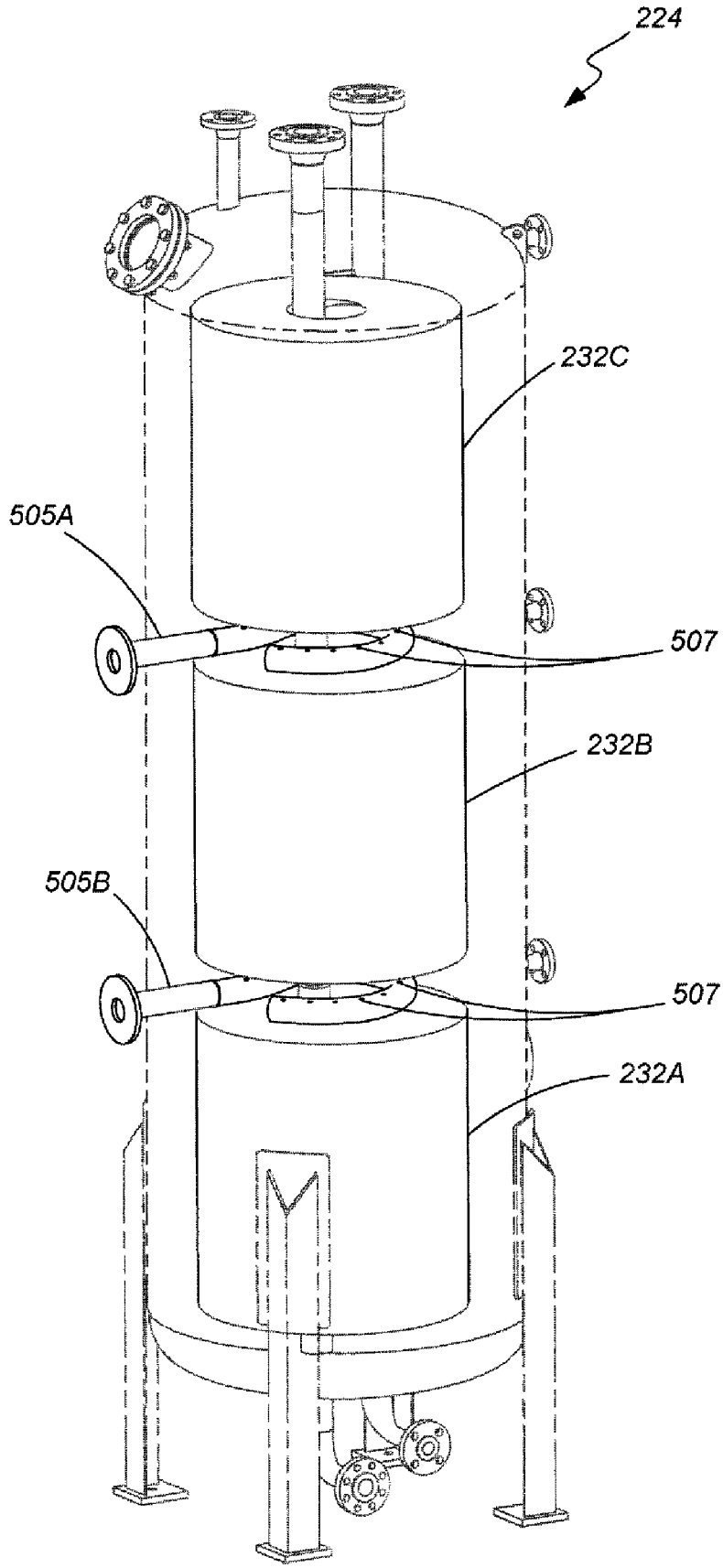
FIG. 5C shows the heat exchanger of FIGS. 5A and 5B with additional features in accordance with another embodiment of the present invention.

Referring briefly to FIG. 5C, an example is shown of inlets 505A and 505B to the $CO_2$ heat exchanger 224 as may be associated with flow paths 152A and 152B (FIG. 18), respectively. It is noted that the shell or tank portion of the heat exchanger 224 is shown in phantom or dashed lines for purposes of convenience and clarity. In the example shown in FIG. 5C, one inlet 505A may be located and configured to discharge the cooling stream 152", or a portion thereof, within the $CO_2$ heat exchanger 224 at a location between the second and third cooling coils 232B and 232C while the other inlet 505B may be located and configured to discharge the cooling stream 152", or a portion thereof, within the $CO_2$ heat exchanger 224 at a location between the first and second cooling coils 232A and 232B.

The inlets 505A and 505B may include one or more discharge ports 507, which may include openings or nozzles, configured to discharge the cooling stream 152" in a desired direction. Thus, for example, the discharge ports 507 of the first inlet 505A may be configured to discharge the cooling stream 152" in an initial direction towards the third cooling coil 232C while the discharge ports 507 of the second inlet 505B may be configured to discharge the cooling stream 152" in an initial direction towards the second cooling coil 232B. Of course, the inlets 505A and 505B and the discharge ports 507 may exhibit different configurations and locations depending, for example, on the desired operational parameters of the $CO_2$ heat exchanger 224.

The cooled process stream 256 leaves the $CO_2$ heat exchanger 224 and splits into cooling and product streams 170' and 172'. The process stream 172' passes through a JT valve 176' and is expanded to a low pressure, for example approximately 35 psia. The expansion via the JT valve 176' also serves to lower the temperature and introduces solid $CO_2$ formed in the product stream 172', as previously discussed herein. The expanded product stream 172", now containing solid $CO_2$, enters the liquid/vapor separator 180 wherein the vapor is collected and removed from the separator 180 through piping 182" and directed to the $CO_2$ heat exchanger 224 for use as a refrigerant in the shell side thereof.

The liquid in the liquid/vapor separator 180 is a slurry comprising the LNG fuel product and solid $CO_2$. Because the solid $CO_2$ may have a tendency to settle within the separator 180, a vapor line 506 may be used to introduce a desired amount of vapor into the separator 180 at the bottom side thereof such that the vapor bubbles through the slurry and causes the solid $CO_2$ to be suspended within the liquid. For example, vapor may be drawn from a location after the coalescing filter 208 of the water/methanol clean-up cycle as indicated by interface connections 507A and 507B. A plurality of valves 508A and 508B may be located and configured such that vapor may flow directly into the separator 180 (i.e., through valve 508A) or may flow to the separator 180 by way of the piping 510 connecting the separator 180 and the hydrocyclone 258, so as to provide a backflushing action and prevent or remove the build-up of solid $CO_2$ in the piping 510 between transfers of slurry from the separator 180 to the hydrocyclone 258.

Of course, vapor may be drawn off from other locations within the plant or may be provided from a separate source of gas. In another embodiment, other means of agitating the slurry within the tank may be used, such as mechanical agitators, so as to prevent settling of the solid $CO_2$ within the separator 180. Additionally, nucleate boiling may be utilized to provide agitation of the slurry within the separator 180.

Additionally, a converging nozzle 542 or funnel may be installed at the slurry exit of the separator 180 to direct the slurry into the piping 510. The nozzle 542 or funnel provides a means for bubbles, which may exist in the slurry that is being transferred, to escape from the slurry and avoid being trapped in the moving liquid transferred to the piping 510. As slurry enters into the nozzle 542, bubbles are allowed to escape along the inclined surfaces of the converging structure as the slurry accelerates due to the converging structure of the nozzle 542. In one embodiment, such a nozzle 542 may be substantially horizontally oriented, located approximately in the center of the separator 180 and coupled to a transfer tube that directs the slurry to the associated piping 510.

The flow of the slurry between the separator 180 and the hydrocyclone 258 may be effected through proper pressure management, such as by controlling the pressure differential between the separator 180 and the storage tank 116. Such pressure management may include maintaining a steady state pressure differential between desired components or it may include the development of periodic, or pulsed, pressure differentials to effect the desired flow of slurry from the separator 180.

The hydrocyclone 258 acts as a separator to remove the solid $CO_2$ from the slurry allowing the LNG product fuel to be collected and stored substantially, as discussed previously herein. The underflow 262 of the hydrocyclone 258, which comprises a flow of thickened slush, may be directed to the $CO_2$ heat exchanger 224 such that it enters the shell side thereof at a desired elevation. Placing the entrance of the thickened slush at a specific elevation, relative to the physical location of the hydrocyclone's underflow 262, enables management of the head or pressure required to flow the thickened slush into the $CO_2$ heat exchanger 224 from the hydrocyclone 258. Thus, a smaller elevation differential between the underflow 262 of the hydrocyclone 258 and the entry into the $CO_2$ heat exchanger 224 results in reduced head requirements to effect the flow of the thickened slush. An appropriate valve, such as a ball valve 512, may be coupled to the piping 278 extending between the hydrocyclone 258 and the heat exchanger 224 to provide isolation capability, such as may be desired, for example, during start-up operations, so as to help prevent $CO_2$ from forming in undesired locations.

The liquid natural gas passes through the overflow 264 of the hydrocyclone 258 and may flow through one of a plurality, in this instance two, $CO_2$ screen filters 266A and 266B placed in parallel. The screen filters 266A and 266B capture any remaining solid $CO_2$ which may not have been separated out in the hydrocyclone 258. The filters 266A and 266B may be configured, for example, as has been described hereinabove with respect to FIG. 9. Additionally, when the filters 266A and 266B need to be purged of accumulated $CO_2$ a higher temperature gas may be flowed therethrough as indicated by interface connections 276A and 276B (FIG. 4). It is noted, that in the embodiment shown in FIG. 18 that gas is drawn from a location downstream of the water clean-up cycle after the coalescing filter 208 as indicated by interface points 514A and 514B and passed through a heat exchanger 275 prior to being passed to the filters 266A and 266B.

As discussed hereinabove, during cleaning of the filter 266B, the cleaning gas may be discharged back to the $CO_2$ heat exchanger 224, as is indicated by interface connections 301A, 301B and 301C. Appropriate valving and piping allows for the filters 266A and 266B to be switched and isolated from one another as may be required. Other methods of removing $CO_2$ solids that have accumulated on the filters may be used as will be appreciated by those of ordinary skill in the art.

In the embodiment shown in FIG. 18, a high-flow loop is provided for assisting in the start-up of the liquefaction plant 502 by redirecting a portion of the process stream through the $CO_2$ heat exchanger 224 during the start-up process. The high-flow gas loop includes a line 516 coupled to the coil side of the $CO_2$ heat exchanger 224 and short circuits one or more of the coils contained therein by directing flow of the process stream, or a desired portion thereof, through a control valve 518 and back into the shell side of the $CO_2$ heat exchanger 224 at a desired location, such as between the bottom and middle coil sets.

In one embodiment, the control valve 518 may be tied, in a control sense, with the JT valve 174' so as to operate as a single valve. In other words, the control valve 518 remains closed until the JT valve 174' is fully open. Thus, the high-flow loop provides increased flow into the shell side of the $CO_2$ heat exchanger 224 when needed by adding to the flow already entering by way of JT valve 174'. For example, a PID (proportional, integral, derivative) controller may be used to control the two valves 174' and 518, wherein a bottom half of a signal produced by the PID controller effects actuation of the JT valve 174' while the upper half of the signal produced by the PID controller effects actuation of the control valve 518. In one particular embodiment, the selected ranges of a signal from the PID controller may be selectively defined to overlap with respect to the control of each of the valves 174' and 518 in order to account for opening and closing hysteresis in the valve actuators and thereby effect a substantially seamless cooperative operation of the two valves 174' and 518 as if they were a single valve.

A check valve 520 may couple the high-flow loop with the vapor line that extends between the plant inlet 128 (from tank 116 shown in FIG. 1) and the combined cooling stream 257 entering the eductor 282. The check valve 520 provides an escape route for high flow gas conditions where the eductor 282 cannot accommodate the flow (such as may be determined by an associated pressure regulator). The check valve 520 enables excess flow in the vapor line and the combined cooling stream 257 may be released into the high-flow loop when the pressure builds to a point that it exceeds the cracking pressure of the check valve 520. In one embodiment, the check valve 520 may include a one-inch check valve having a swing check wherein nothing prevents the valves' opening, except for the back pressure on the check, valve 520, and the weight of a check gate. Thus, the pressure on one side of the check valve 520 may be limited, for example, to 1-3 psig over the pressure on the other side thereof.

As with other embodiments described herein, the liquefaction plant 502 may include an ejector or an eductor 282 through which passes a combined cooling stream 257. The motive stream 284 may be drawn from the process stream at one or more of a plurality of locations. For example, the motive stream 284, or a portion thereof, may be drawn from a location between the high efficiency heat exchanger 166 and the $CO_2$ heat exchanger 224. Additionally, the motive stream 284, or a portion thereof, may be drawn from a location between the compressor 158 (or the bypass loop 164, if the compressor is not in operation) and the ambient heat exchanger 220 as indicated by interface connections 530A and 530B. As discussed hereinabove, the motive stream 284 flows through the eductor 282 and serves to draw the combined cooling stream 257 into one or more of the tank inlets 252A-252I (FIG. 5B). The ability to draw the motive stream 284 from multiple locations, including from multiple locations simultaneously, using appropriate valving and piping, provides additional flexibility in controlling the pressure and temperature of the motive stream 284 such that, for example, solid $CO_2$ or other constituents may be prevented from building up on the internal surfaces of the eductor 282.

The liquefaction plant 502 also includes a surge protection line 532 to protect the compressor 158 from insufficient flows which would result in an undesirable acceleration of the compressor 158. The surge protection line 532 ties into the compressed process stream 154' at a location between the ambient heat exchanger 220 and the high efficiency heat exchanger 166 and returns the flow through control valve 534 to the inlet of the compressor 158. A flow meter may be used to monitor the flow rate of material entering the compressor 158 and, if necessary, actuate the control valve 534 so as to alter the flow therethrough. It is noted that the surge protection line 532 might be located and configured to draw gas from a different location such as at essentially any location downstream from the check valve 535 following the compressor 158 and prior to a reduction of pressure of the compressed gas.

As also indicated in FIG. 18, besides splitting the inlet flow into a cooling stream 152 and a process stream 154, an additional stream of gas 536 may be drawn of for operation of gas bearings associated with the expander 156/compressor 158 such as has been discussed hereinabove. As will also be appreciated by those of ordinary skill in the art, this additional stream of gas 536 (or yet another stream of gas) may be used as seal gas to provide a noncontacting seal between the compressor 158, the expander 156 and a center bearing disposed therebetween.

In operating the liquefaction plant 502, various parameters may be monitored and various adjustments implemented in order to maintain operation of the expander 156/compressor 158 within a desired range and in order to produce LNG at a desired rate with specified temperature and pressure characteristics. Control of the liquefaction plant 502 may be fully or partially automated, such as, for example, by using an appropriate computer, a programmable logic circuit (PLC), using closed-loop and open-loop schemes, using proportional, integral, derivative (PID) control, or other appropriate control and programming tools as will be appreciated by those of ordinary skill in the art. Additionally, if desired, the liquefaction plant 502 may be operated manually. The following discussion describes examples of logic that may be used in controlling the liquefaction plant 502.

In order to efficiently run the expander 156/compressor 158 within desired speed and flow parameters, certain flow criteria should be met. If control is being automated, the control system may be configured to set and maintain these flow requirements automatically, by equation. The equation may also automatically calculate a flow set-point that meets the flow requirements of the expander 156/compressor 158. The equation may start calculating flow values as soon as the expander 156/compressor 158 is started.

Under one control scheme, the "back-end flow loop," which is generally the flow starting with the cooled process stream 256 and includes the flow through the JT valve 174' back into the $CO_2$ heat exchanger 224, as well as the flow through the JT valve 176' to the separator 180, may be used as a primary control mechanism in operating the liquefaction plant 502. A desired "set-point" is initially determined for the back-end flow. This set-point represents a flow rate that is sufficient to ensure that adequate flow is provided to the expander 156/compressor 158 and is sufficient to activate flow sensors that may be positioned throughout the liquefaction plant 502 at desired locations.

It is noted that, depending on the type of flow meters or flow sensors being used, the calculated flow set-point may be insufficient during slow speed operation of the expander 156/compressor 158 to maintain detection of the flow(s) throughout the liquefaction plant 502. Thus, it may be desirable to utilize a manual set point (i.e., one that is not determined by the automatic calculation) until the turbo speed is sufficiently high such that any automatic flow calculation set-point matches or exceeds the manual set point. Once the manual and calculated set-points match, the system can be switched from manual to automatic set-point generation. From this point on, the automatic set-point may be used to maintain the appropriate flows required by the expander 156/compressor 158 for proper operation.

The calculated back-end flow (CBEF) is derived by indirectly determining the flow through the compressor 158 (i.e., the process stream 154). Referring to FIG. 18, the flow is calculated as follows:

$$CBEF = F112 - (F152 + F536) \quad \text{EQ 1}$$

Where CBEF is the calculated backend flow (lbm/hr); F112 is the flow coming into the liquefaction plant 502 through the inlet 112 (lbm/hr); F152 is the flow through the expander 156 (lbm/hr); and F536 is the flow to the stream of gas bearings 536. The flow to the gas bearings 538 may be a fixed value and considered a constant.

The CBEF is the actual flow feedback value used to determine if the system is responding correctly and causing the flow to progress towards the set-point. The CBEF value is basically the same value as that which is measured by a flow meter as it flows through the compressor 158 (although independently derived) and is only different due to minor flows within the system. However, having two independent flow values representative of the flow through the compressor 158 may be important when considering surge flows as discussed hereinbelow.

The automatic calculated flow set-point is determined by the following equation:

EQ 2:

$$ABEF = 6000\left(\frac{RPM}{85000}\right)\left(\frac{P112}{440}\right)BESF$$

Where ABEF is the Automatic Calculated Backend flow set-point (lbm/hr); 6000 is a constant and is the maximum design flow through the compressor 158 at 85000 RPM, and 440 psia, (lbm/hr); RPM is the current revolutions per minute of the compressor 158; 85000 is a constant and is the design speed (RPM) of compressor 158; P112 is the current pressure (psia) at the inlet 112 of the liquefaction plant 502; 440 is a constant and is the design pressure (psia) for the inlet 112; and BESF is the back-end flow safety factor (a dimensionless multiplier).

Figure 19A:
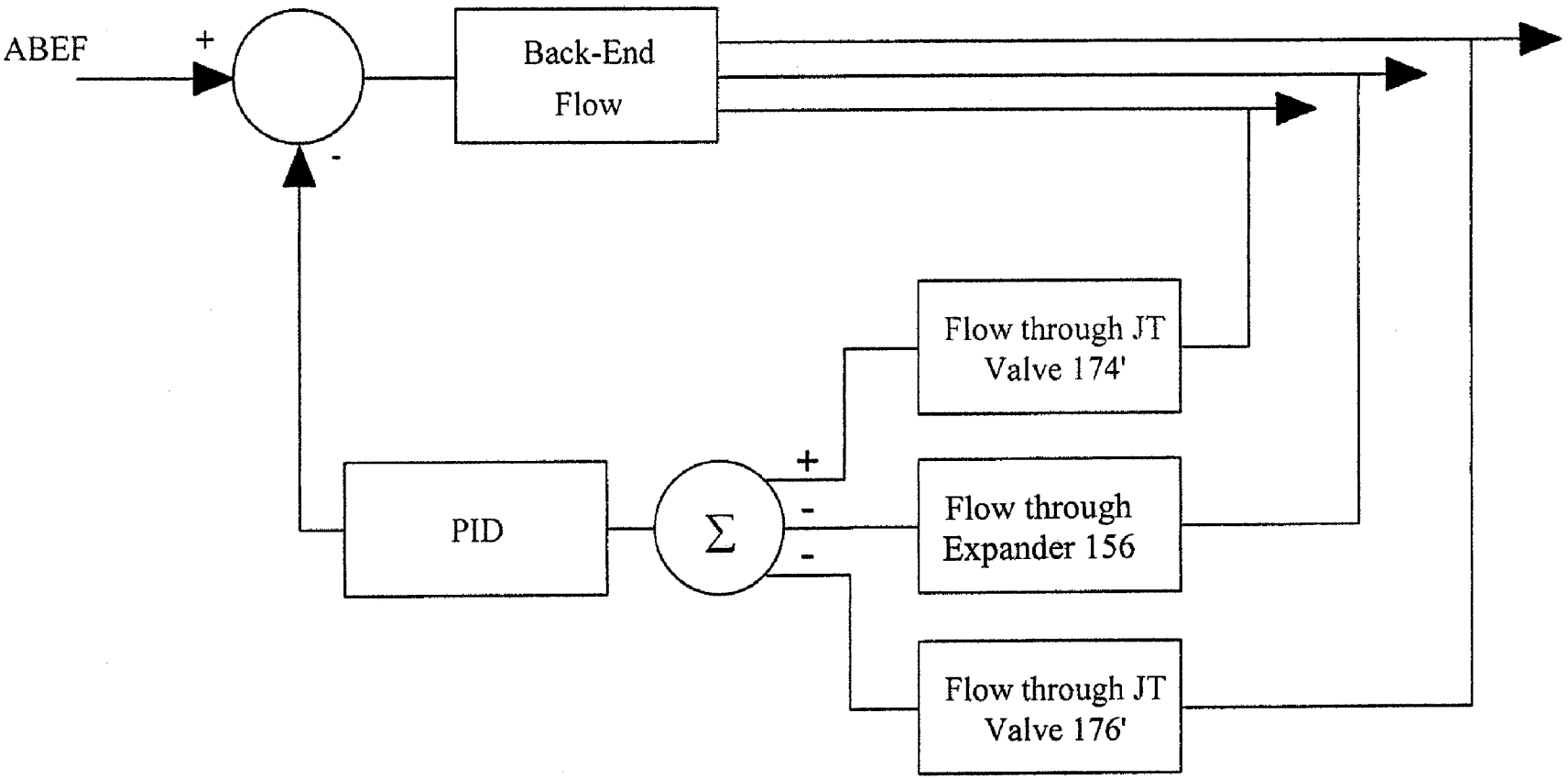
FIGS. 19A-19E are block diagrams showing control loops which may be used in accordance with various embodiments of the present invention.

Referring to FIG. 19A, a block diagram of a closed-loop control scheme is shown as an example for back-end flow control. The JT valve 174' discharges the compressed cooling stream 256 (or a portion thereof) into the shell side of the $CO_2$ heat exchanger 224 and is the controlled element in this scheme. During start-up, the control valve 518 of the high-flow loop may be used to accommodate additional flow if the JT valve 174' goes to a fully open position.

One specific method of controlling the valves in the back-end flow, either in conjunction with the logic set forth above or with some other logic, includes a process referred to herein as valve abstraction. Valve abstraction allows any number of valves, "N," to be viewed as a single valve from the perspective of a controlling loop. The valves are arranged by Cv size (the flow coefficient of a valve) with appropriate scaling and zones using the output of a control loop to operate all valves incorporated in the loop. In other words, valves with smaller flow coefficients (Cv) will be actuated first with the relative weight of those valves taken into account.

Figure 20:
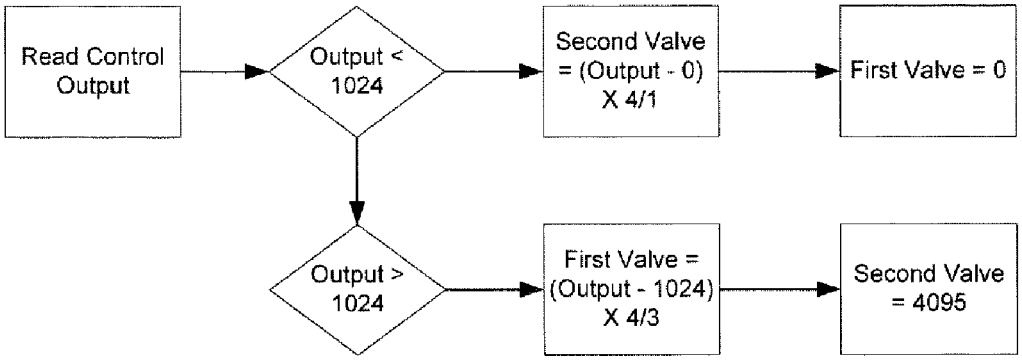
FIG. 20 is a flow diagram relating to a control process that may used with a liquefaction plant in accordance with an embodiment of the present invention.

In one more specific example, a system with two valves may be considered. A first valve has Cv of 3 and a second valve has a Cv of 1. The control output has a resolution of 4096. The output of the control loop is divided into two zones. The first zone is assigned to the second valve, as it is the smaller valve (Cv=1). This zone would be a ratio of the second valves Cv in relation to the total resulting Cv when both valves are open. This ratio, when applied to the output resolution of the "combined" valve, would result in the second valve's zone ranging from 0 to 1023. The first valve would, therefore, have a zone associated with the output range of 1024 to 4095. This arrangement enables the valves to act as one valve. If the valves have nonlinear Cv curves, then the resulting zones would have to be curve fitted for appropriate valve actuation. FIG. 20 shows a flow diagram showing the logic of such valve control schematically.

It is noted that such a method may be appropriately incorporated into the control of the JT valve 174' and the control valve 518 of the high flow loop as has been discussed hereinabove.

Another technique that may be used, and which may be advantageously combined with the process of valve abstraction, includes what may be referred to as dynamic gain manipulation. Dynamic gain manipulation may be used to modify the proportional gain of a PID loop used, for example, to control the back-end flow. The upper and lower gain values are mapped against the physical parameters associated with a material transition (e.g., a gas-to-liquid or a liquid-to-gas transition). For example, considering a transition from a gaseous phase to a liquid phase, the physical parameters that provide an impetus for such a phase change include pressure and temperature. After determining which physical parameters have the most significant contribution to a phase change are identified, then these parameters may be mapped against the gain used in a PID control loop. It is noted that different dynamic gain maps may be used at different stages of plant operation. For example, one dynamic gain map may be used during the start-up of the plant while another dynamic gain map may be used during steady-state operation of the plant. The use of different dynamic gain maps may be useful because, for example, during start-up, the gas is less dense than during normal operations. As the density of the gas increases (and the temperature of the gas is correspondingly colder), the velocity of the gas increases. Thus, such variables may be taken into account in controlling the plant.

Figure 21:
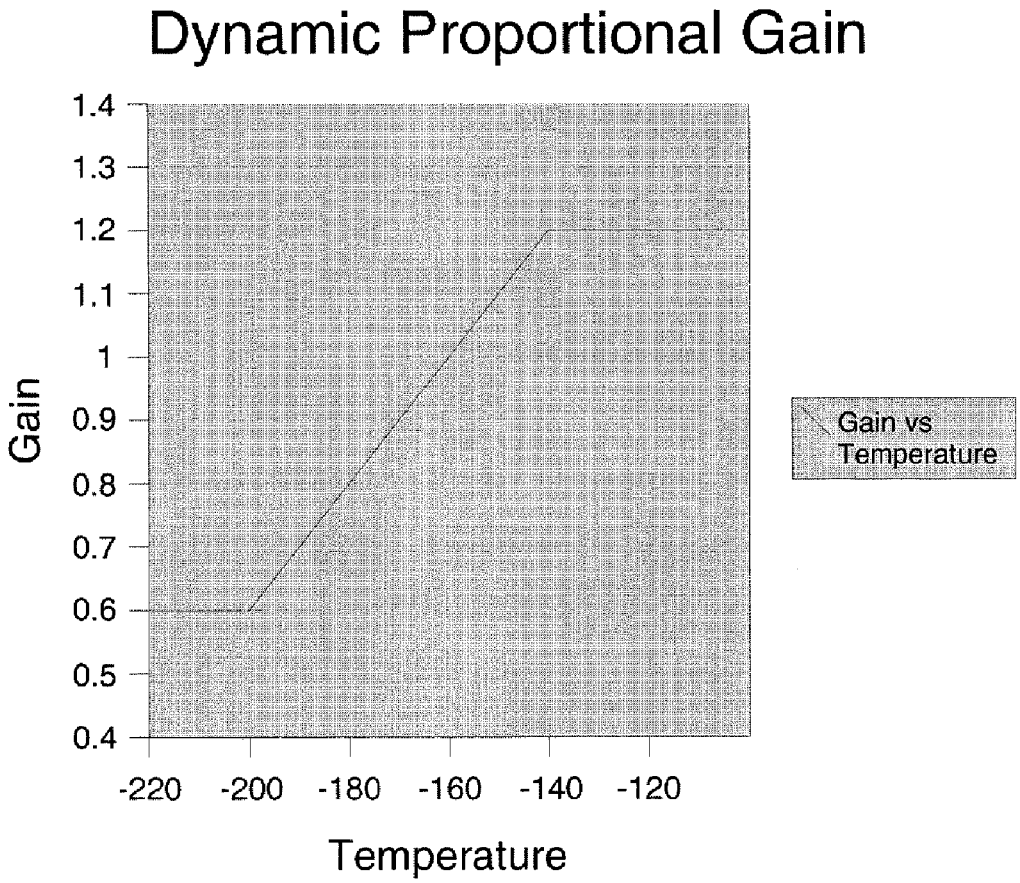
FIG. 21 is a graph showing a relationship of proportional gain and temperature which may be used in controlling portions of a liquefaction plant in accordance with an embodiment of the present invention.

For example, if natural gas begins to change density toward a liquid state at roughly −140° F. at 700 PSIG and is fully a liquid at approximately −200° F. at 700 PSIG, then, the gain may be mapped against this range as shown in FIG. 21. Once the values have been mapped, the gain on the PID loop can be modified according to the curve of the phase transition of the material being handled. This will allow the loop to remain stable during phase transitions. While the technique of using dynamic gain may be used with integral and derivative gains, the technique appears to work particularly well with proportional gain when combined with the technique of valve abstraction as discussed hereinabove.

The use of both valve abstraction and dynamic gain manipulation to maintain stability during a phase transition from a gas to a liquid (or a liquid to a gas) may be particularly suited for implementation during startup of a plant, but may be utilized with any process that requires flow control across material phase transitions.

Still referring to FIG. 18, the cooling stream 253 is designed to regulate the temperature of the compressed product stream 154' by altering the flow volume entering the shell side of the $CO_2$ heat exchanger 224. As the compressed product stream 154' cools to a desired set-point, the JT valve 176' valve leading to the separator 180 is opened, thereby reducing the flow to the $CO_2$ heat exchanger 224 and preventing it from overcooling the compressed product stream 154'.

As discussed hereinabove, the flow of the cooling stream 253 into the shell of the $CO_2$ heat exchanger 224 acts as a refrigerant to cool the compressed product stream 154'. When the flow of the cooling stream 253 is reduced, the temperature can be balanced to the desired set-point. A reduction in the flow of the cooling stream 253 also results in the increased production of liquid in the separator 180. Excess flow not required for cooling stream 253 is thus removed from the system as liquid product.

Figure 19B:
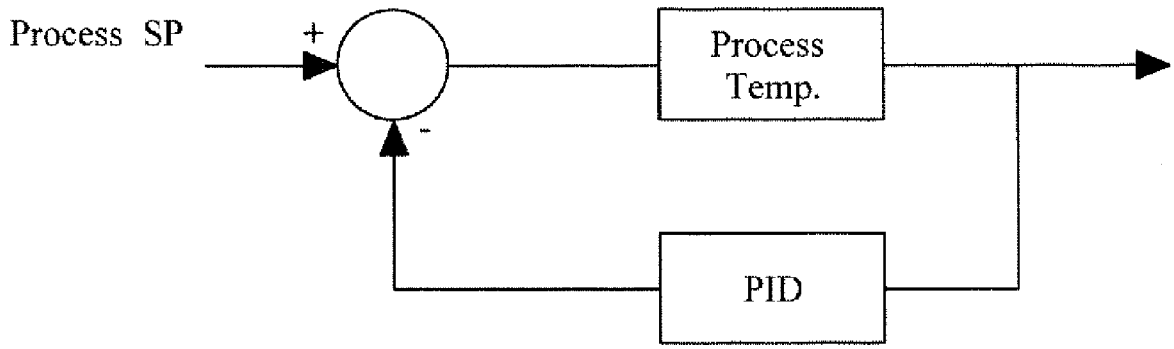

During start-up of the liquefaction plant 502, the JT valve 176' is closed due to the relatively warm temperatures of the compressed product stream 154' and associated components. Therefore, all the flow is directed into cooling stream 253. One or more appropriate temperature sensors may be used to monitor the temperature of the back end flow at one or more locations. For example, the temperature may be monitored at a location such as in the cooled product stream 256 which exits the $CO_2$ heat exchanger 224. If the sensed temperature exceeds (i.e., gets colder than) the set point, or the target temperature, the JT valve 176' leading to the separator 180 will begin to open. This can be controlled, for example, with a PLC using a PID closed loop control scheme, such as shown in FIG. 19B.

In one embodiment of the invention, the relationship of the various valves (which includes the JT valve 174' and the JT valve 176' (although it may include others such as the control valve 518 of the high-flow loop) may be used to control the liquefaction plant 502, including control of liquid production. In such an embodiment, during the startup and early operation of the liquefaction plant 502, all the high pressure flow is managed through control of the back-end flow. Initially, it is desirable to manage the flow requirements of the compressor 158 and provide necessary cooling to the product stream. Cooling is maximized by directing all of the high pressure mass flow into the shell side of the $CO_2$ heat exchanger 224.

During the initial cooling phase of the $CO_2$ heat exchanger 224 and the compressed product stream 154', the temperature control loop is dormant or inactive. This is due to the fact that the temperature of the process stream, such as the cooled process stream 256, is much warmer than the set-point or the target temperature. This relatively warm process fluid keeps the JT valve 176' closed. As the temperature approaches the set-point, the JT valve 176' begins to open. In one example, such a set point may be between approximately −175° F. and −205° F.

As the JT valve 176' opens (which valve may be considered both the temperature control valve, as well as the liquid production valve in the presently described control scheme), flow is diverted away from cooling the $CO_2$ heat exchanger 224. If the process continues cooling and exceeds the temperature set-point, the JT valve 176' opens further, thereby reducing flows to the $CO_2$ heat exchanger 224. This action continues to reduce the flow, and thus refrigeration, to the $CO_2$ heat exchanger 224 until the cooling process reverses. Since the flow set-point is constant, the JT valve 174' (which may be considered the flow valve) begins to close in unison to the JT valve 176' (the temperature control valve) opening, and vice-versa.

As the temperature of the product stream 256 warms, the temperature valve/JT valve 176' starts closing and the flow valve/JT valve 174' begins opening. This action of opening and closing the two JT valves 174' and 176' continues until a steady position is reached where both valves are at least partially open such that both flow and temperature conditions (set-points) are met. This back and forth action of opening and closing the JT valves 174' and 176' may be handled by PID control loops as set forth hereinabove. The balanced condition of the JT valves 174' and 176' results in a steady state production of liquid flowing into the SGL tank and a correct refrigeration flow into the $CO_2$ heat exchanger 224.

In the currently described embodiment, the combination of these two control loops (i.e., the flow loop and the temperature loop) makes the steady state operation possible. The various heat exchangers (e.g., the $CO_2$ heat exchanger 224) may be designed with enough capacity to overdrive their need for refrigeration, thus providing an excess of flow for liquid product production, if desired.

As previously discussed with respect to FIG. 3, methanol may be added to the process to remove water vapor from the feed gas and prevent water from freezing within the various plant components including, for example, within the turbo expander 156. As also noted above, this feature is considered to be available for use with the process described with respect to FIG. 18. Considering both FIGS. 3 and 18, an example of a control scheme regarding the addition of methanol is now considered. Methanol is added to the primary flow entering the liquefaction plant 502 through the plant inlet 112 by way of pump 202 which may include a metering pump. The pump 202 may force the methanol into the flow through a small atomizing nozzle. The amount of methanol injected is equation driven, based on a combination of the flow rate through the plant inlet 112 (such as may be determined by a flow meter 110; FIG. 1) and the $CO_2$ content of the incoming gas.

In one embodiment, the pump 202 may include a multi-piston positive displacement piston pump, wherein each stroke measures out a calibrated quantity. Such a pump 202 may be calibrated by running the pump 202 at a constant speed and measuring the quantity of liquid in a beaker over a given time. An equation may utilize the desired methanol flow value, based on mass flow of the incoming natural gas through the plant inlet 112, and convert the desired flow to motor speed (Hz) based on the calibration of the pump 202. One such equation is as follows:

EQ 3:

$$MF = (A0 + A1(\text{Meth_}H_2O\text{_Content})) * \frac{F112}{10{,}000} * MSF$$

Where: A0=0.79 and is a constant based on methanol/water data; A1=0.626 and is a constant based on methanol/water data; MF is the methanol flow; Meth_$H_2O$_Content is the content of $H_2O$ in the gas stream (a constant that must be determined for the particular flow); F112 is the mass flow entering the plant inlet 112; MSF is the methanol safety factor (a constant); and 10,000 is a constant based on the design flow of the liquefaction plant 502.

Figure 19C:
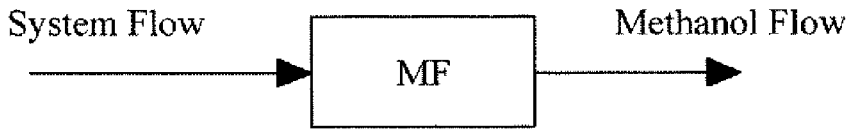

The methanol absorbs the water and both are removed by cyclonic separators, coalescing separators, or both, when the temperature reaches approximately −70° F. in the product stream 154. The cooling stream 152 (and subsequent flow paths) can get to approximately −100° F. before the methanol mixture is removed. The control of the methanol flow may be effected by, for example, an appropriate open loop control scheme using an equation, such as Equation 3 set forth above, such as shown in FIG. 19C.

As previously discussed, certain situations may occur wherein the flow into the compressor 158 becomes insufficient causing the compressor 158 to quickly accelerate because of lack of load. To prevent this condition, a surge protection line 532 routes flow from the high pressure side of the compressor 158 back to the lower pressure inlet of the compressor 158. This surge protection line 532 may be controlled by the surge protection circuit to prevent the compressor 158 from going into surge when abnormal conditions are present.

In one embodiment, the control of the surge protection line 532 may include closed loop, PID control using the following equation:

EQ 4:

$$SF = 5{,}000\left(\frac{RPM}{85{,}000}\right)\left(\frac{P112}{440}\right)SSF$$

Where SF is surge flow set-point; 5,000 is a constant, and is the minimum flow through the compressor at 85,000 revolutions per minute and 440 psia, (lbm/hr); RPM is the current revolutions per minute of the compressor 158; 85,000 is a constant, and is the design speed (revolutions per minute) of the compressor 158; P112 is the pressure at the plant inlet 112 (psia); 440 is the design pressure (psia); and SSF is a surge safety factor for the compressor 158.

Figure 19D:
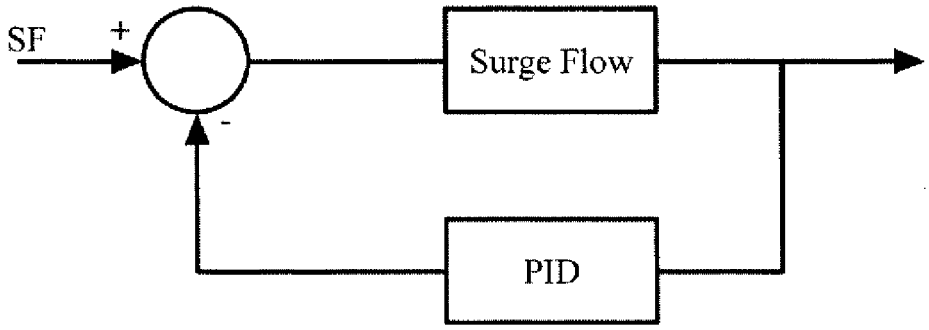
Figure 19E:
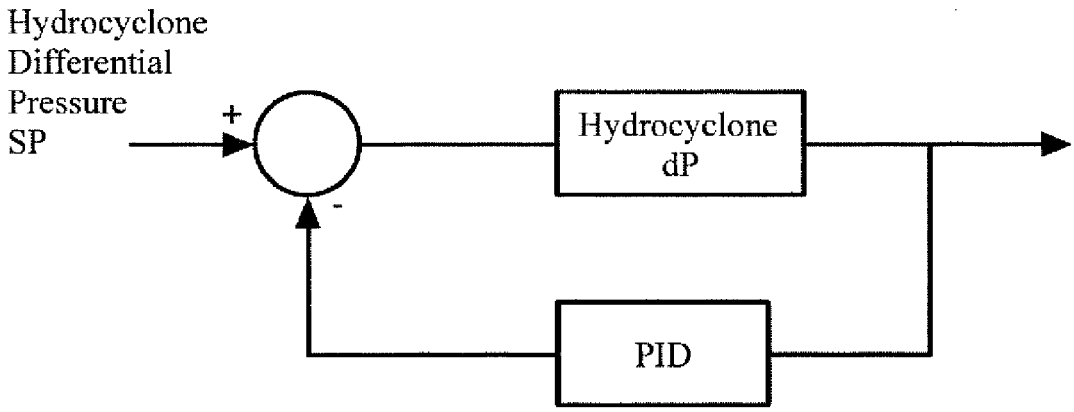

Equation 4 may be used, for example, in conjunction with a closed loop PID control scheme, such as shown in FIG. 19D, wherein a flow meter placed in the process stream 154 may be used as the feedback element, and the control valve 534 may be the controlled element.

Since the surge protection line 532 is essentially a safety control loop, the control valve 534 is rarely opened. However, if an aberration in the operation of the liquefaction plant 502 causes the flow through the compressor 158 to fall below the surge flow set point (SF), the control valve 534 will open and cause the flow to circulate back to the inlet of the compressor 158. It is noted that use of a flow sensor in the process stream line as the feedback for the surge control prevents the use of such a flow sensor for control of the backend flow. When the surge loop is activated, the flow through the compressor 158 is accurately reported by the flow sensor. However, in order for the control of backend flow to adjust for an off-normal or aberrational condition, it will be reading the flow through the compressor 158 indirectly as set forth by EQ 1, set forth hereinabove, which will actually be lower than the reading of a flow sensor in the process stream 154. If control of the back-end flow were to also rely on the flow sensor in the process stream 154, the controller would not be able to correct the abnormal condition, because the flow through the compressor 158 would appear to be correct.

Still referring to FIG. 18, liquid level in the separator 180 is desirably maintained between a minimum and maximum level. A differential pressure transducer may be used for sensing the liquid level within the separator 180. The minimum level may be determined so as to provide an adequate residence time for the solid $CO_2$ in the liquid, thereby ensuring a subcooled $CO_2$ particle. The minimum level also ensures that the majority of the expanding flow (i.e., the flow from the JT valve 176') contacts the fluid surface directly rather than contacting the walls of the separator tank. Subcooling all the $CO_2$ in the liquid helps to prevent the particles from sticking to one another and plugging up the system.

The maximum liquid level is the highest operational fill level and may be used to trigger the liquid transfer through the hydrocyclone 258. Both levels may be programmed into an appropriate controller as will be appreciated by those of ordinary skill in the art. In one example, the minimum fill level may be set at approximately 30% of the capacity of separator 180 and maximum fill levels may be set at approximately 60% of the capacity of separator 180, although other values may be used. In one embodiment, a fill level equivalent to 90-100% may be used as a safety level, where if the specified level is reached, an emergency stop of the plant may be triggered.

In transferring the slurry to the hydrocyclone 258, a pressure circuit may be used to pressurize the separator 180 at desired transfer times and effect batch transfers of liquid from the separator 180 to the hydrocyclone 258. For example, in one embodiment, a vent line 543 may provide communication between the separator 180 and the storage tank 116 (FIG. 1) as indicated by interface connections 544A and 544B. An actuated ball valve 545 may be coupled to the vent line 543 to selectively effect such communication. Thus, during times when liquid is being produced within the separator 180 and slurry is not being transferred, the ball valve 545 may be in an open position such that vapor from the separator 180 is directed to the eductor 282 and the separator 180 and storage tank 116 are maintained at common pressures (e.g., 35 psia). However, when it is desired to transfer slurry from the separator 180 to the hydrocyclone 258 (such as when the liquid/slurry level within the separator 180 reaches a specified level), the ball valve 545 may be closed, causing pressure to build in the separator 180 by way of, for example, a back pressure regulator 546 positioned in line 182". The back pressure regulator may be set at, for example, a pressure of approximately 75 psia to approximately 80 psia. The increased pressure in the separator 180 may then be used as a motive force to transfer the slurry from the separator 180 to the hydrocyclone 258. Once the liquid/slurry level within the separator 180 drops to a specified minimum level, the ball valve 545 may again open such that pressure within the separator 180 is again reduced to a common level with the storage tank 116 (FIG. 1) and liquid/slurry begins to accumulate again within the separator 180.

In controlling the hydrocyclone 258, two control points may be considered. The first control point is the flow pressure coming into the hydrocyclone 258. The second control point is the differential pressure across the underflow 262 and the overflow 264. The incoming pressure may be maintained by the motive stream 284 flow pushing the liquid through the separator 180 and into the hydrocyclone 258. The differential pressure between the underflow 262 and the overflow 264 may be controlled by restricting the flow with the associated control valve 265.

The underflow 262 (which contains a $CO_2$ slurry), exits directly into the shell side of the $CO_2$ heat exchanger 224 and may be used as the reference pressure for controlling the differential pressure within the hydrocyclone 258. As noted previously, the differential pressure across the hydrocyclone 258 may be maintained between, for example, −0.5 psid and +1 psid. Generally, if the pressure differential is maintained closer to −0.5 psid, more liquid will flow out the overflow 264 while generally poorer separation of liquid and solid will be exhibited. As the pressure differential increases to +1 psid and higher, more product liquid is pushed out the underflow 262 with the $CO_2$, but higher separation efficiencies will be exhibited.

The control valve 265 coupled with the overflow 264 of the hydrocyclone 258 restricts the flow and may be used to prevent it from dropping below −0.5 psid. The pressure of the storage tank 116 (FIG. 1) is held at a desired set-point, and is generally equal to or higher than the pressure in the separator 180. For example, a pressure differential between the storage tank 116 and hydrocyclone 258 of about 15 psid may exist. A pressure differential between the hydrocyclone 258 and separator 180 of about 15 psid may also exist except when liquid is being transferred. During liquid transfer, the pressure in separator 180 will be higher than the pressure in hydrocyclone 258. A closed loop control scheme using PID control may be implemented such as is shown in FIG. 19D. The control loop may use one or more differential pressure transmitters as control inputs with the control valve 265 being the controlled element. The hydrocyclone 258 differential pressure set point may be manually programmed into the control system, or may be calculated according to various monitored operational parameters as will be appreciated by those of ordinary skill in the art.

As previously discussed, the polishing filters 266A and 266B may be used to remove any $CO_2$ that may have escaped the separation process effected by the hydrocyclone 258. As a filter (e.g., filter 266A) collects $CO_2$, the differential pressure across the filter 266A will increase. When the differential pressure across the filter 266A reaches a specific level (i.e., a defined set-point), the flow of liquid will be switched to the other filter 266B, so that the first filter 266A may be allowed to warm the collected $CO_2$ therefrom. The warming/cleaning of a given filter 266A or 266B may be user selectable between a passive warming cycle that can take many hours or even days, or an active warming cycle where hot gas is routed through the identified filter until all the filtered or collected $CO_2$ has sublimed back into the liquefaction plant 502. The selection of cleaning methods may be determined by the amount of time that it takes for the polishing filter 266A, 266B to become filled with $CO_2$ during normal operation of the plant 502. Isolation of a given filter 266A or 266B for either filtering purposes, or for cleaning purposes, may be effected through control of three-way valves 540A and 540B or through other appropriate valving and piping as will be appreciated by those of ordinary skill in the art.

Figure 22:
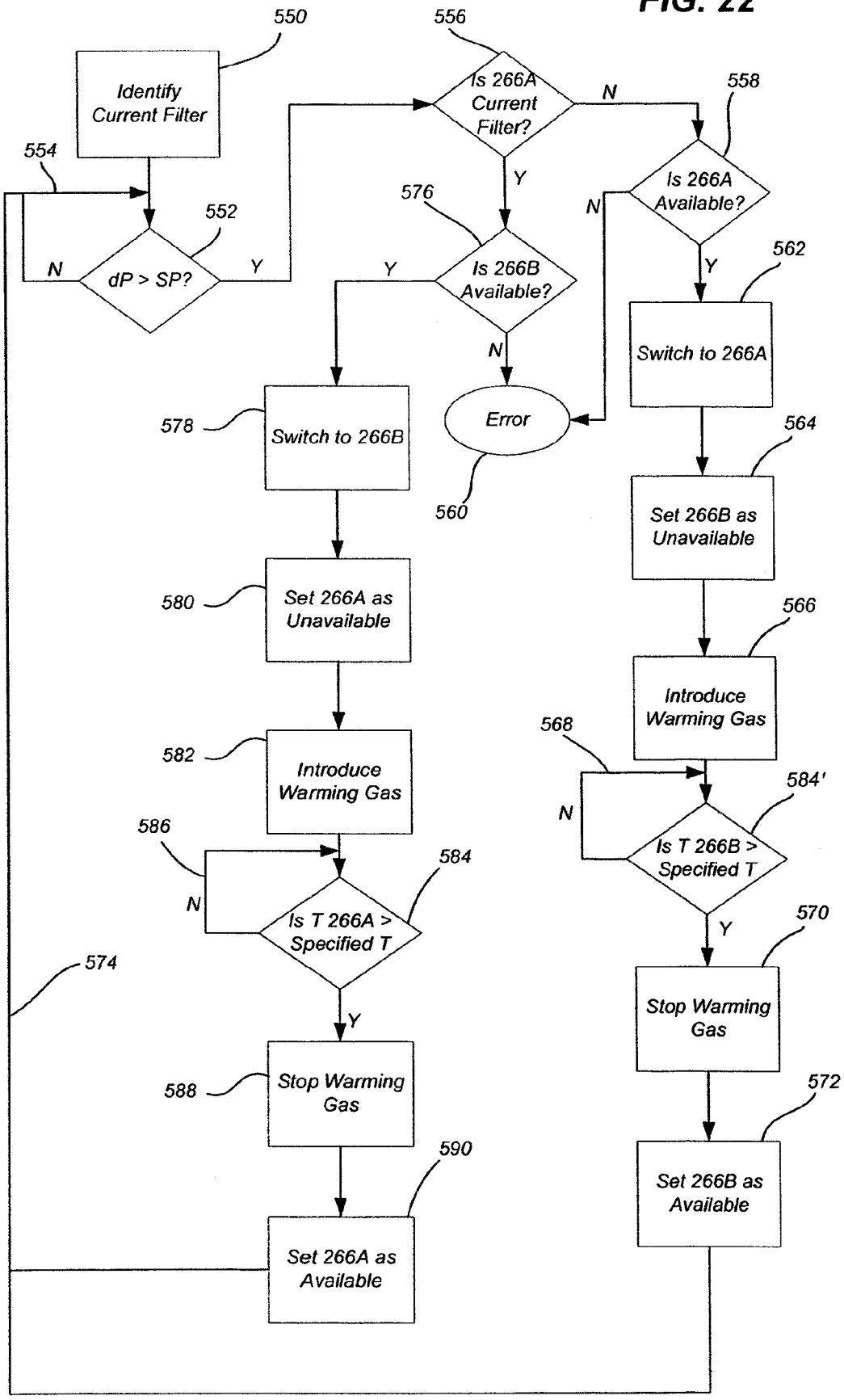
FIG. 22 is a flow diagram showing logic that may be used in controlling certain components of a liquefaction plant in accordance with an embodiment of the present invention.

Referring briefly to FIG. 22 in conjunction with FIG. 18, a flow diagram is shown describing logic that may be used in managing the polishing filters 266A and 266B in accordance with one embodiment of the present invention. As indicated at 550, a filter 266A or 266B is selected for use in filtering liquid passing from the hydrocyclone 258 to the LNG storage tank 116 (FIG. 1). During filtering, the operational filter is monitored to determine whether the differential pressure (dP) across the filter is greater than a desired set-point (SP) as indicated at 552. If the differential pressure is less than the set-point, the monitoring process continues as indicated by loop 554. If the differential pressure is greater than the set-point, then it is determined whether the first filter 266A is being used as indicated at 556.

If the first filter 266A is not the current filter, it is then determined if the first filter 266A is available (as it is possible that both filters 266A and 266B may be simultaneously unavailable), as indicated at 558. If the first filter 266A is not available, an error message may be reported to the controller as shown at 560. If the first filter 266A is available, then liquid flow is switched to the first filter 266A as indicated at 562 and the second filter 266B is set as being unavailable as indicated at 564.

Warming gas is then introduced into the second filter 266B, such as by supplying such warming gas from interfacing connection 276B, through the filter 266B and out interfacing connection 301B, as indicated at 566. The temperature of the second filter 266B is monitored and compared with a target temperature as indicated at 566. If the temperature of the filter 266B is less than the target temperature, the process continues, as indicated by loop 568. In one embodiment of the present invention, the target temperature may be approximately −70° F. If the temperature of the filter 266B is greater than the target temperature, indicating that all of the $CO_2$ has been sublimed from the filter 266B, then the flow of warming gas is stopped as indicated at 570. The second filter 266B is then set as being available as indicated at 572 and the process continues as indicated by loop 574.

Returning back to the decision point at 556, if the first filter 266A is the current filter, then it is determined whether the second filter 266B is available as indicated at 576. If the second filter 266B is not available, an error message may be reported as indicated at 560. If the second filter 266B is available, then liquid flow is switched to the second filter 266B as indicated at 578 and the first filter 266A is set as being unavailable as indicated at 580.

Warming gas is then introduced into the first filter 266A, such as by supplying such warming gas from interfacing connection 276A, through the filter 266A and out interfacing connection 301A, as indicated at 582. The temperature of the first filter 266A is monitored and compared with a target temperature as indicated at 584. If the temperature of the filter 266A is less than the target temperature, the process continues, as indicated by loop 586. If the temperature of the filter 266A is greater than the target temperature, indicating that all of the $CO_2$ has been sublimed from the filter 266A, then the flow of warming gas is stopped as indicated at 588. The first filter 266A is then set as being available as indicated at 590 and the process continues as indicated by loop 574.

EXAMPLE 1

Figure 15:
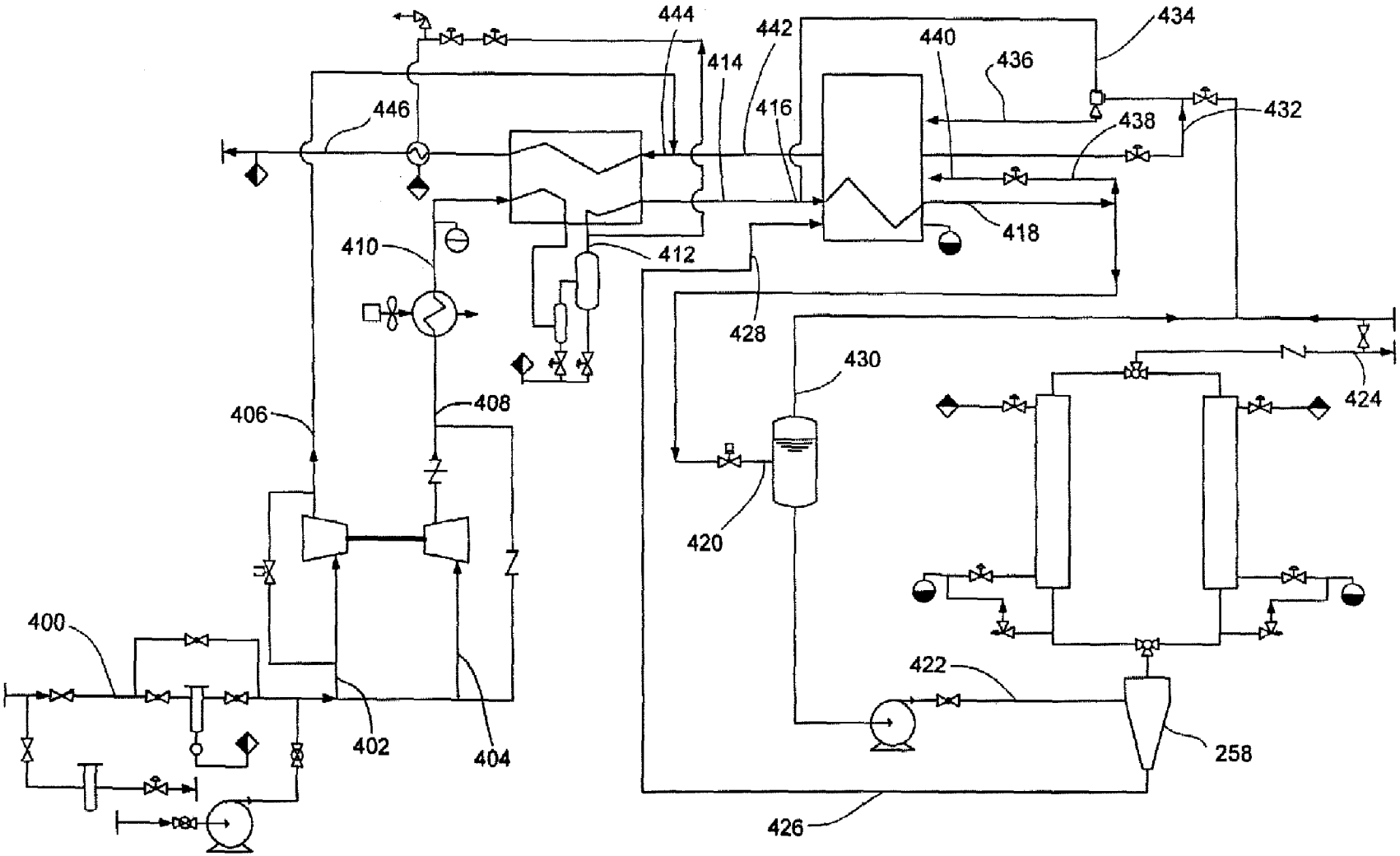
FIG. 15 is a process flow diagram showing state points of the flow mass throughout the system according to one embodiment of the present invention.

Referring now to FIGS. 4 and 15, an example of the process carried out in the liquefaction liquefaction plant 102" is set forth. It is noted that FIG. 15 is the same process flow diagram as FIG. 4 (combined with the additional components of FIG. 3, e.g., the compressor 154 and turbo expander 156, etc.) but with component reference numerals omitted for clarity. As the general process has been described above with reference to FIG. 4, the following example will set forth examples of conditions of the gas/liquid/slurry at various locations throughout the plant, referred to herein as state points, according to the calculated operational design of the liquefaction plant 102".

At state point 400, as the gas leaves the supply pipeline and enters the liquefaction plant 102", the gas will be approximately 60° F. at a pressure of approximately 440 psia, with a flow of approximately 10,000 lbm/hr.

At state points 402 and 404, the flow will be split such that approximately 5,065 lbm/hr flows through state point 402 and approximately 4,945 lbm/hr flows through state point 404 with temperatures and pressures of each state point being similar to that of state point 400.

At state point 406, as the stream exits the turbo expander 156, the gas will be approximately −104° F. at a pressure of approximately 65 psia. At state point 408, as the gas exits the compressor 158, the gas will be approximately 187° F. at a pressure of approximately 770 psia.

At state point 410, after the first heat exchanger 220 and prior to the high efficiency heat exchanger 166, the gas will be approximately 175° F. at a pressure of approximately 770 psia. At state point 412, after water clean-up and about midway through the high efficiency heat exchanger 166, the gas will be approximately −70° F. at a pressure of approximately 766 psia and exhibit a flow rate of approximately 4,939 lbm/hr.

The gas exiting the high efficiency heat exchanger 166, as shown at state point 414, will be approximately −105° F. at a pressure of approximately 763 psia.

The flow through the product stream 172' at state point 418 will be approximately −205° F. at a pressure of approximately 761 psia with a flow rate of approximately 3,735 lbm/hr. At state point 420, after passing through the Joule-Thomson valve, and prior to entering the separator 180, the stream will become a mixture of gas, liquid natural gas, and solid $CO_2$ and will be approximately −240° F. at a pressure of approximately 35 psia. The slurry of solid $CO_2$ and liquid natural gas will have similar temperatures and higher pressures as it leaves the separator 180, however, it will have a flow rate of approximately 1,324 lbm/hr.

At state point 422, the pressure of the slurry will be raised, via the pump 260, to a pressure of approximately 114 psia and a temperature of approximately −236° F. At state point 424, after being separated via the hydrocyclone 258, the liquid natural gas will be approximately −235° F. at a pressure of approximately 68 psia with a flow rate of approximately 1,059 lbm/hr. The liquid natural gas will drop in pressure from approximately 68 psia to approximately 42 psia while flowing through piping 278, and will experience pressure losses as it passes through the $CO_2$ filters and exits the liquefaction plant 102" into a storage vessel 116 where it will be at a pressure of approximately 35 psia.

At state point 426 the thickened slush (including solid $CO_2$) exiting the hydrocyclone 258 will be approximately −235° F. at a pressure of approximately −68.5 psia and will flow at a rate of approximately 265 lbm/hr.

At state point 430, the gas exiting the separator 180 will be approximately −240° F. at a pressure of approximately 35 psia with a flow rate of approximately 263 lbm/hr.

At state point 434, the gas in the motive stream 284 entering into the eductor 282 will be approximately −105° F. at approximately 764 psia. The flow rate at state point 434 will be approximately 1,205 lbm/hr. At state point 436, subsequent the eductor 282, the mixed stream will be approximately −217° F. at approximately 70 psia with a combined flow rate of approximately 698 lbm/hr.

At state point 438, prior to JT valve 174', the gas will be approximately −205° F. at a pressure of approximately 761 psia with a flow rate of approximately 2,147 lbm/hr. At state point 440, after passing through JT valve 174', whereby solid $CO_2$ is formed, the slurry will be approximately −221° F. with a pressure of approximately 68.5 psia.

At state point 442, upon exiting heat exchanger 224, the temperature of the gas will be approximately −195° F. and the pressure will be approximately 65 psia. The flow rate at state point 442 will be approximately 3,897 lbm/hr. At state point 444, after combining two streams, the gas will have a temperature of approximately −151° F. and a pressure of approximately 65 psia.

At state point 446, upon exit from the high efficiency heat exchanger 166, and prior to discharge into the pipeline 104, the gas will have a temperature of approximately 99° F. and a pressure of approximately 65 psia. The flow rate at state point 446 will be approximately 8,962 lbm/hr.

EXAMPLE 2

Figure 23:
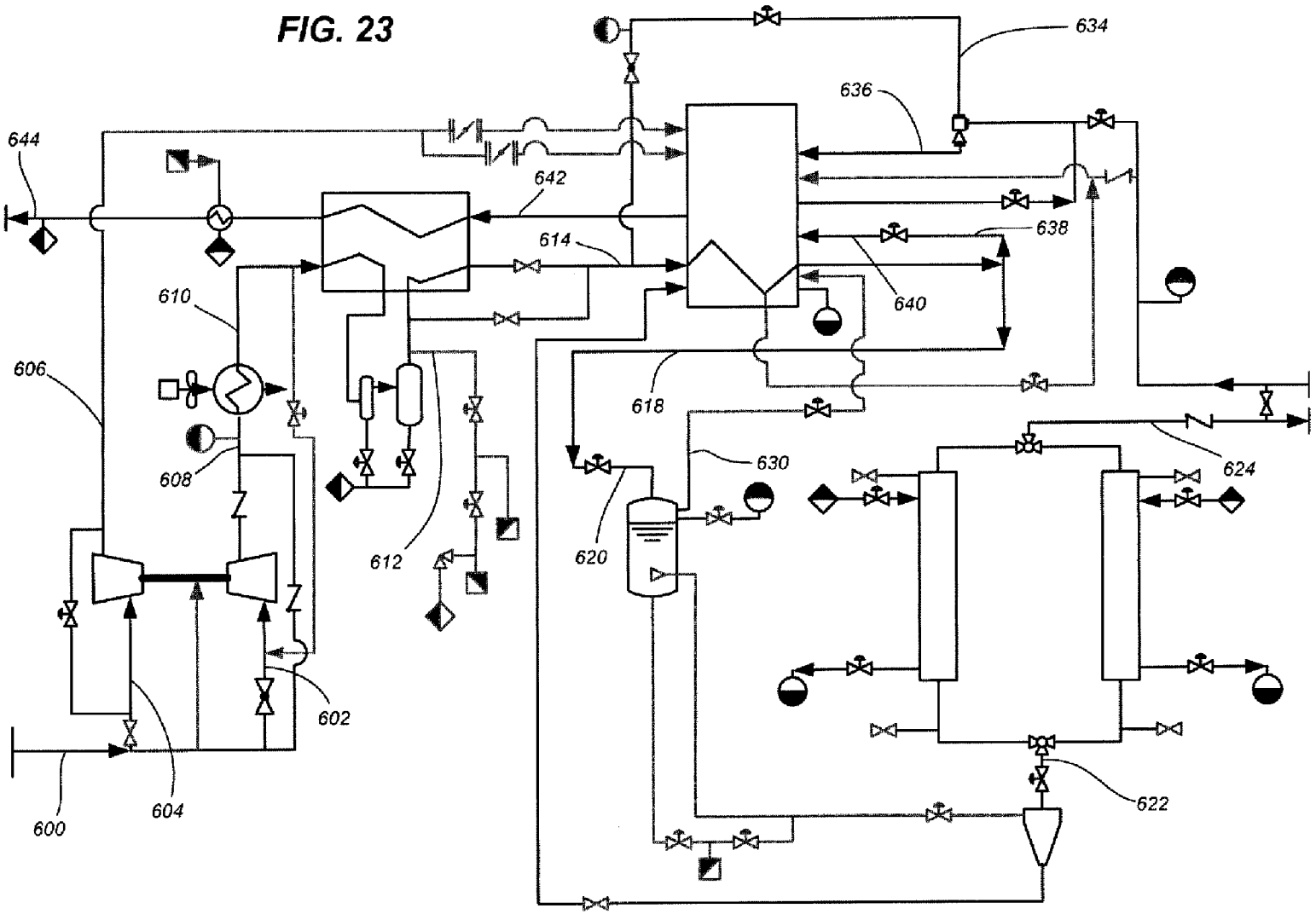
FIG. 23 is a process flow diagram showing state points of the flow mass throughout the system according to one embodiment of the present invention.

Referring now to FIGS. 18 and 23, an example of the process carried out in the liquefaction plant 502 is set forth. It is noted that FIG. 23 is the same process flow diagram as FIG. 18, but with component reference numerals omitted for clarity. As the general process has been described above with reference to FIG. 18, the following example will set forth examples of conditions of the gas/liquid/slurry at various locations throughout the liquefaction plant, referred to herein as state points, according to the calculated operational design of the liquefaction plant 502.

At state point 600, as the gas leaves the supply pipeline and enters the liquefaction plant 502, the gas will be approximately 51° F. at a pressure of approximately 464 psia with a flow of approximately 8,672 lbm/hr.

At state points 602 and 604, the flow will be split such that approximately 4,488 lbm/hr flows through state point 602 and approximately 4,184 lbm/hr flows through state point 604 with temperatures and pressures of each state point being similar to that of state point 600.

At state point 606, as the stream exits the turbo expander 156, the gas will be approximately −69° F. at a pressure of approximately 66 psia. At state point 608, as the gas exits the compressor 158, the gas will be approximately 143° F. at a pressure of approximately 674 psia.

At state point 610, after the first heat exchanger 220 and prior to the high efficiency heat exchanger 166, the gas will be approximately 128° F. at a pressure of approximately 674 psia. At state point 612, after water clean-up and about mid-way through the high efficiency heat exchanger 166, the gas will be approximately −86° F. at a pressure of approximately 668 psia.

The gas exiting the high efficiency heat exchanger 166, as shown at state point 614, will be approximately −115° F. at a pressure of approximately 668 psia.

The flow through the product stream 172' at state point 618 will be approximately −181° F. at a pressure of approximately 661 psia with a flow rate of approximately 549 lbm/hr. At state point 620, after passing through the Joule-Thomson valve 176', and prior to entering the separator 180, the stream will become a mixture of gas, liquid natural gas, and solid $CO_2$ and will be approximately −215° F. at a pressure of approximately 76 psia. The slurry of solid $CO_2$ and liquid natural gas will have similar temperatures and pressures as it leaves the separator 180, however, it will have a flow rate of approximately 453 lbm/hr.

At state point 622, after being separated via the hydrocyclone 258, the liquid natural gas will be approximately −220° F. at a pressure of approximately 65 psia with a flow rate of approximately 365 lbm/hr. At state point 624, after flowing through a polishing filter 266A or polishing filter 266B, the temperature of the liquid natural gas will be approximately −227° F. and the pressure will be approximately 51 psia. The state of the liquid natural gas will remain substantially the same as it exits the liquefaction plant 502 into a storage vessel or tank 116 (FIG. 1) with the allowance for some variation due to, for example, pressure losses due to piping.

At state point 624, the thickened slush (including solid $CO_2$) exiting the hydrocyclone 258 will be approximately −221° F. at a pressure of approximately −64 psia and will flow at a rate of approximately 89 lbm/hr.

At state point 630, the gas exiting the separator 180 will be approximately −218° F. at a pressure of approximately 64 psia with a flow rate of approximately 96 lbm/hr.

At state point 634, the gas in the motive stream 284 entering into the eductor 282 will be approximately −130° F. at approximately 515 psia. The flow rate at state point 634 will be approximately 1,015 lbm/hr. At state point 636, subsequent the eductor 282, the mixed stream 284 will be approximately −218° F. at approximately 64 psia with a combined flow rate of approximately 1,036 lbm/hr.

At state point 638, prior to JT valve 174', the gas will be approximately −181° F. at a pressure of approximately 661 psia with a flow rate of approximately 2,273 lbm/hr. At state point 640, after passing through JT valve 174', whereby solid $CO_2$ is formed, the slurry will be approximately −221° F. with a pressure of approximately 64 psia.

At state point 642, upon exiting the $CO_2$ heat exchanger 224, the temperature of the gas will be approximately −178° F. and the pressure will be approximately 63 psia. The flow rate at state point 642 will be approximately 7,884 lbm/hr.

At state point 644, upon exit from the high efficiency heat exchanger 166, and prior to discharge into the pipeline 104, the gas will have a temperature of approximately 61° F. and a pressure of approximately 62 psia. The flow rate at state point 644 will be approximately 7,884 lbm/hr.

The liquefaction processes depicted and described herein with respect to the various embodiments provide for low cost, efficient and effective means of producing LNG without the requisite "purification" of the gas before subjecting the gas to the liquefaction cycle. Such a process enables the use of relatively "dirty" gas typically found in residential and industrial service lines, eliminates the requirement for expensive pretreatment equipment and provides a significant reduction in operating costs for processing such relatively "dirty" gas.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A liquefaction plant comprising:

a first flow path defined and configured for sequential delivery of a first stream of natural gas through a compressor, a first side of a first heat exchanger and a first side of a second heat exchanger;

a second flow path defined and configured for sequential delivery of a second stream of natural gas through an expander, a second side of the second heat exchanger and a second side of the first heat exchanger; and at least two paths including a cooling path having a first expansion valve therein and a liquid production path having a second expansion valve therein formed from the first flow path at a location subsequent an intended flow of the first stream of natural gas through the first side of the second heat exchanger, wherein the cooling path selectively is defined and configured to direct at least a first portion of the first stream of natural gas to the second side of the second heat exchanger and wherein the liquid production path is defined and configured to selectively direct a second portion of the first stream of natural gas to a gas-liquid separator.

2. The liquefaction plant of claim 1, further comprising at least one hydrocyclone located and configured to receive a solid-liquid slurry from the gas-liquid separator, wherein an underflow of the at least one hydrocyclone is in fluid communication with the second side of the second heat exchanger.

3. The liquefaction plant of claim 2, further comprising at least one filter in fluid communication with an overflow of the at least one hydrocyclone.

4. The liquefaction plant of claim 1, further comprising valving and piping located and configured to selectively discharge the second stream of natural gas at least two different locations within the second side of the second heat exchanger.

5. The liquefaction plant of claim 1, wherein the first heat exchanger is configured as a countercurrent flow heat exchanger wherein the first side of the second heat exchanger includes a first heat exchange flow path and the second side of the second heat exchanger includes a second heat exchange flow path running countercurrent to the first heat exchange flow path.

6. The liquefaction plant of claim 5, further comprising valving and piping located and configured to selectively direct at least a portion of the first stream of natural gas out of the first heat exchange flow path and to the first side of the second heat exchanger so as to short circuit at least a portion of the first heat exchange flow path.

7. The liquefaction plant of claim 1, wherein the second heat exchanger includes at least one coil disposed within a shell, and wherein the first side of the second heat exchanger includes a flow path through the at least one coil and wherein the second side of the second heat exchanger includes a flow path between the at least one coil and the shell.

8. The liquefaction plant of claim 1, wherein the expander and the compressor are mechanically coupled to each other and wherein work derived from the expander drives the compressor.

9. The liquefaction plant of claim 8, further comprising a third flow path including a third stream of natural gas directed to at least one gas bearing associated with the mechanically coupled compressor and expander.

10. The liquefaction plant of claim 1, further comprising a third heat exchanger disposed between the compressor and the first side of the first heat exchanger such that first stream of natural gas sequentially flows from the compressor through the third heat exchanger and through the first side of the first heat exchanger.

11. A liquefaction plant comprising:

a first flow path configured for sequential delivery of a first stream of natural gas through a compressor, a first side of a first heat exchanger and a first side of a second heat exchanger;

a second flow path configured for sequential delivery of a second stream of natural gas through an expander, a second side of the second heat exchanger and a second side of the first heat exchanger;

at least two paths including a cooling path and a liquid production path formed from the first flow path at a location subsequent an intended flow of the first stream of natural gas through the first side of the second heat exchanger, the cooling path selectively configured to direct at least a first portion of the first stream of natural gas to the second side of the second heat exchanger and wherein the liquid production path is configured to selectively direct a second portion of the first stream of natural gas to a gas-liquid separator; and a surge protection loop comprising valving and piping located and configured to selectively direct at least a portion of the first stream of natural gas from a location between the compressor and the first side of the first heat exchanger back to an inlet of the compressor.

12. A liquefaction plant comprising:

a first flow path configured for sequential delivery of a first stream of natural gas through a compressor, a first side of a first heat exchanger and a first side of a second heat exchanger;

a second flow path configured for sequential delivery of a second stream of natural gas through an expander, a second side of the second heat exchanger and a second side of the first heat exchanger;

at least two paths including a cooling path and a liquid production path formed from the first flow path at a location subsequent an intended flow of the first stream of natural gas through the first side of the second heat exchanger, the cooling path selectively configured to direct at least a first portion of the first stream of natural gas to the second side of the second heat exchanger and wherein the liquid production path is configured to selectively direct a second portion of the first stream of natural gas to a gas-liquid separator; and valving and piping configured to direct a portion of the first stream of natural gas to the gas-liquid separator such that the portion of the first stream of natural gas bubbles through any liquid contained therein.

13. The liquefaction plant of claim 12, further comprising a converging nozzle disposed in the gas-liquid separator and coupled with an outlet thereof.

14. A liquefaction plant comprising:

a first flow path configured for sequential delivery of a first stream of natural gas through a compressor, a first side of a first heat exchanger and a first side of a second heat exchanger;

a second flow path configured for sequential delivery of a second stream of natural gas through an expander, a second side of the second heat exchanger and a second side of the first heat exchanger;

at least two paths including a cooling path and a liquid production path formed from the first flow path at a location subsequent an intended flow of the first stream of natural gas through the first side of the second heat exchanger, the cooling path selectively configured to direct at least a first portion of the first stream of natural gas to the second side of the second heat exchanger and the liquid production path is configured to selectively direct a second portion of the first stream of natural gas to a gas-liquid separator; and a source of methanol located and configured to introduce a volume of methanol into the first flow path at a location prior to an intended flow of natural gas through the compressor.

15. The liquefaction plant of claim 14, further comprising at least one separating device disposed in the first flow path located and configured to substantially remove the volume of methanol and any water associated therewith.

16. The liquefaction plant of claim 15, wherein the at least one separating device includes at least one coalescing filter.

17. A liquefaction plant comprising:

a first flow path configured for sequential delivery of a first stream of natural gas through a compressor, a first side of a first heat exchanger and a first side of a second heat exchanger;

a second flow path configured for sequential delivery of a second stream of natural gas through an expander, a second side of the second heat exchanger and a second side of the first heat exchanger;

at least two paths including a cooling path and a liquid production path formed from the first flow path at a location subsequent an intended flow of the first stream of natural gas through the first side of the second heat exchanger, the cooling path selectively configured to direct at least a first portion of the first stream of natural gas to the second side of the second heat exchanger and the liquid production path is configured to selectively direct a second portion of the first stream of natural gas to a gas-liquid separator;

a liquid storage tank and another flow path defined between the gas-liquid separator and the liquid storage tank, and a first vent line coupled with the gas-liquid separator and a valve disposed within the first vent line providing selective communication between the gas-liquid separator and the liquid storage tank such that, when the valve is in an open position, a pressure in the gas-liquid separator is substantially the same as a pressure in the liquid storage tank.

18. The liquefaction plant of claim 17, further comprising a second vent line extending from the gas-liquid separator and the second heat exchanger, and a back-pressure regulator coupled with the second vent line, wherein when the valve in the first vent line is closed, the back pressure regulator is configured to develop an increased pressure within the gas-liquid separator.

19. A method of producing liquid natural gas, the method comprising:

providing a source of unpurified natural gas and flowing a portion of the unpurified natural gas from the source;

dividing the portion of unpurified natural gas into at least a process stream and a cooling stream;

flowing the process stream sequentially through a compressor, a first side of a first heat exchanger and a first side of a second heat exchanger;

flowing the cooling stream sequentially through an expander, through a second side of the second heat exchanger and into the source;

sensing a temperature of the process stream after it exits the first side of the second heat exchanger;

flowing substantially all of the process stream from the first side of the second heat exchanger to the second side of the first heat exchanger if the sensed temperature is warmer than a specified temperature; and flowing a first portion of the process stream from the first side of the second heat exchanger to the second side of the second heat exchanger and flowing a second portion of the process stream from the first side of the second heat exchanger to a gas-liquid separator if the sensed temperature is colder than the specified temperature.

20. The method according to claim 19, wherein the specified temperature is between approximately −175° F. and −205° F.

21. The method according to claim 19, wherein flowing substantially all of the process stream from the first side of the second heat exchanger to the second side of the first heat exchanger further includes flowing at least a portion of the process stream through an expansion valve.

22. The method according to claim 19, wherein flowing a second portion of the process stream from the first side of the second heat exchanger to a gas-liquid separator further includes flowing the second portion of the process stream through an expansion valve.

23. The method according to claim 19, further comprising producing a slurry of liquid natural gas and solid carbon dioxide from the second portion of the process stream within the liquid-gas separator.

24. The method according to claim 23, further comprising agitating the slurry to keep the solid carbon dioxide substantially suspended within the liquid natural gas.

25. The method according to claim 24, wherein agitating the slurry further includes bubbling a gas through the slurry.

26. The method according to claim 25, wherein bubbling a gas through the slurry includes diverting another portion of the process stream to the liquid-gas separator.

27. The method according to claim 24, wherein agitating the slurry further includes effecting nucleate boiling within the liquid natural gas.

28. The method according to claim 24, further comprising flowing the slurry through a converging nozzle as it exits the liquid-gas separator.

29. The method according to claim 19, further comprising selectively flowing a slurry of liquid natural gas and solid carbon dioxide from the liquid-gas separator to a hydrocyclone.

30. The method according to claim 29, further comprising flowing a slush that is rich in solid carbon dioxide through an underflow of the hydrocyclone to the second side of the second heat exchanger.

31. The method according to claim 30, further comprising flowing liquid natural gas through an overflow of the hydrocyclone to a storage tank.

32. The method according to claim 30, further comprising maintaining a pressure within the gas-liquid separator and a pressure within the storage tank at a substantially common pressure while slurry is not flowing from the gas-liquid separator to the hydrocyclone.

33. The method according to claim 32, further comprising increasing the pressure within the gas-liquid separator to a pressure greater than the pressure in the storage tank when the slurry is flowing to the hydrocyclone.

34. The method according to claim 30, further comprising flowing the liquid natural gas through at least one filter prior to flowing the liquid natural gas to the storage tank.

35. The method according to claim 30, further comprising managing a composition of the slush by controlling a pressure differential between the underflow and the overflow of the hydrocyclone.

36. The method according to claim 29, further comprising subliming the solid carbon dioxide in the second side of the second heat exchanger.

37. The method according to claim 23, further comprising subcooling the solid carbon dioxide.

38. The method according to claim 19, further comprising flowing any vapor within the liquid-gas separator to the second side of the second heat exchanger.

39. The method according to claim 19, further comprising monitoring a flow rate of the process stream through the compressor and, if the monitored flow rate is less than a specified flow rate, diverting at least a portion of the process stream from a location between the compressor and the first side of the first heat exchanger to an inlet of the compressor.

40. The method according to claim 39, wherein the diverting further includes opening a valve disposed in piping that provides a flow path from the location between the compressor and the first side of the first heat exchanger and the inlet of the compressor.

41. The method according to claim 40, further comprising closing the valve when the monitored flow rate exceeds the specified flow rate.

42. The method according to claim 19, wherein flowing a first portion of the process stream from the first side of the second heat exchanger to the second side of the second heat exchanger and flowing a second portion of the process stream from the first side of the second heat exchanger to a gas-liquid separator if the sensed temperature is colder than the specified temperature includes controlling a flow rate of the first portion of the process stream and a flow rate of the second portion of the process stream based, at least in part, on the sensed temperature.

43. The method according to claim 42, wherein controlling a flow rate of the first portion of the process stream and a flow rate of the second portion of the process stream includes actuating at least one valve.

44. The method according to claim 43, wherein actuating at least one valve includes actuating at least a first valve associated with the flow of the first portion of the process stream and actuating at least a second valve associated with the flow of the second portion of the process stream.

45. The method according to claim 43, wherein controlling a flow rate of the first portion of the process stream and a flow rate of a second portion of the process stream and actuating at least one valve includes controlling the opening and closing of the at least one valve with a proportional, integral, derivative (PID) control loop.

46. The method according to claim 45, wherein controlling the opening and closing of the at least one valve with a proportional, integral, derivative (PID) control loop includes mapping a gain of a proportional control of the PID control loop against a temperature range.

47. The method according to claim 46, further comprising defining the temperature range based on a phase change of the unpurified natural gas between a liquid phase and a gas phase.

48. The method according to claim 47, further comprising defining the temperature range to be from approximately −205° F. to approximately −140° F.

* * * * *

UNITED STATES PATENT AND TRADEMARK OFFICE

CERTIFICATE OF CORRECTION

PATENT NO. : 7,594,414 B2
APPLICATION NO. : 11/381904
DATED : September 29, 2009
INVENTOR(S) : Bruce M. Wilding et al.

It is certified that error appears in the above-identified patent and that said Letters Patent is hereby corrected as shown below:

In the specification:

| | | |
|---|---|---|
| COLUMN 4, | LINE 15, | change "to cool to the" to --to cool the-- |
| COLUMN 4, | LINE 45, | change "solid is separated" to --solid are separated-- |
| COLUMN 4, | LINE 54, | change "gas flow" to --gas flowing-- |
| COLUMN 5, | LINE 47, | change "according an" to --according to an-- |
| COLUMN 6, | LINE 29, | change "may used" to --may be used-- |
| COLUMN 7, | LINE 44, | change "and or process" to --and/or process-- |
| COLUMN 8, | LINE 4, | change "feed gas **140**" to --feed gas **108**-- |
| COLUMN 8, | LINE 15, | change "feed gas (i.e.," to --feed gas **140** (i.e.,-- |
| COLUMN 10, | LINE 36, | change "result in a" to --results in a-- |
| COLUMN 11, | LINES 40,41 | change "America LEWA located" to --American LEWA, Inc., located-- |
| COLUMN 12, | LINES 32,33 | change "liquefaction-plant" to --liquefaction plant-- |
| COLUMN 12, | LINE 66, | change "Industries, Inc." to --Industries, Inc.,-- |
| COLUMN 14, | LINE 56, | change "streams through" to --streams **253** and **255** through-- |
| COLUMN 14, | LINE 57, | change "streams flow" to --streams **253** and **255** flow-- |
| COLUMN 15, | LINE 29, | change "diverter will" to --diverter **251**B will-- |
| COLUMN 15, | LINE 33, | change "will caused the" to --will cause the-- |
| COLUMN 15, | LINE 34, | change "two coils, as" to --two coils **232**A and **232**B, as-- |
| COLUMN 15, | LINE 50, | change "coils, respectively)." to --coils **232**A and **232**B, respectively).-- |
| COLUMN 16, | LINE 56, | change "coupled structural" to --coupled to structural-- |
| COLUMN 16, | LINE 66, | change "tank inputs" to --tank inlets-- |
| COLUMN 17, | LINES 19,20 | change "sepa-rator **260**" to --sepa-rator **180**-- |
| COLUMN 17, | LINE 26, | change "pump with" to --pump **260** with-- |
| COLUMN 18, | LINE 9, | change "depending of the" to --depending on the-- |
| COLUMN 18, | LINE 20, | change "an 8to 12" to --an 8 to 12-- |
| COLUMN 18, | LINE 46, | change "counter flowing" to --counterflowing-- |

Signed and Sealed this
Eighth Day of January, 2013

David J. Kappos

David J. Kappos
*Director of the United States Patent and Trademark Office*

In the specification (continued):

| | | |
|---|---|---|
| COLUMN 19, | LINE 6, | change "stream **154′**" to --stream **154″**-- |
| COLUMN 19, | LINE 8, | change "valve and" to --valve **280**A and-- |
| COLUMN 19, | LINE 12, | change "stream between" to --stream **154″** between-- |
| COLUMN 19, | LINE 27, | change "more or cooling" to --more of cooling-- |
| COLUMN 19, | LINE 46, | change "the plant" to --the liquefaction plant-- |
| COLUMN 20, | LINE 12, | change "**257**, **257′** flow" to --**257**, **257′**, flow-- |
| COLUMN 20, | LINE 13, | change "more or cooling" to --more of cooling-- |
| COLUMN 20, | LINE 16, | change "stream exiting" to --stream **286** exiting-- |
| COLUMN 21, | LINE 33, | change "compressor will" to --compressor **158** will-- |
| COLUMN 21, | LINE 36, | change "PDC **302** valve" to --PDC valve **302**-- |
| COLUMN 21, | LINE 54, | change "the circuit" to --the differential pressure circuit-- |
| COLUMN 22, | LINE 28, | change "plant **102″**." to --liquefaction plant **102″**.-- |
| COLUMN 22, | LINE 61, | change "plant **102″**" to --liquefaction plant **102″**-- |
| COLUMN 22, | LINE 65, | change "plant **102″**." to --liquefaction plant **102″**.-- |
| COLUMN 23, | LINE 4, | change "the liquefaction liquefaction" to --the liquefaction-- |
| COLUMN 23, | LINE 5, | change "the plant" to --the liquefaction plant **102″**-- |
| COLUMN 24, | LINE 32, | change "stream may" to --stream **152″** may-- |
| COLUMN 27, | LINE 19, | change "the valves' opening," to --the valve's opening,-- |
| COLUMN 27, | LINE 20, | change "the check, valve" to --the check valve-- |
| COLUMN 27, | LINE 34, | change "compressor is" to --compressor **158** is-- |
| COLUMN 28, | LINE 64, | change "gas bearings **536**." to --gas **536**.-- |
| COLUMN 29, | LINE 24, | change "**440** is" to --440 is-- |
| COLUMN 29, | LINE 53, | change "valves Cv" to --valve's Cv-- |
| COLUMN 30, | LINE 49, | change "valve leading to" to --leading to-- |
| COLUMN 31, | LINE 11, | change "loop) may" to --loop)) may-- |
| COLUMN 33, | LINE 5, | change "**440** is the" to --440 is the-- |
| COLUMN 35, | LINE 12, | change "plant **502**." to --liquefaction plant **502**.-- |
| COLUMN 35, | LINE 45, | change "at **566**." to --at **584′**.-- |
| COLUMN 36, | LINE 13, | change "the liquefaction liquefaction plant **102″**" to --the liquefaction plant **102″**-- |
| COLUMN 36, | LINE 53, | change "valve, and" to --valve **176′**, and-- |
| COLUMN 37, | LINE 47, | change "liquefaction plant," to --liquefaction plant **502**,-- |

In the claims:

| | | | |
|---|---|---|---|
| CLAIM 4, | COLUMN 39, | LINE 43, | change "at least" to --at at least-- |
| CLAIM 10, | COLUMN 40, | LINE 7, | change "that first" to --that the first-- |
| CLAIM 32, | COLUMN 42, | LINE 62, | change "while slurry" to --while the slurry-- |
| CLAIM 35, | COLUMN 43, | LINE 6, | change "the overflow" to --an overflow-- |